US006527209B1

(12) United States Patent
Dorscht

(10) Patent No.: US 6,527,209 B1
(45) Date of Patent: Mar. 4, 2003

(54) COMMINUTING APPARATUS

(76) Inventor: John Dorscht, 69 Georgian Crescent, Kitchener, Ontario (CA), N2B 3N8

( * ) Notice: Subject to any disclaimer, the term of this patent is extended or adjusted under 35 U.S.C. 154(b) by 0 days.

(21) Appl. No.: 09/546,903

(22) Filed: Apr. 10, 2000

(51) Int. Cl.[7] ..... B02B 5/02

(52) U.S. Cl. ..... 241/101.2; 241/101.76; 241/236

(58) Field of Search ..... 241/236, 101.2, 241/101.76

(56) References Cited

U.S. PATENT DOCUMENTS

| | | | | |
|---|---|---|---|---|
| 3,703,970 A | | 11/1972 | Benson | |
| 5,094,392 A | | 3/1992 | Szombathy | |
| 5,320,293 A | | 6/1994 | Laly et al. | |
| 5,595,350 A | | 1/1997 | Massaro, Jr. et al. | |
| 5,680,999 A | * | 10/1997 | Wada | 241/236 |
| 5,975,447 A | * | 11/1999 | Brusseau | 241/274 |

OTHER PUBLICATIONS

Internet web page printout regarding SSI (Shredding Systems, Inc.) Quad four–shaft shredder.
Internet web page printout regarding TRYCO/UNTHA International Model RS–30.
Internet web page printout regarding West Salem Machinery Co. Model 1662 HT.
Internet web page printout regarding ZEHR Manufacturing Model HG–2000.
Internet web page printout regarding Packer Industries, Inc. Model 750.
Waste News, Mar. 20, 2000, p. 17, Advance Lifts, Inc. Model APM–4854.

* cited by examiner

*Primary Examiner*—Mark Rosenbaum
(74) *Attorney, Agent, or Firm*—R. Craig Armstrong

(57) ABSTRACT

A shredding apparatus comprises a plurality of rotatable rolls, each one of the rolls being rotatable around an axis of rotation in a first direction of rotation or a second direction of rotation. Each roll further has a plurality of angled replaceable teeth, which are arranged in at least one first set of teeth arranged in a first helical line across an outer surface of each roll, circumferentially spaced apart a first angle and facing the first direction of rotation. Further, at least one second set of teeth is arranged in a second helical line across the outer face of each roll, circumferentially spaced apart the first angle and facing the second direction of rotation. The first helical line and the second helical line of teeth are arranged to axially (in the longitudinal direction of the rolls) move material to be shredded when the rolls are rotated. Further, the shredding apparatus has a frame structure with roll holding means, for journalling the plurality of rolls in a spaced apart relationship to form a bed of rolls. The frame structure is surrounded by an enclosure provided with a charging opening for material to be shredded and a discharging opening for shredded material. A reversible drive means supplies rotation force to rotate the plurality of rolls, and a plurality of gear means, arranged one for each roll, transfers the rotation force from one roll to an adjacent roll so that adjacent rolls rotate in opposite directions of rotation.

16 Claims, 52 Drawing Sheets

COMMINUTING APPARATUS

BACKGROUND OF THE INVENTION

1. Field of the Invention

This invention relates to comminuting or shredding apparatuses, and particularly to shredders having a plurality of rotating rolls provided with teeth. Most particularly, the shredder is of a type for shredding waste wood such as pallets, crating, stumps and other construction material, for example cardboard and other organic material.

2. Description of the Prior Art

Traditionally, a rotating roll comminuting apparatus has one or more rolls provided with teeth or other protrusions, which cooperate with non-rotating anvil structures to break up material. Comminuting apparatuses of this type are disclosed in U.S. Pat. No. 3,703,970 (Benson), U.S. Pat. No. 5,320,293 (Laly et al.) and U.S. Pat. No. 5,094,392 (Szombathy), for example.

The traditional comminuting apparatuses all share a number of apparent disadvantages and drawbacks. They are relatively complicated in their roll teeth/anvil structure, which makes their manufacture expensive. When the roll teeth/anvil structure gets worn, it is complicated, and therefor expensive, to replace or repair this structure. The teeth have to be cut off and new teeth welded in place, or a new roll have to be installed and the old roll sent for repair.

SUMMARY OF THE INVENTION

It is an object of the invention to mitigate and/or obviate the above mentioned disadvantages and drawbacks to provide a shredding apparatus, which is easy and cheap to manufacture and assemble and which provides the required shredding capacity.

A further object of the invention is to provide a shredding apparatus, which spreads the material to be shredded over a large area of the plurality of rotating rolls, in order to enhance the output of the shredder and at the same time avoiding material bridging (material to be shredded is stuck above the rolls because it is squeezed by other pieces of material to be shredded, held by the surrounding walls etc.).

Yet a further object of the invention is to provide a shredding apparatus, which provides an axial flow of the material to be shredded along the longitudinal direction of the rolls, for further eliminate material gliding above the rolls.

Still a further object of the invention is to provide a shredding apparatus, which provides reversible rolls having equal shredding capabilities in either direction of rotation, to effect reflow and agitation of the material to be shredded.

Another object of the invention is to provide a shredding apparatus, which controls the depth of the cut of the shredding rolls into the material to be shredded.

A further object of the invention is to provide a shredding apparatus, in which the smaller size material, which is not required to be sized, freely falls through the shredding roll construction, to reduce wear and tear on the rolls.

In the invention, a shredding apparatus comprises a plurality of rotatable rolls, each one of the rolls being rotatable around an axis of rotation in a first direction of rotation or a second direction of rotation. Each roll further has a plurality of angled replaceable teeth, which are arranged in at least one first set of teeth arranged in a first helical line across an outer surface of each roll, circumferentially spaced apart a first angle and facing the first direction of rotation. Further, at least one second set of teeth is arranged in a second helical line across the outer face of each roll, circumferentially spaced apart the first angle and facing the second direction of rotation. The first helical line and the second helical line of teeth are arranged to axially (in the longitudinal direction of the rolls) move material to be shredded when the rolls are rotated. Further, the shredding apparatus has a frame structure with roll holding means, for journalling the plurality of rolls in a spaced apart relationship to form a bed of rolls. The frame structure is surrounded by an enclosure provided with a charging opening for material to be shredded and a discharging opening for shredded material. A reversible drive means supplies rotation force to rotate the plurality of rolls, and a plurality of gear means, arranged one for each roll, transfers the rotation force from one roll to an adjacent roll so that adjacent rolls rotate in opposite directions of rotation.

The plurality of rolls preferably comprises at least 4 rolls, preferably 4, 6, 8, 10, 11 or 12 rolls.

The first angle is preferably 15, 30, 45, 60 or 90 degrees.

Each roll is advantageously arranged on the frame roll holding means so that each of the at least one first and at least one second helical line of teeth is offset a second angle with respect to the at least one first and at least one second helical line of teeth of adjacent rolls. The second angle is preferably 6, 8, 10 or 12 degrees.

Each roll arranged in a middle portion of the bed of rolls is preferably held in a lower position compared to the rolls arranged towards either of two outer sides of the bed of rolls, forming sloping sides of the bed of rolls down towards the middle of the bed of rolls in the longitudinal direction of the bed of rolls, to force material to be shredded to be moved from the outer sides to the middle portion of the bed of rolls. Thus, the bed of rolls is shaped as a curve, having the outer rolls at a higher elevation than the middle rolls.

The teeth of the at least one first and the at least one second set of teeth of each of the rolls are preferably arranged so that only one tooth is engaging the material to be shredded at one time during the rotation of the roll. Alternatively, the teeth of the at least one first and the at least one second set of teeth of each of the rolls are arranged so that at least two teeth are engaging the material to be shredded at one time during the rotation of said roll.

The rolls further preferably have sizing discs arranged around a circumference of each roll, the sizing discs being positioned along the outer surface of each roll, where each sizing disc of one roll is placed so that sizing discs of an adjacent roll do not occupy the same space as the sizing discs of the one roll.

In one embodiment of the invention, the reversible drive means comprises at least one internal combustion engine. Alternatively, the reversible drive means comprises at least one electric motor, at least one hydraulic motor or at least one pneumatic motor. In a further embodiment of the invention, the reversible drive means comprises a first hydraulic cylinder and a second hydraulic cylinder, the first cylinder being anchored at one end and attached to a first gear means of a first roll at a first off-centre mounting means on the first gear means, the second cylinder being anchored at one end and attached to a second gear means of a second roll at a second off-centre mounting means on the second gear means, so that when the first cylinder is extended or retracted, the first gear means is made to rotate around the axis of rotation for the first roll, and when the second cylinder is extended or retracted, the second gear means is made to rotate around the axis of rotation for the second roll, causing the plurality of rolls to rotate driven by the plurality of gear means for each roll. The first off-centre mounting means and the second off-centre mounting means are arranged at different angular locations on the first and second gear means, respectively, to prevent stalling of rotation force transfer from the first and second cylinders.

The reversible drive means further advantageously comprises a pressure sensing means connected to automatically reverse the roll rotation directions when the pressure sensing means senses that material to be shredded is stuck in the plurality of rolls.

The reversible drive means further preferably comprises a timer arrangement to periodically reverse the roll rotation direction.

The shredding apparatus further comprises a plurality of vertically extendible/contractible and horizontally spaceable main legs, to provide support for the shredding apparatus during shredding, and a plurality of extendible and contractible lifting legs, to lift the shredding apparatus off ground, so that the main legs can be spaced apart and extended or contracted and spaced together for providing self-loading and self-erecting capabilities to the shredding apparatus.

Preferably, the main legs comprise a first leg assembly and a second leg assembly, arranged on opposite sides of the frame. The first leg assembly comprises a first main housing attached to the frame via first frame extensions, a first main leg extending from the first main housing, protruding substantially downwards, at a first end of the first main housing and a second main leg, protruding substantially downwards, from a second end of the first main housing. The first main leg is held by a first holding means, slidingly arranged in the first main housing at the first end, between a retracted position and an extended position. The second main leg is held by a second holding means, slidingly arranged in the first main housing at the second end, between a retracted position and an extended position. The second leg assembly comprises a second main housing attached to the frame via second frame extensions. A third main leg extends from the second main housing, protruding substantially downwards, at a third end of the second main housing and a fourth main leg, protrudes substantially downwards, from a fourth end of the second main housing. The third main leg is held by a third holding means, slidingly arranged in the second main housing at the third end, between a retracted position and an extended position. The fourth main leg is held by a fourth holding means, slidingly arranged in the second main housing at the fourth end, between a retracted position and an extended position.

The sliding motion of the first holding means and the second holding means is preferably provided by at least one first fluid cylinder arranged inside the first main housing, and the sliding motion of the third holding means and the fourth holding means is preferably provided by at least one second fluid cylinder arranged inside the first main housing.

A first lifting leg and a second lifting leg are preferably arranged at the first frame extension, the first lifting leg and the second lifting leg being extendably arranged in a downward direction, between a fully retracted position and a fully extended position. The first lifting leg and the second lifting leg are extendable further downwards than the first main leg and the second main leg. A third lifting leg and a fourth lifting leg are preferably arranged at the second frame extension, the third lifting leg and the fourth lifting leg being extendably arranged in a downward direction, between a fully retracted position and a fully extended position. The third lifting leg and the fourth lifting leg are extendable further downwards than the third main leg and the fourth main leg.

The rolls are preferably arranged with their longitudinal direction running from the first leg assembly to the second leg assembly. Alternatively, the rolls are arranged with their longitudinal direction perpendicular to a line connecting the first leg assembly and the second leg assembly.

The enclosure advantageously comprises four substantially horizontal walls, the rolls forming the entire bottom part of the enclosure, so that material to be shredded only flows through the rolls.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1A:
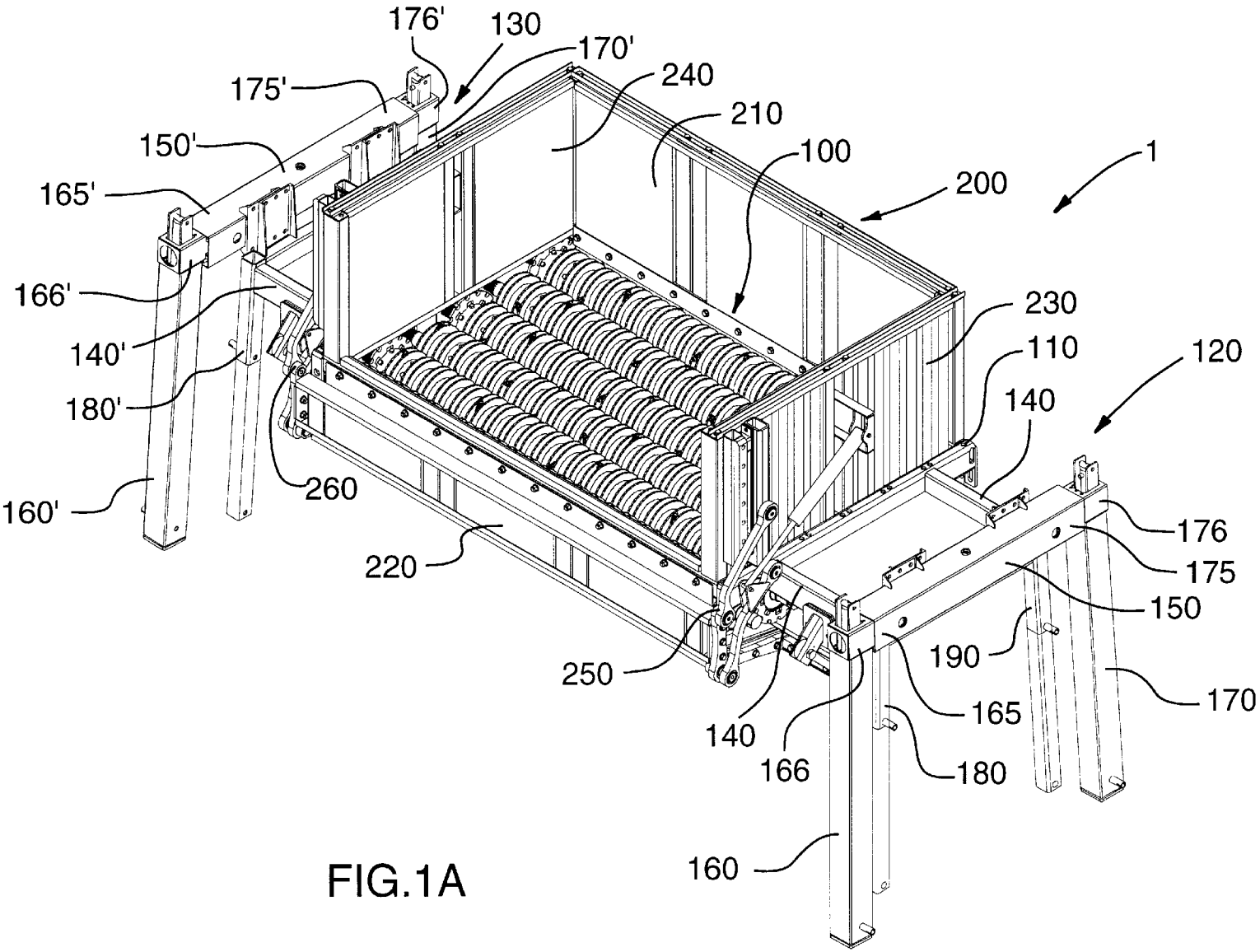
FIG. 1A is a schematic elevational perspective side view of a shredding apparatus according to the invention, showing the charging door lowered for placing material in the shredding apparatus.

Referring to FIGS. 1A to 4B, a shredding apparatus 1 according to the invention has a plurality of rotatable rolls 100 arranged in a side-by-side pattern forming a roll bed, so that the longitudinal directions of the rolls are substantially parallel with each other. Each roll is rotated in a direction opposite to the rotation direction of any adjacent rolls. How this is accomplished will be detailed later. The plurality of rolls 100 are held by a frame 110, which is preferably of a generally rectangular shape held in a substantially horizontal plane. Attached to the frame are advantageously a first leg assembly 120 and a second leg assembly 130, arranged on opposite sides of the frame. Preferably, the plurality of rolls 100 are arranged with their longitudinal direction between the first leg assembly and the second leg assembly, although it is possible to arrange the rolls so that their longitudinal directions are substantially perpendicular to a line connecting the first leg assembly and the second leg assembly. The first leg assembly 120 is preferably attached to the frame 110 via first frame extensions 140, and comprises a first main housing 150. From the first main housing extends a first main leg 160, protruding substantially downwards, at a first end 165 of the first main housing and a second main leg 170, protruding substantially downwards, from a second end 175 of the first main housing. The first main leg is held by a first holding means 166, which is slidingly arranged in the first main housing 150 at the first end 165, between a retracted position and an extended position. Similarly, the second main leg 170 is held by a second holding means 176, which is slidingly arranged in the first main housing 150 at the second end 175, between a retracted position and an extended position. The sliding motion of the first and second holding means is preferably provided by one or more fluid cylinders (not shown) arranged outside or, preferably, inside the first main housing. If one cylinder is used, it will be of the double-action type, having two opposite rams. If two cylinders are used, one will move the first holding means 166 and the other will move the second holding means 176. For balance reasons, it is advantageous that the two holding means move in synchronization. Further, a first lifting leg 180 and a second lifting leg 190 are arranged at the first frame extensions 140 or, alternatively, at the first main housing 150 (this arrangement is not shown). The first lifting leg and the second lifting leg are extendably arranged in a downward direction, between a fully retracted position and a fully extended position, where the lifting leg extends further downwards than the adjacent main leg. The extending motion is preferably provided by fluid cylinders arranged in or on each lifting leg.

Similarly, arranged on a side of the frame 110 opposite to the first leg assembly, attached to the frame is the second leg assembly 130. The second leg assembly 130 is preferably attached to the frame 110 via second frame extensions 140', and comprises a second main housing 150'. From the second main housing extends a third main leg 160', protruding substantially downwards, at a first end 165' of the second main housing and a fourth main leg 170', protruding substantially downwards, from a second end 175' of the second main housing. The third main leg is held by a third holding means 166', which is slidingly arranged in the second main housing 150' at the first end 165', between a retracted position and an extended position. Similarly, the fourth main leg 170' is held by a fourth holding means 176', which is slidingly arranged in the second main housing 150' at the second end 175', between a retracted position and an extended position. The sliding motion of the third and fourth holding means is preferably provided by one or more fluid cylinders (not shown) arranged outside or, preferably, inside the second main housing. If one cylinder is used, it will be of the double-action type, having two opposite rams. If two cylinders are used, one will move the third holding means 166' and the other will move the fourth holding means 176'. For balance reasons, it is advantageous that the two holding means move in synchronization. Further, a third lifting leg 180' and a fourth lifting leg 190' (see FIG. 2A) are arranged at the second frame extensions 140' or, alternatively, at the second main housing 150' (this arrangement is not shown). The third lifting leg and the fourth lifting leg are extendably arranged in a downward direction, between a fully retracted position and a fully extended position where the lifting leg extends further downwards than the adjacent main leg. The extending motion is preferably provided by fluid cylinders arranged in or on each lifting leg.

Figure 1B:
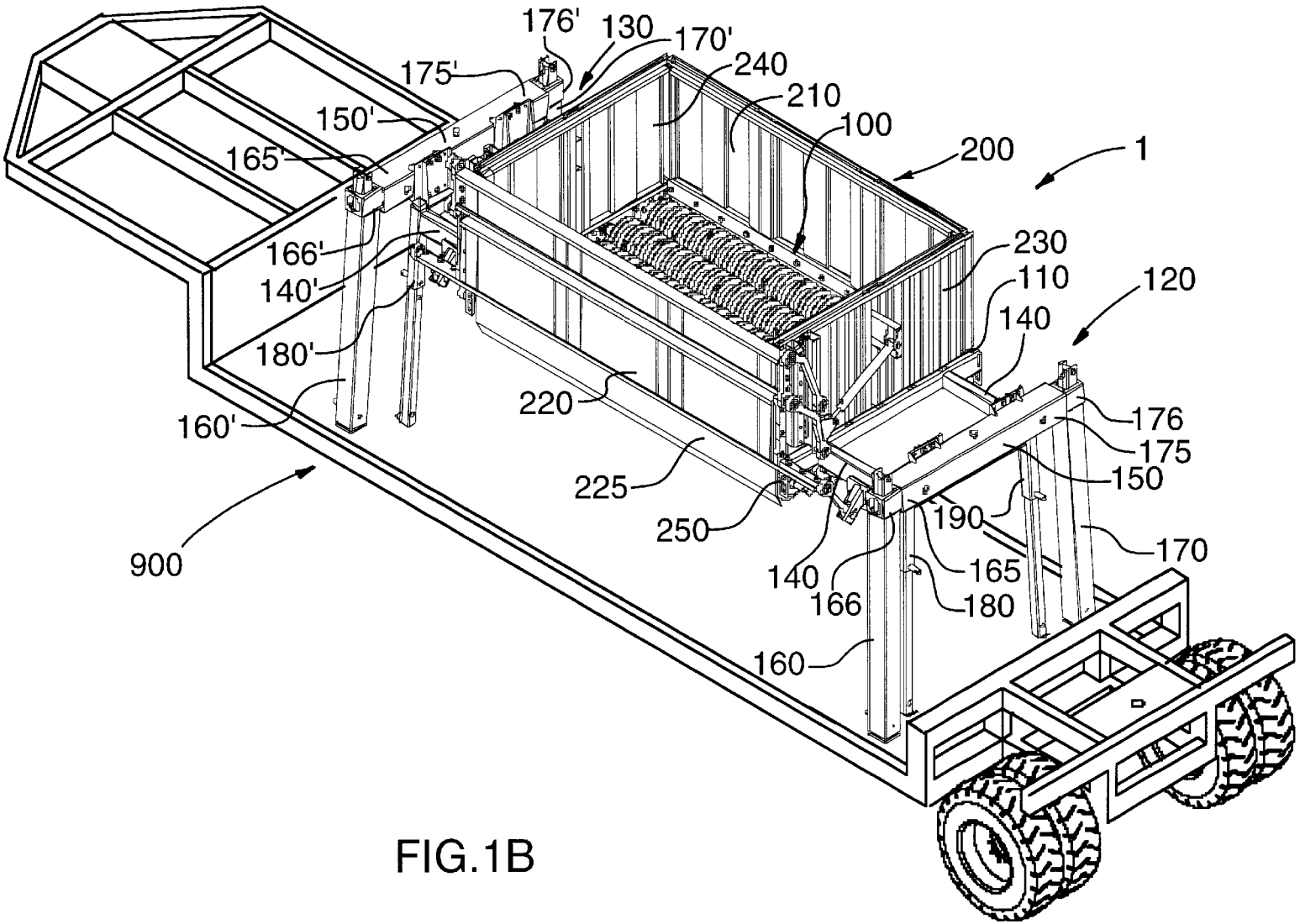
FIG. 1B is a schematic elevational perspective side view of a shredding apparatus according to the invention, showing the shredding apparatus placed on a flatbed type trailer and the charging door raised.
Figure 1C:
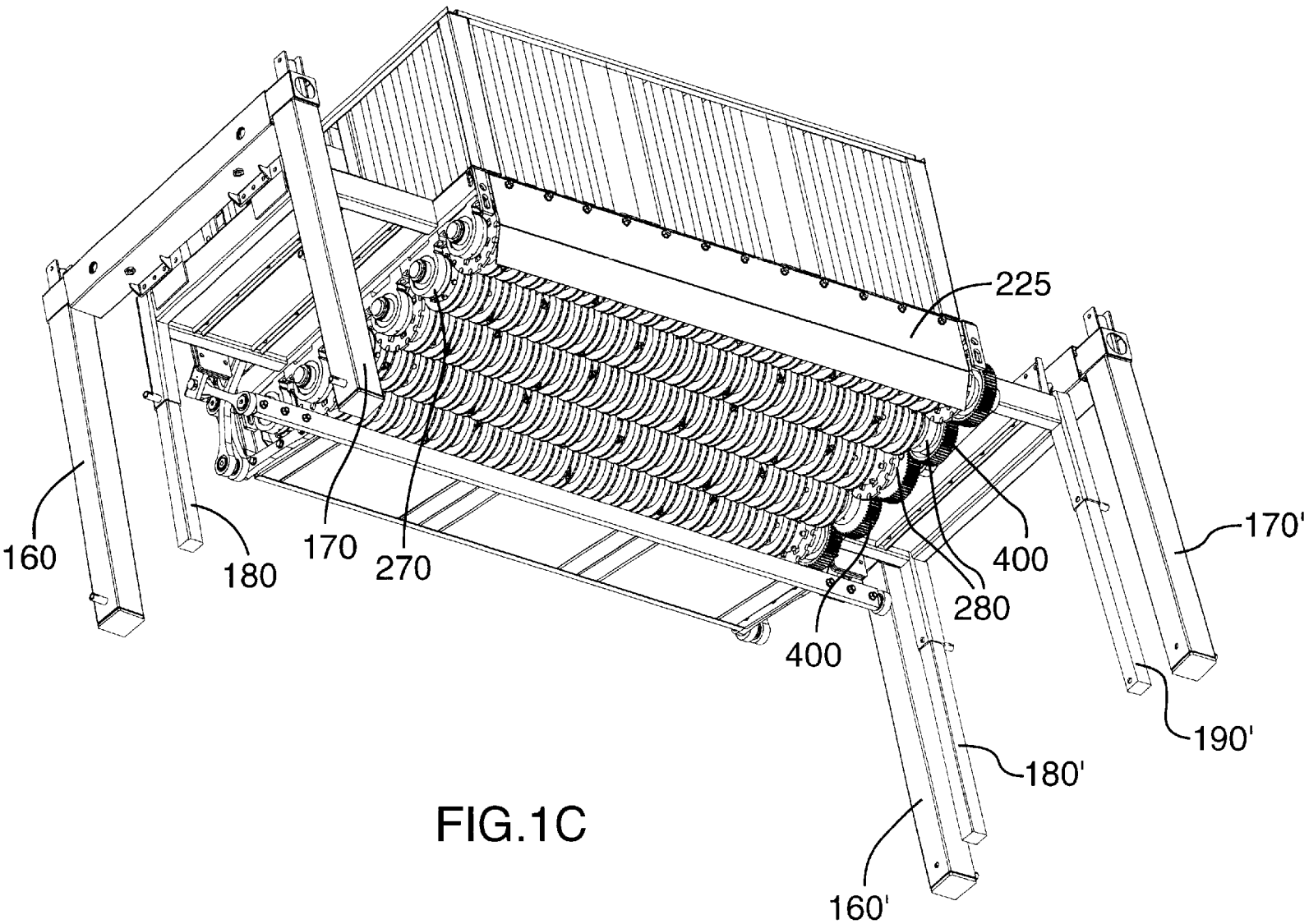
FIG. 1C is a schematic perspective side view from below of a shredding apparatus according to the invention, showing the support legs in a position for transportation of the shredding apparatus.
Figure 1D:
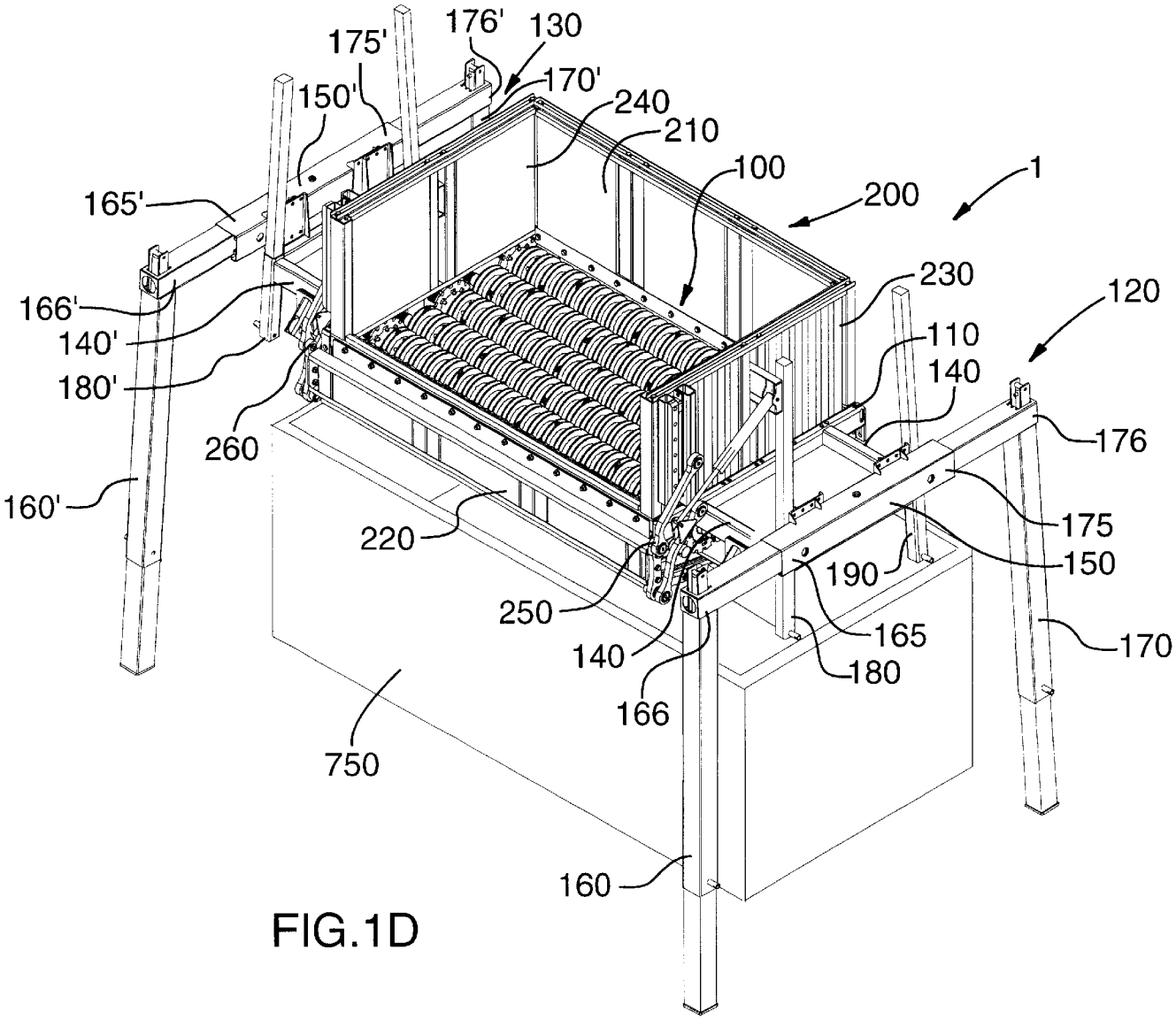
FIG. 1D is a schematic elevational perspective side view of a shredding apparatus according to the invention, showing the support legs in a position for shredding use of the shredding apparatus, and showing a container placed under the shredding apparatus for collecting the shredded material.
Figure 1E:
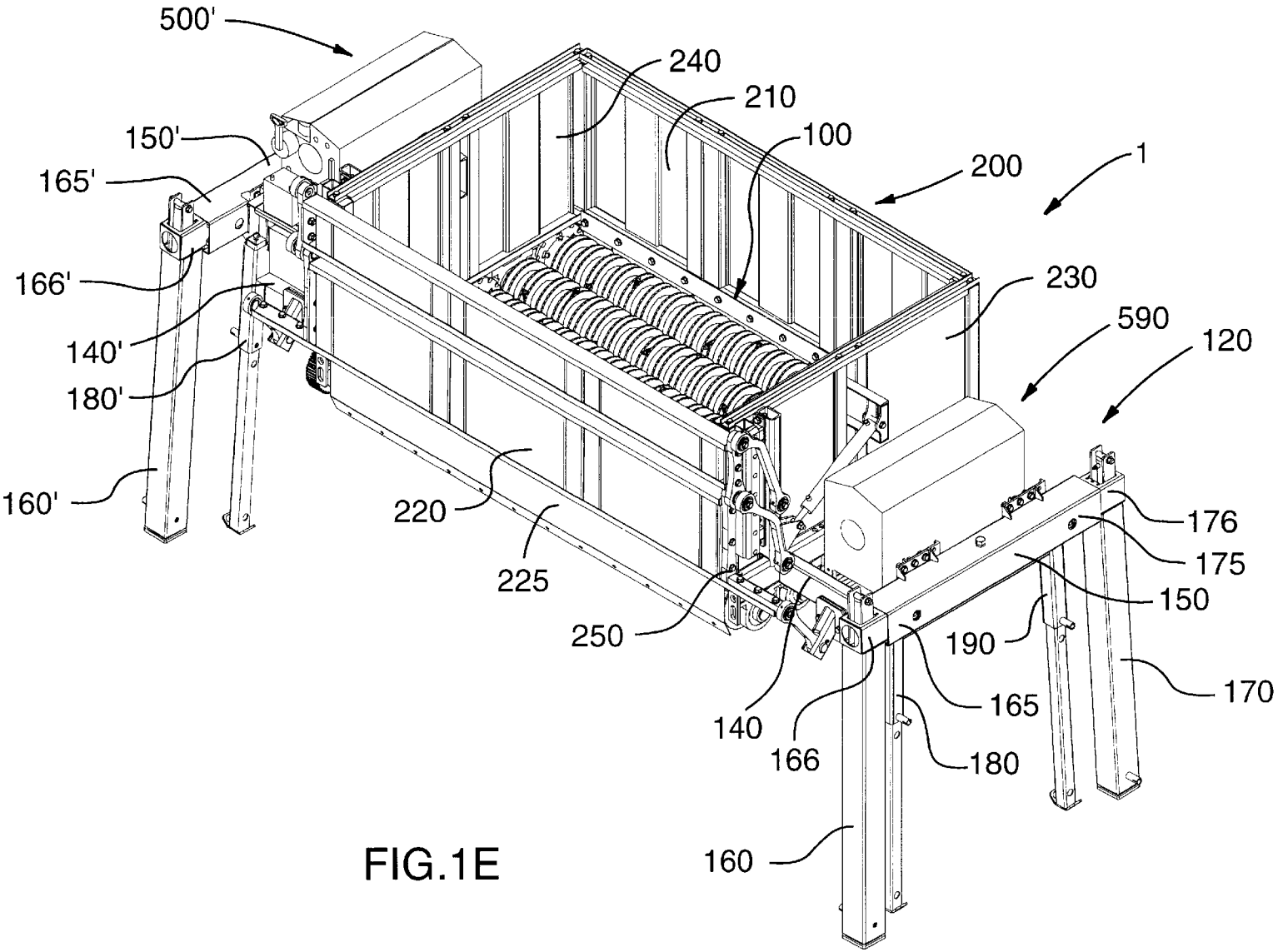
FIG. 1E is a schematic elevational perspective side view of a shredding apparatus according to the invention, showing the alternative drive means for the rolls being a hydraulic motor.

The shredding apparatus 1 is transported, for instance on a flat-bed trailer 900, with the first, second, third and fourth main legs 160, 170, 160', 170', respectively, in their retracted positions, i.e. the first, second, third and fourth holding means 166, 176, 166', 176', respectively, are fully retracted towards the respective first or second main housing 150, 150', respectively, see FIG. 1B. The first, second, third and fourth lifting legs 180, 190, 180', 190', respectively, are also fully retracted. The shredding apparatus thus rests on the main legs, which are in their retracted position, minimizing the width of the shredding apparatus.

In preparing the shredding apparatus 1 for use, for example at a building site where wood or similar waste material is to be shredded, the transport vehicle is parked at the desirable shredding site and the first, second, third and fourth lifting legs 180, 190, 180', 190', respectively, are moved to their respective fully extended positions, thereby lifting the shredding apparatus 1 so that it does not rest on the main legs anymore, see FIGS. 9A to 9H. During transport, the lifting legs are fully extended, and also the main legs are extended to make contact with the carrying surface of the vehicle/trailer. The shredding apparatus, as loaded onto a vehicle, conforms to legal requirements regarding load height and width, because the main legs are horizontally movable. The first, second, third and fourth main legs 160, 170, 160', 170', respectively, are moved to their fully extended positions, i.e. the first, second, third and fourth holding means 166,176,166', 176', respectively, are fully extended from the respective first or second main housing 150, 150', respectively. Thereafter, the first, second, third and fourth lifting legs 180, 190, 180', 190', respectively, are moved to their respective fully retracted positions, thereby lowering the shredding apparatus 1 so that it rests solely on the main legs. Because the main legs are now further spread apart, the whole shredding apparatus 1 is in a more stable position and ready for use. A container 750 is preferably positioned underneath the plurality of rolls 100 before operation of the shredder begins, to collect the shredded material. The container is preferably a roll-off bin (adapted to be transported by roll-off trucks) or a tin scow. In certain applications, for example when shredding stumps, it is desirable to shred directly to the ground surface, for later removal of the shredded material. In this case, the container is not needed.

Figure 1F:
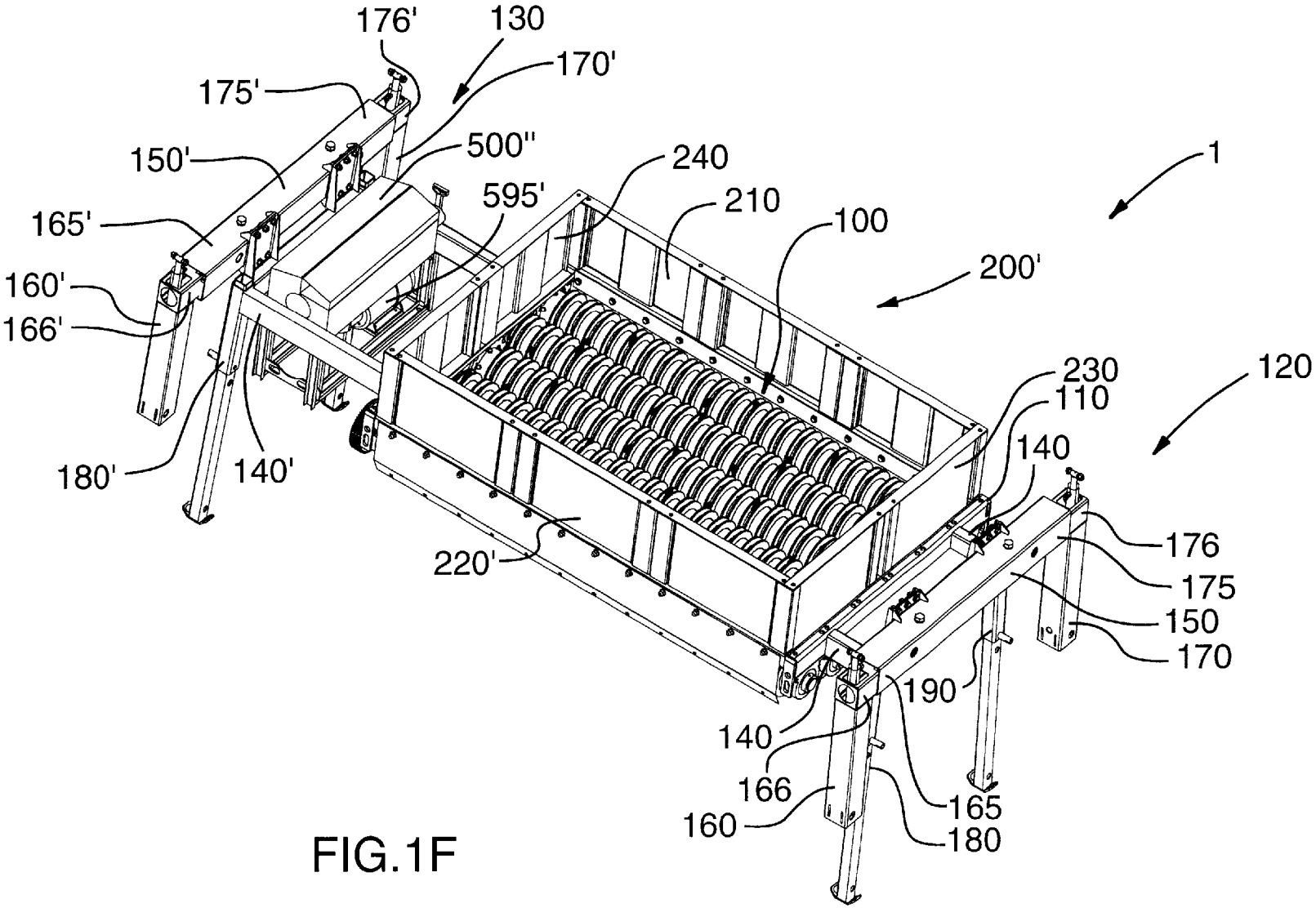
FIG. 1F is a schematic elevational perspective side view of a shredding apparatus according to the invention, showing the alternative drive means for the rolls being an electric motor.

The shredding apparatus 1 further comprises an enclosure 200 (hopper), substantially surrounding a space above the plurality of rolls 100. The enclosure preferably has a back 210, a movable front (door) 220 (see FIG. 2A), a first side 230 and a second side 240. The front is movable from a closed position, in which it abuts the first and second sides, to an open position, in which it is held substantially horizontal underneath the plurality of rolls 100. The movement of the front 220 is provided by a first hinge means 250, preferably arranged on the side of the frame 110 where the first leg arrangement 120 is found, and a second hinge means 260, preferably arranged on the side of the frame where the second leg arrangement 130 is found. A door shield 225 is arranged on the frame 110 on the side of the front 220, to protect the plurality of rolls 100 from being damaged by the moving front, when the front is lowered towards its open position. The door shield only partially covers the bottom of the roll closest to the front of the enclosure 200, to not obstruct the flow of shredded material through the plurality of rolls 100. Advantageously, a door shield 225 is arranged at the side of the back 210 also, with the same features as the door shield arranged at the front. An alternative embodiment of an enclosure 200' is shown in FIG. 1F, in which the front 220' is fixedly attached to the first side 230 and the second side 240. In this case, any charging of the enclosure will have to be done from above (over the sides or the front/back portions.

Figure 2A:
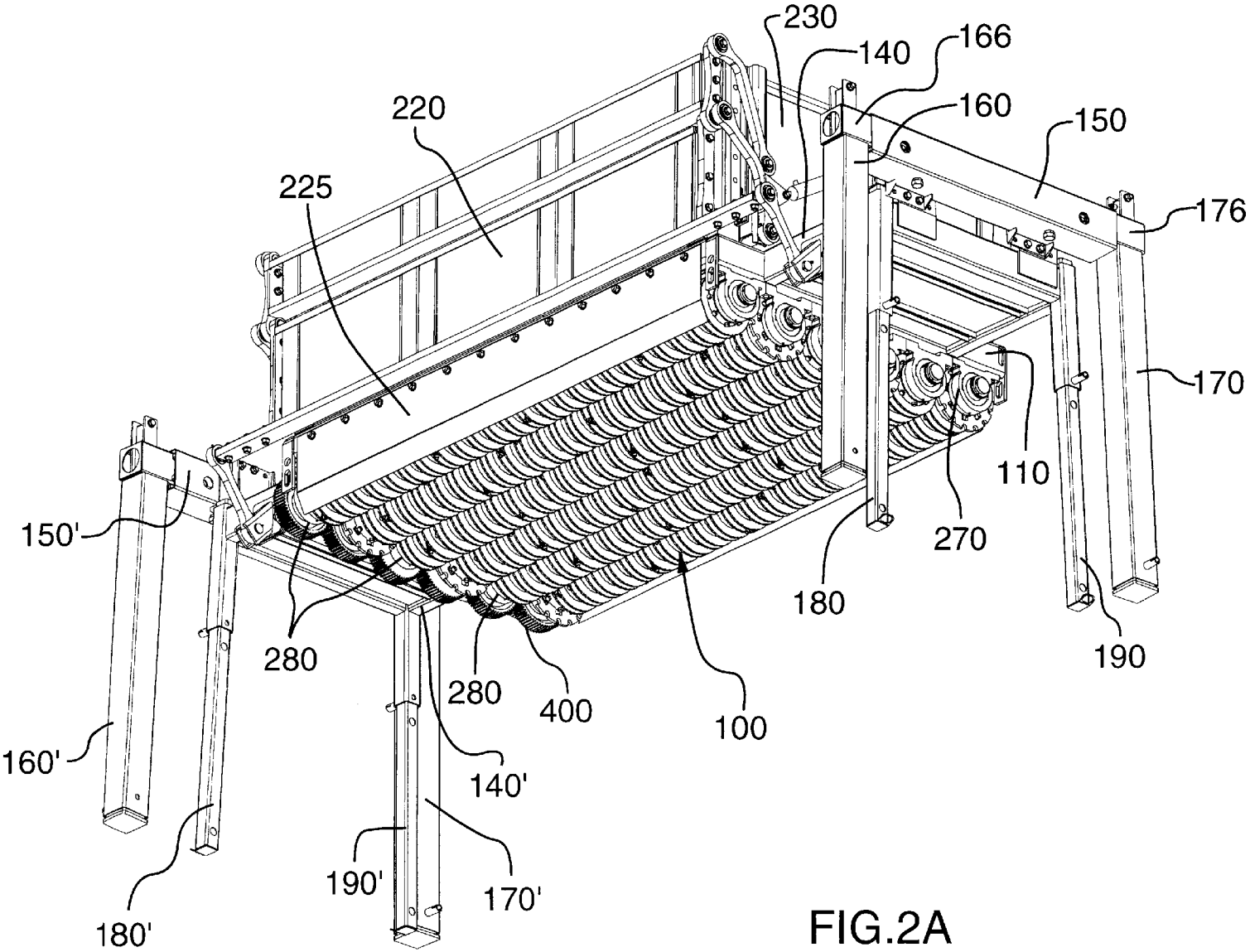
FIG. 2A is a schematic perspective side view from below of a shredding apparatus according to the invention, showing the apparatus from the opposite side from the roll drive side, with the charging door closed.
Figure 2B:
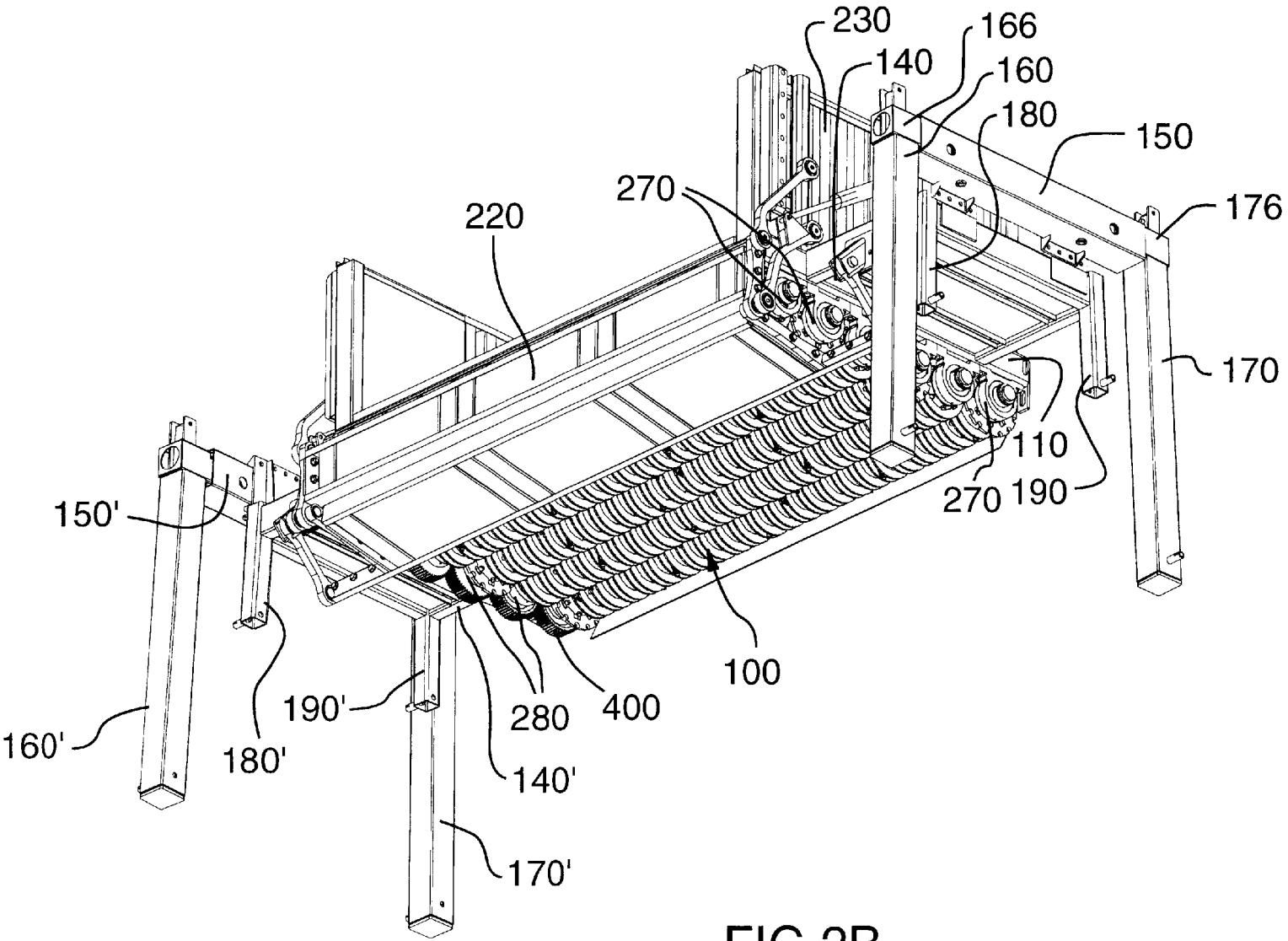
FIG. 2B is a schematic perspective side view from below of a shredding apparatus according to the invention, showing the apparatus from the opposite side from the roll drive side, with the charging door opened.
Figure 2C:
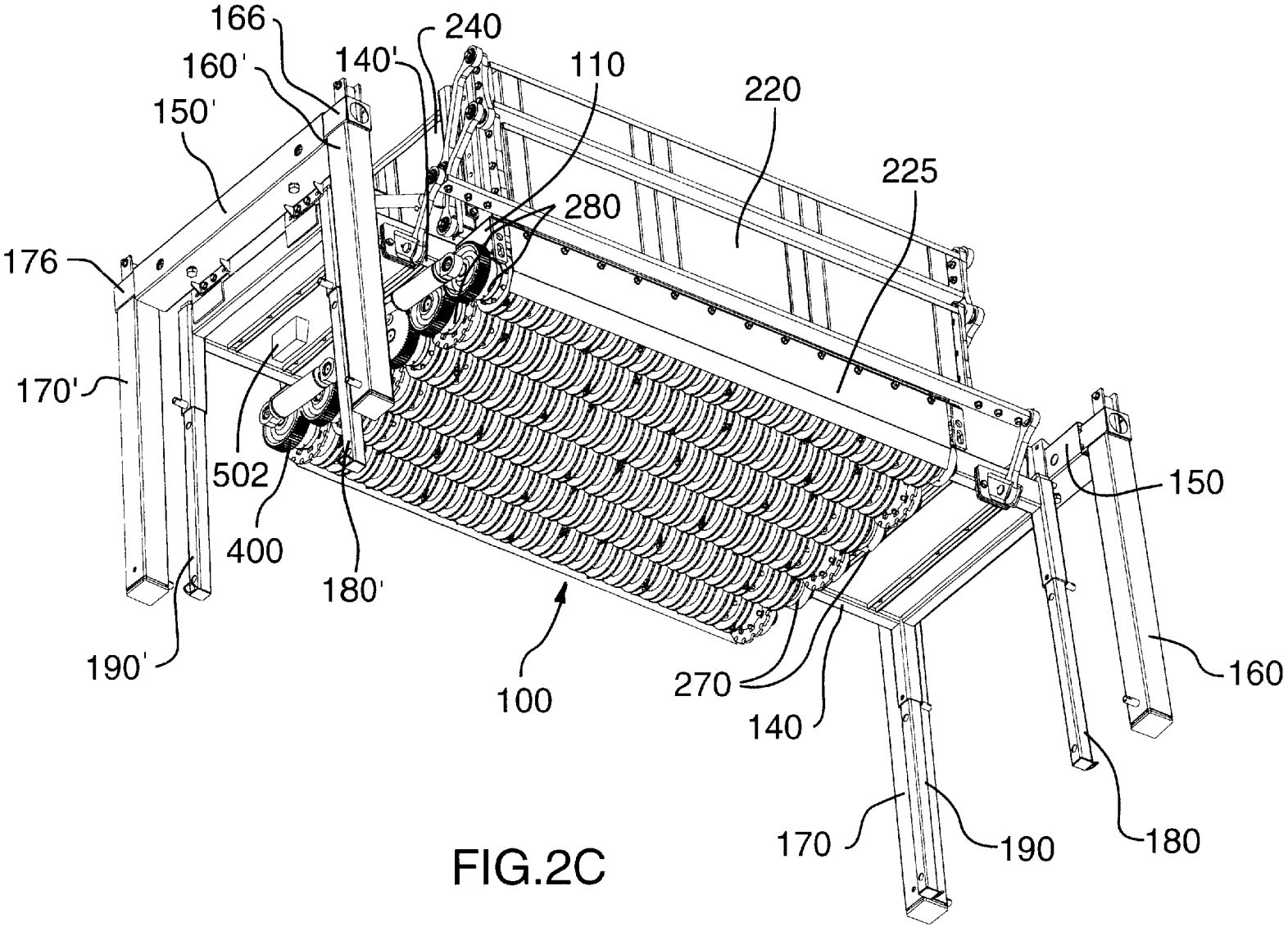
FIG. 2C is a schematic perspective side view from below of a shredding apparatus according to the invention, showing the apparatus from the roll drive side, with the charging door closed.
Figure 2D:
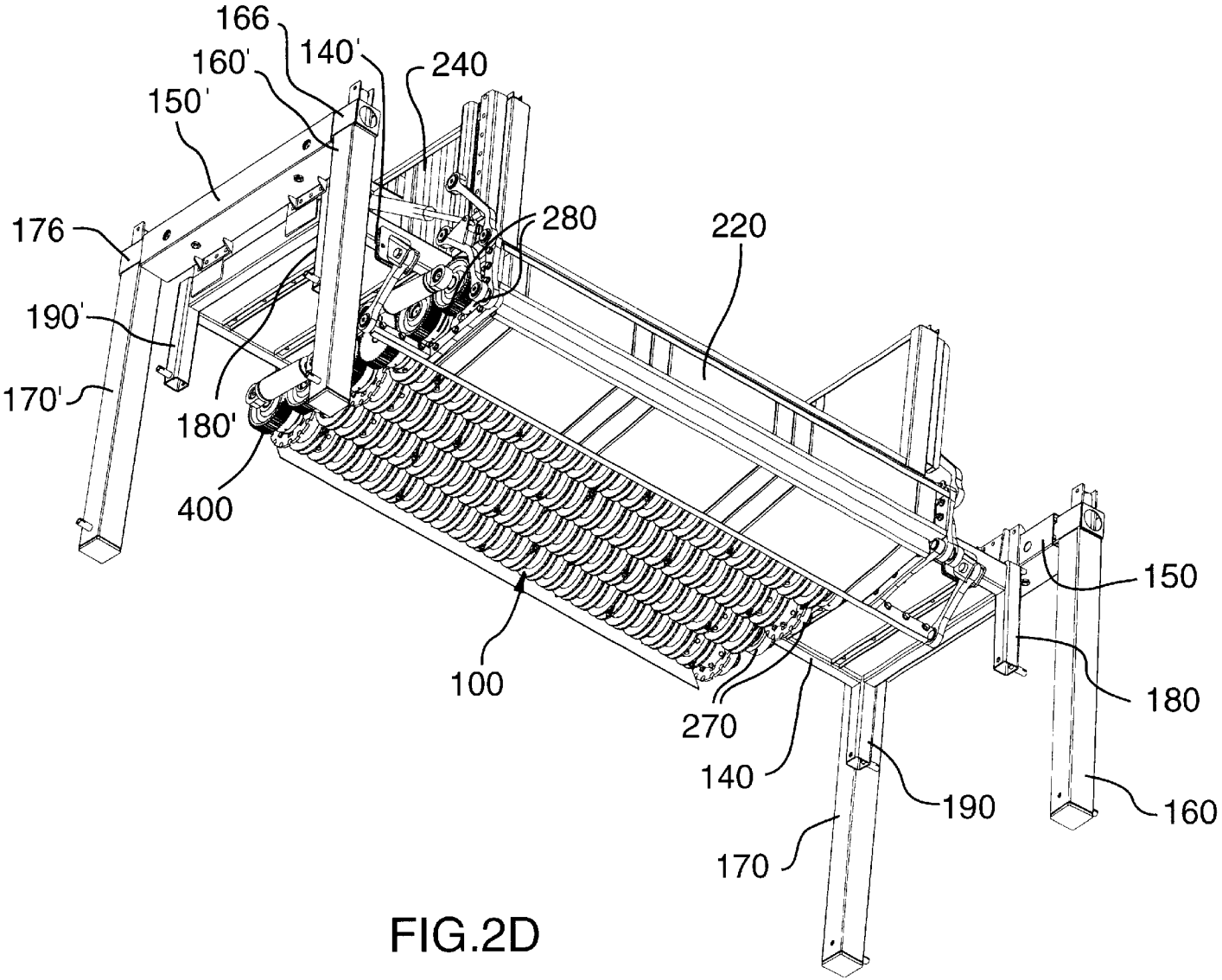
FIG. 2D is a schematic perspective side view from below of a shredding apparatus according to the invention, showing the apparatus from the roll drive side, with the charging door opened.
Figure 2E:
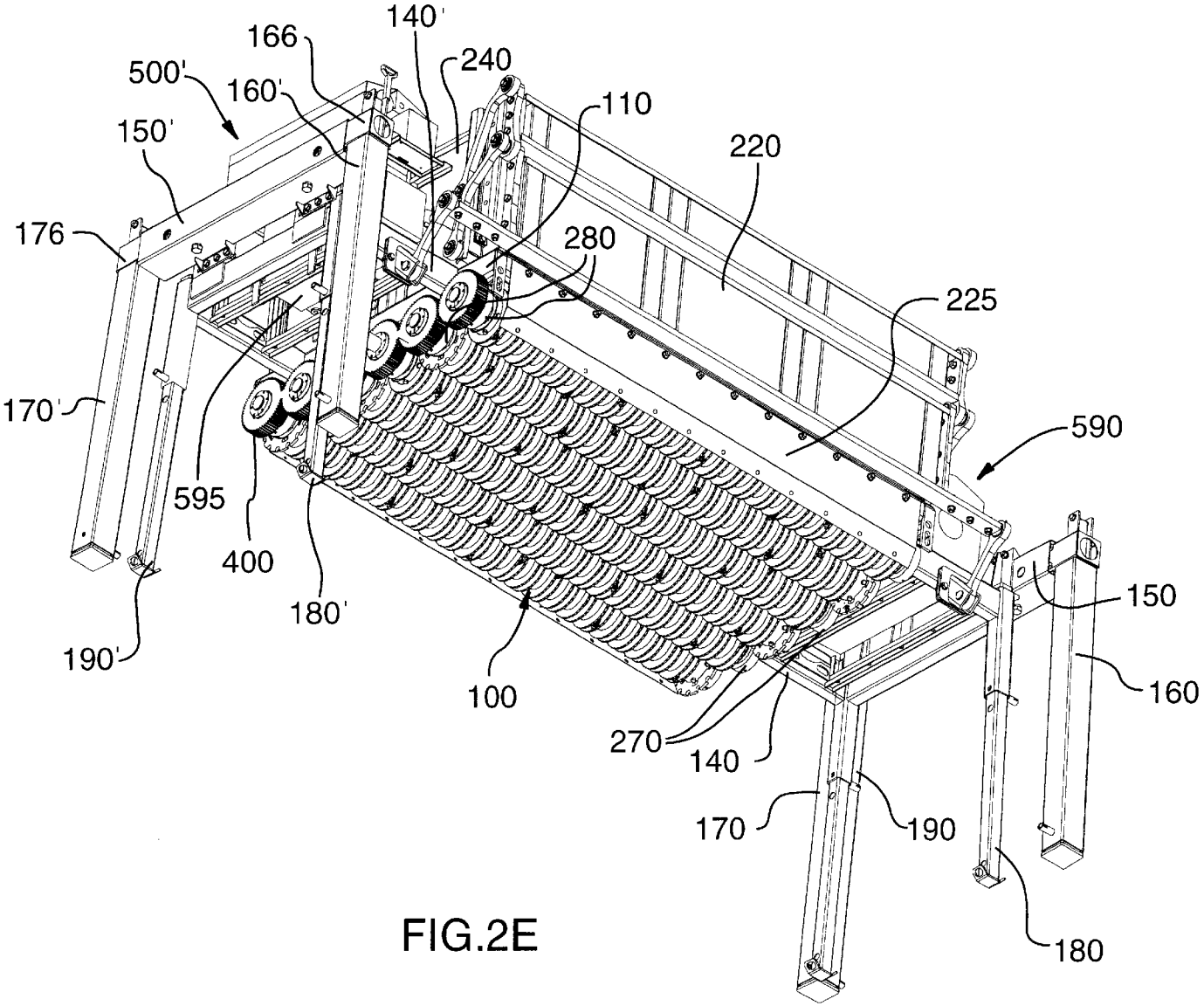
FIG. 2E is a schematic perspective side view from below of a shredding apparatus according to the invention, showing the alternative drive means for the rolls being a hydraulic motor.
Figure 2F:
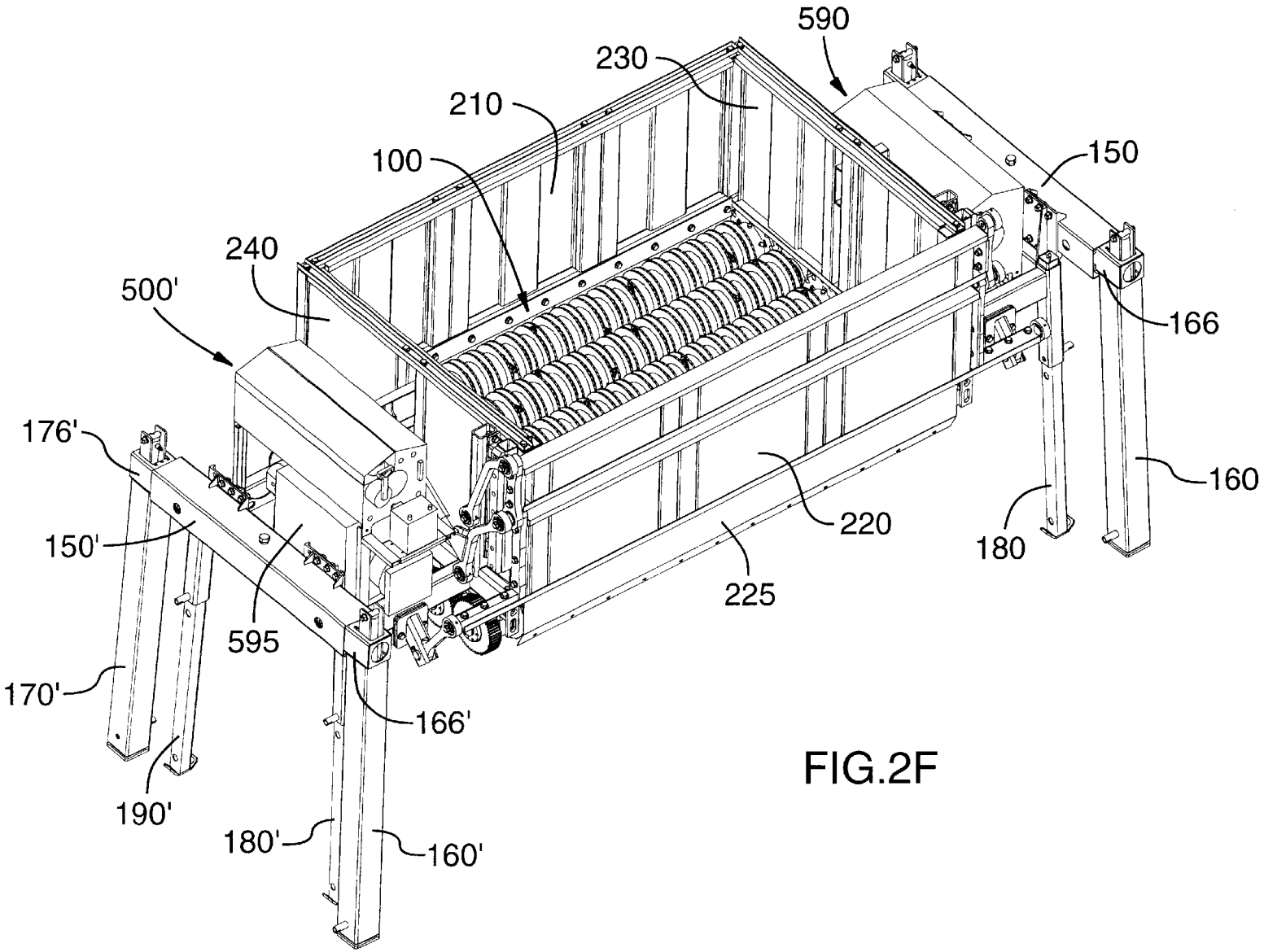
FIG. 2F is a schematic elevational perspective side view of a shredding apparatus according to the invention, showing the alternative drive means for the rolls being a hydraulic motor.
Figure 2G:
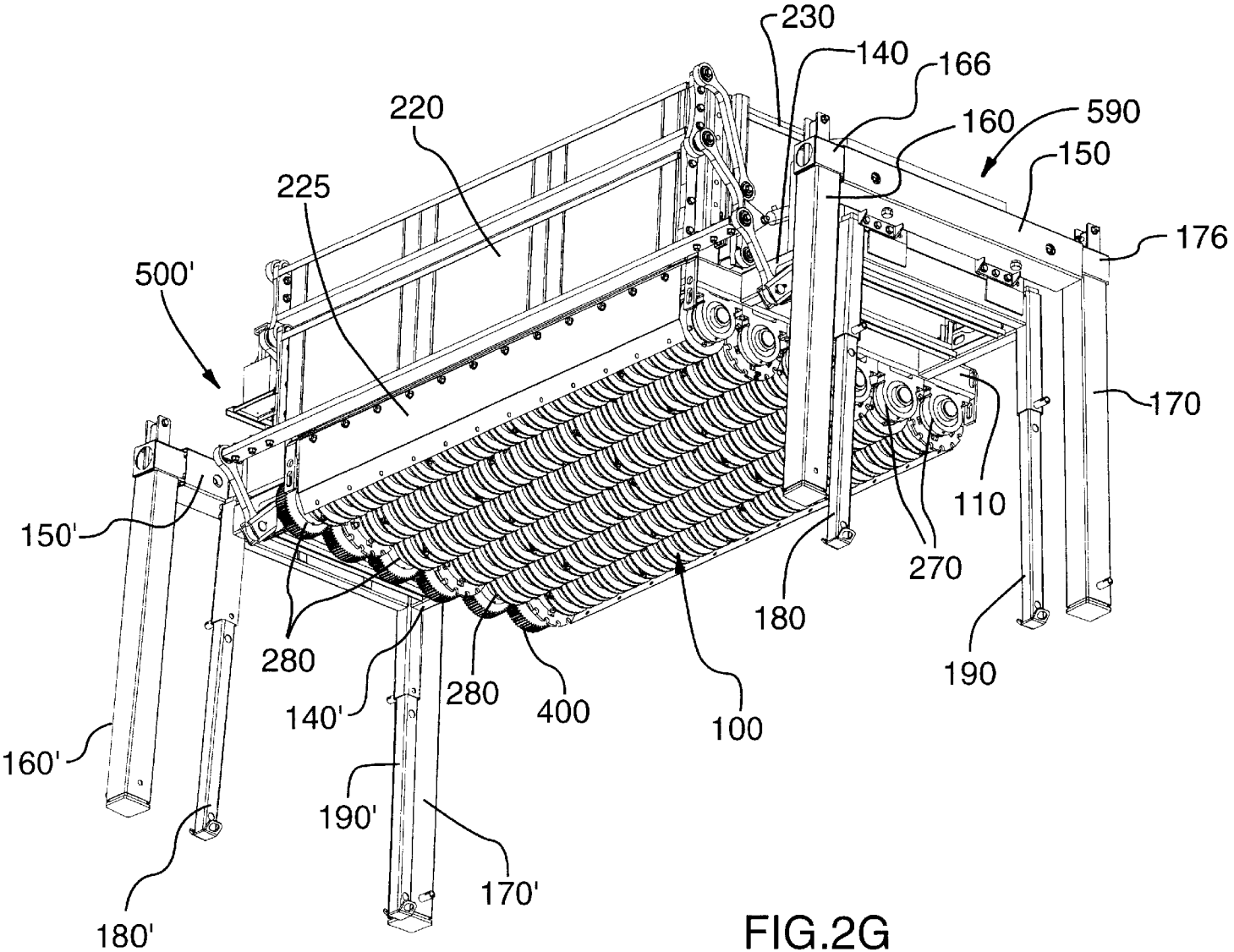
FIG. 2G is a schematic perspective side view from below of a shredding apparatus according to the invention, showing the alternative drive means for the rolls being a hydraulic motor.
Figure 2H:
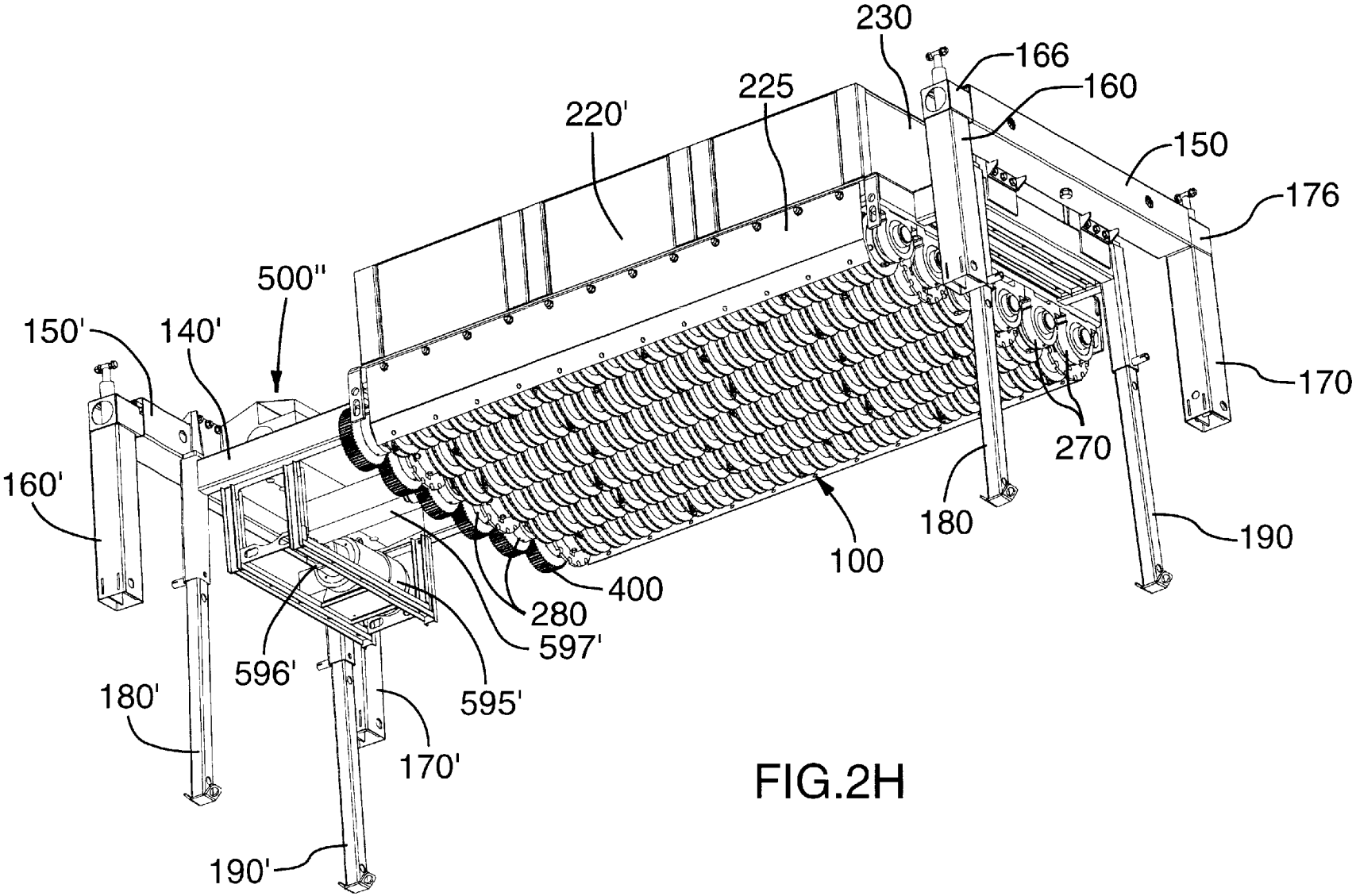
FIG. 2H is a schematic perspective side view from below of a shredding apparatus according to the invention, showing the alternative drive means for the rolls being an electric motor.
Figure 3A:
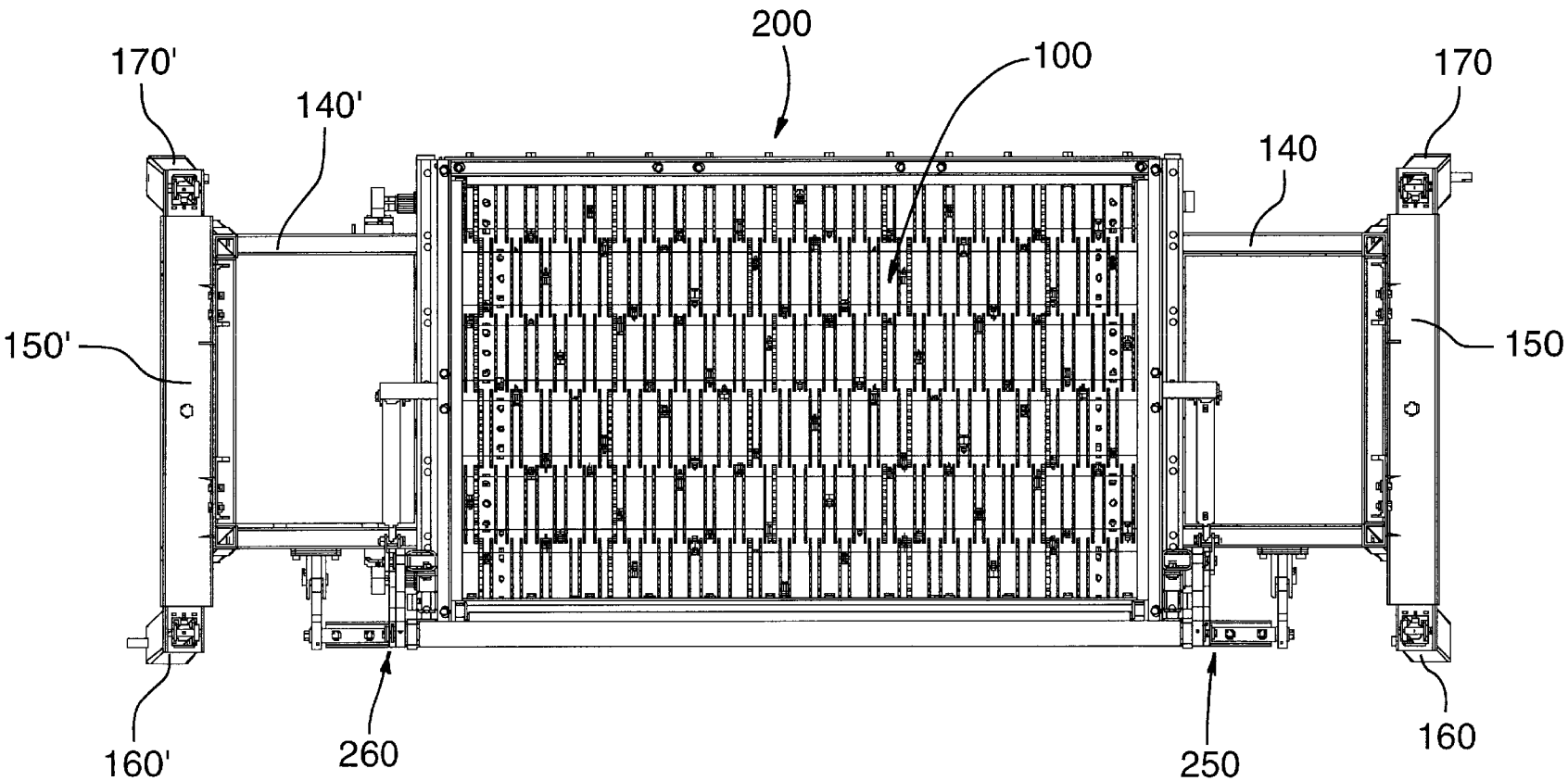
FIG. 3A is a top view of a shredding apparatus according to the invention, showing the apparatus with the charging door closed.
Figure 3B:
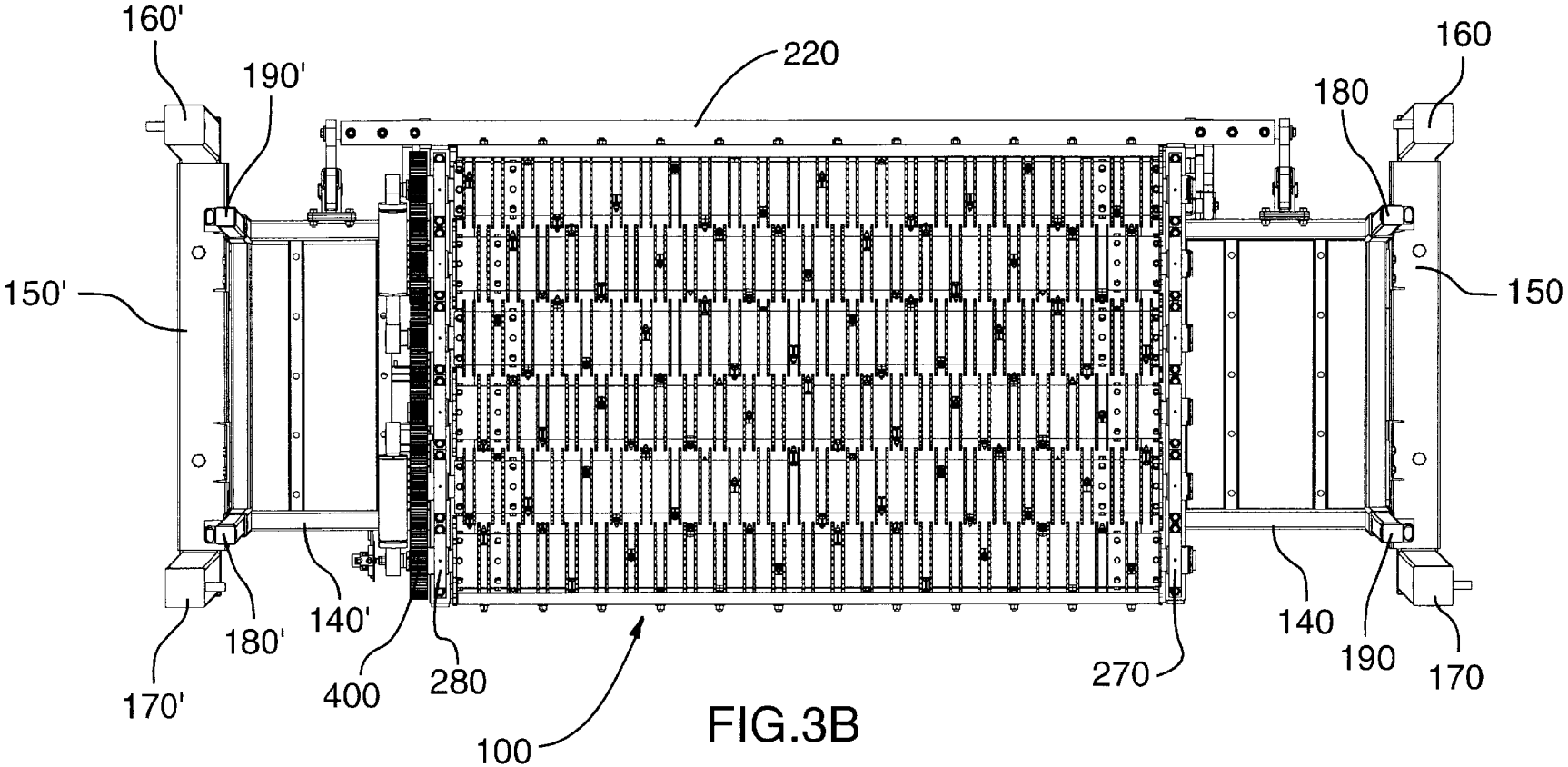
FIG. 3B is a bottom view of a shredding apparatus according to the invention, with the charging door closed.
Figure 3C:
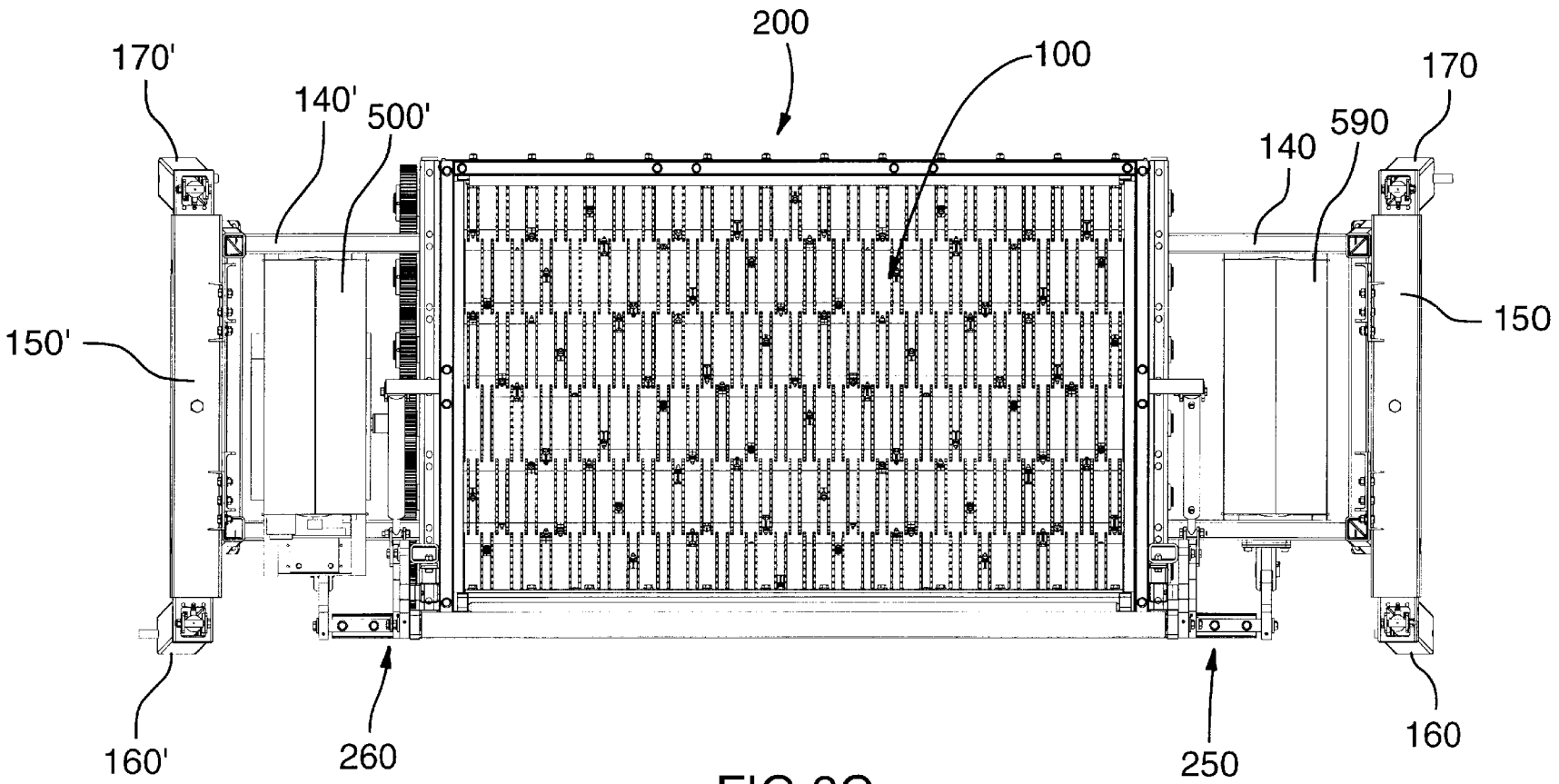
FIG. 3C is a top view of a shredding apparatus according to the invention, showing the alternative drive means for the rolls being a hydraulic motor.
Figure 3D:
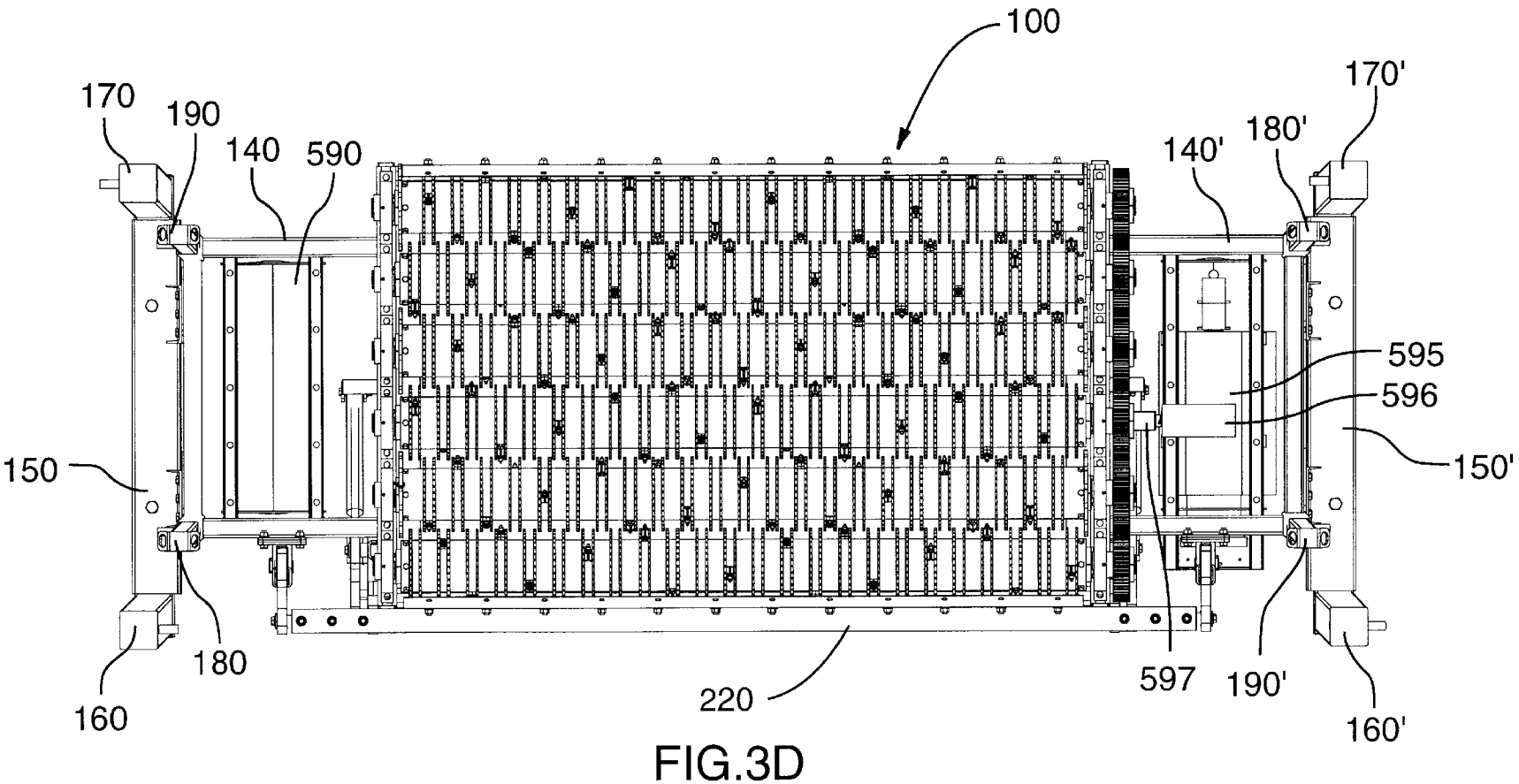
FIG. 3D is a bottom view of a shredding apparatus according to the invention, showing the alternative drive means for the rolls being a hydraulic motor.
Figure 3E:
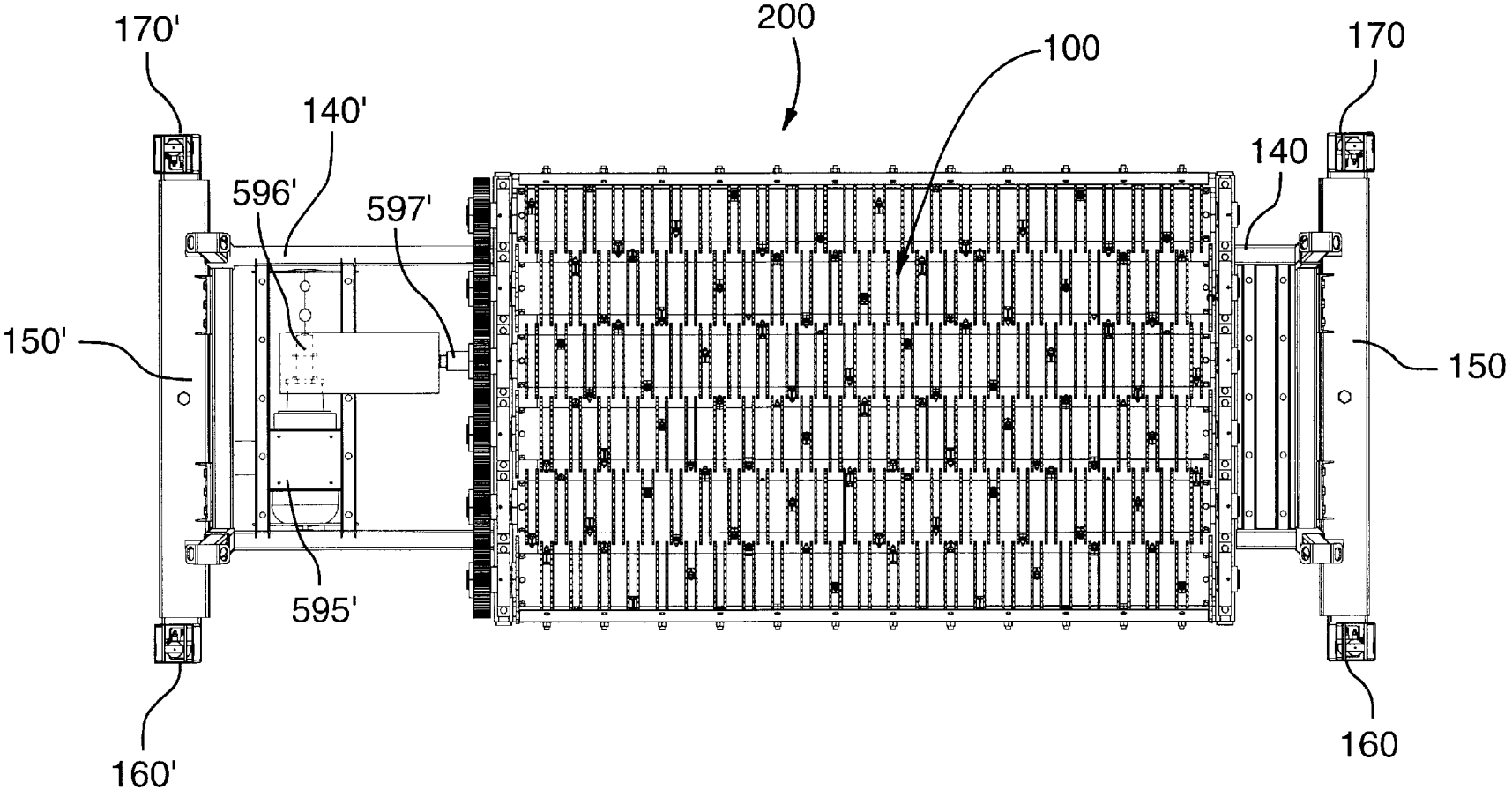
FIG. 3E is a bottom view of a shredding apparatus according to the invention, showing the alternative drive means for the rolls being an electric motor.
Figure 4A:
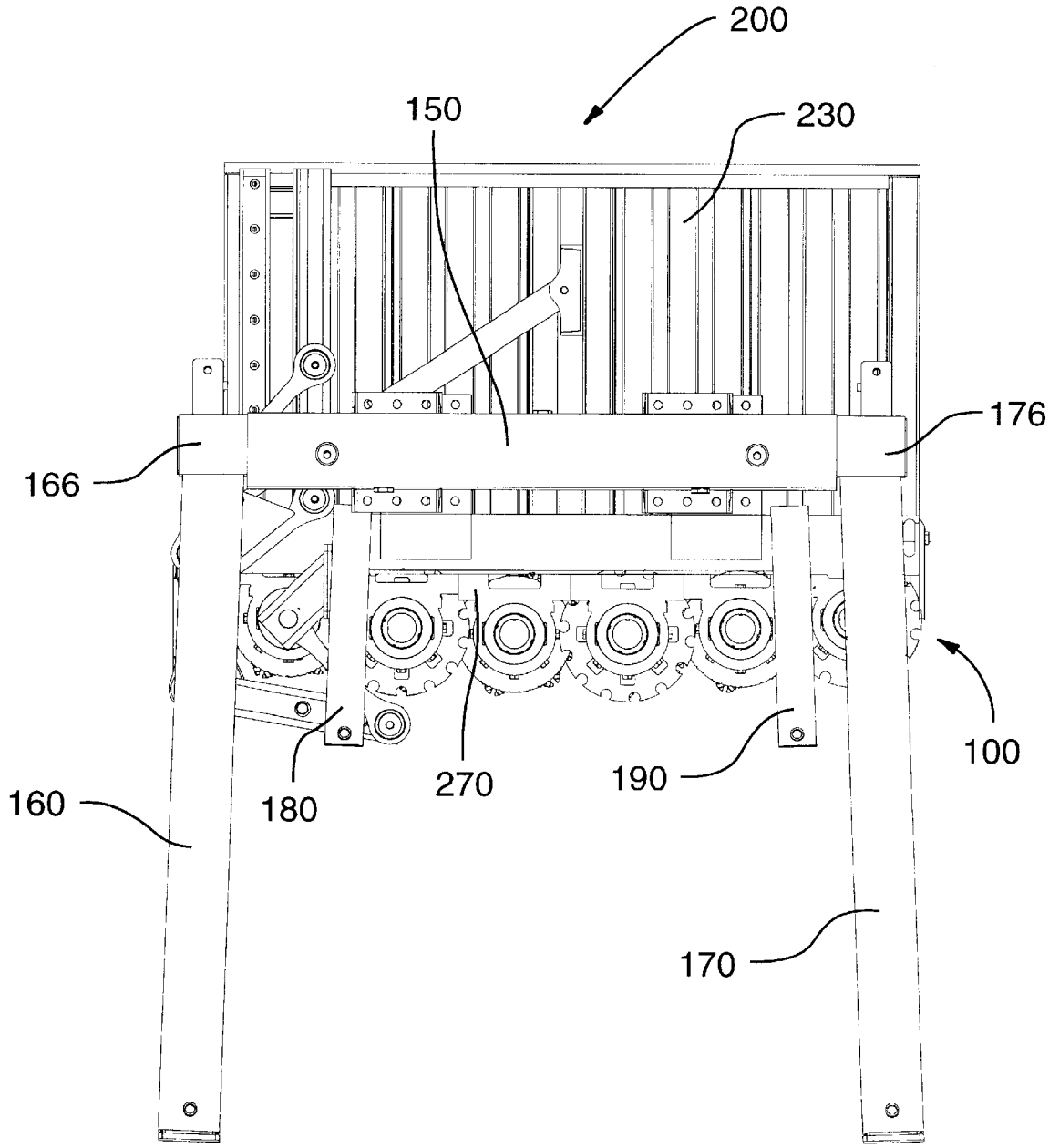
FIG. 4A is a side view of a shredding apparatus according to the invention, seen from the opposite side from the roll drive side, with the charging door closed.
Figure 4B:
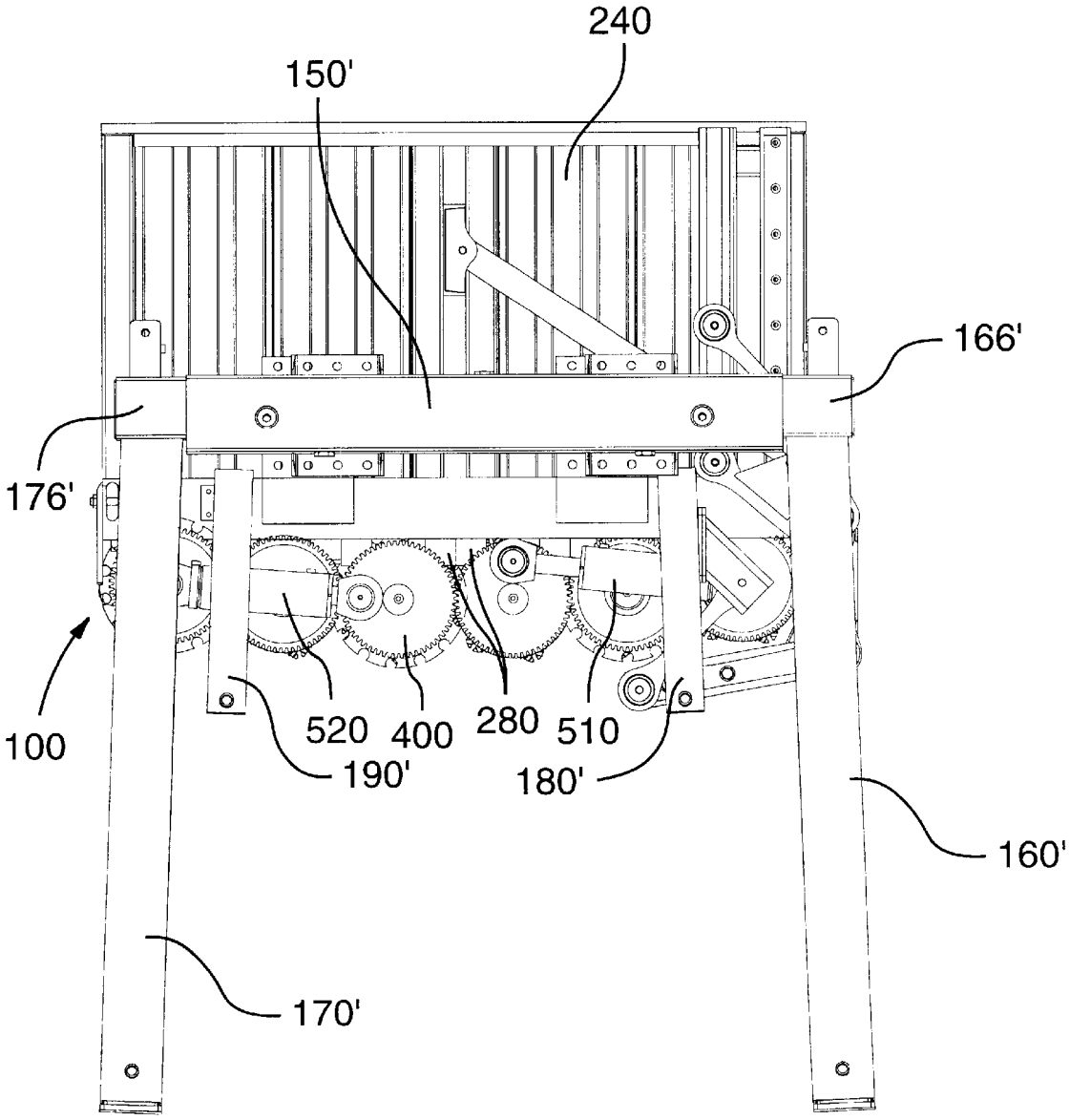
FIG. 4B is a side view of a shredding apparatus according to the invention, seen from the roll drive side, with the charging door closed.
Figure 4C:
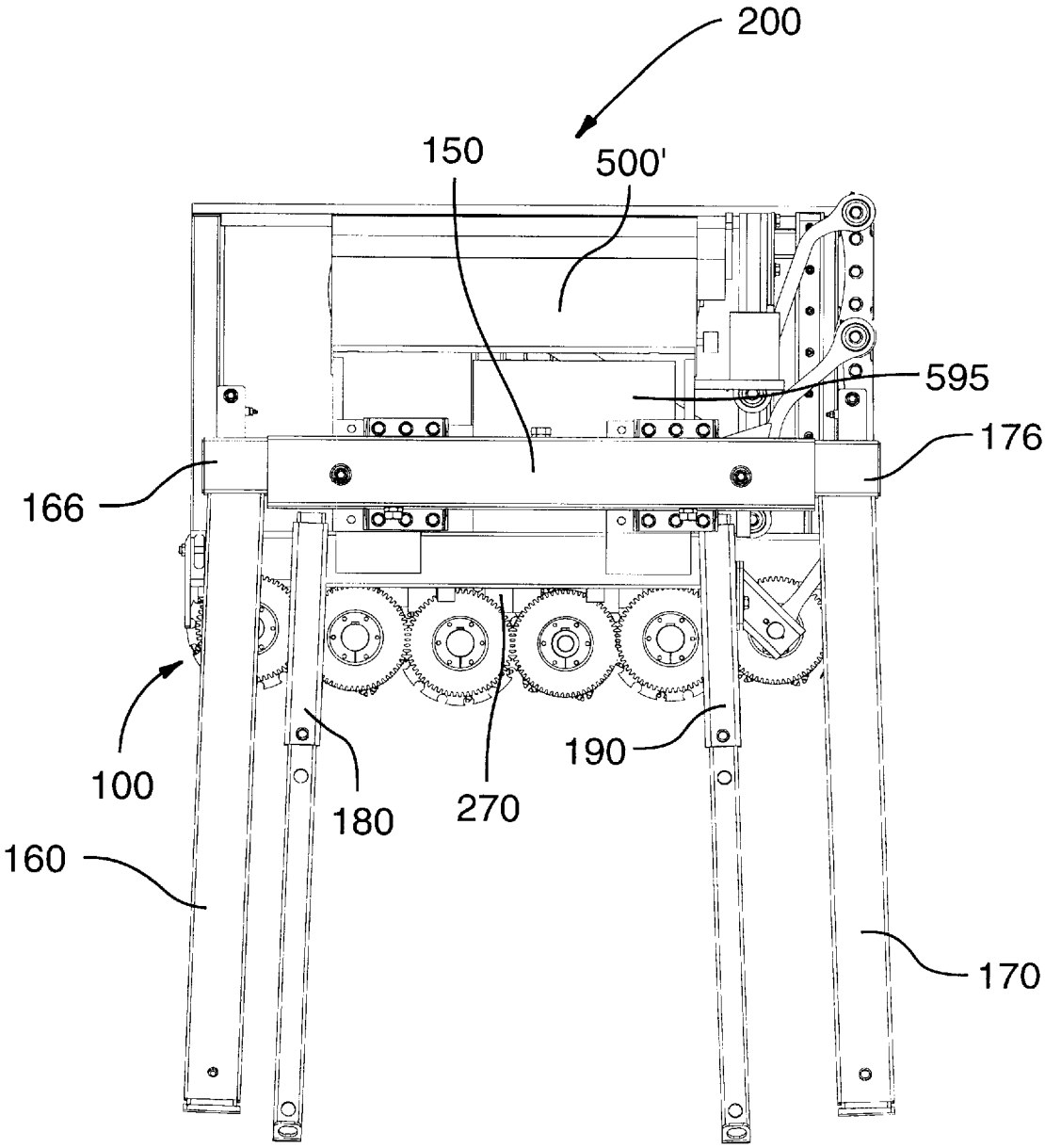
FIG. 4C is a side view of a shredding apparatus according to the invention, seen from the roll drive side, showing the alternative drive means for the rolls being a hydraulic motor.
Figure 4D:
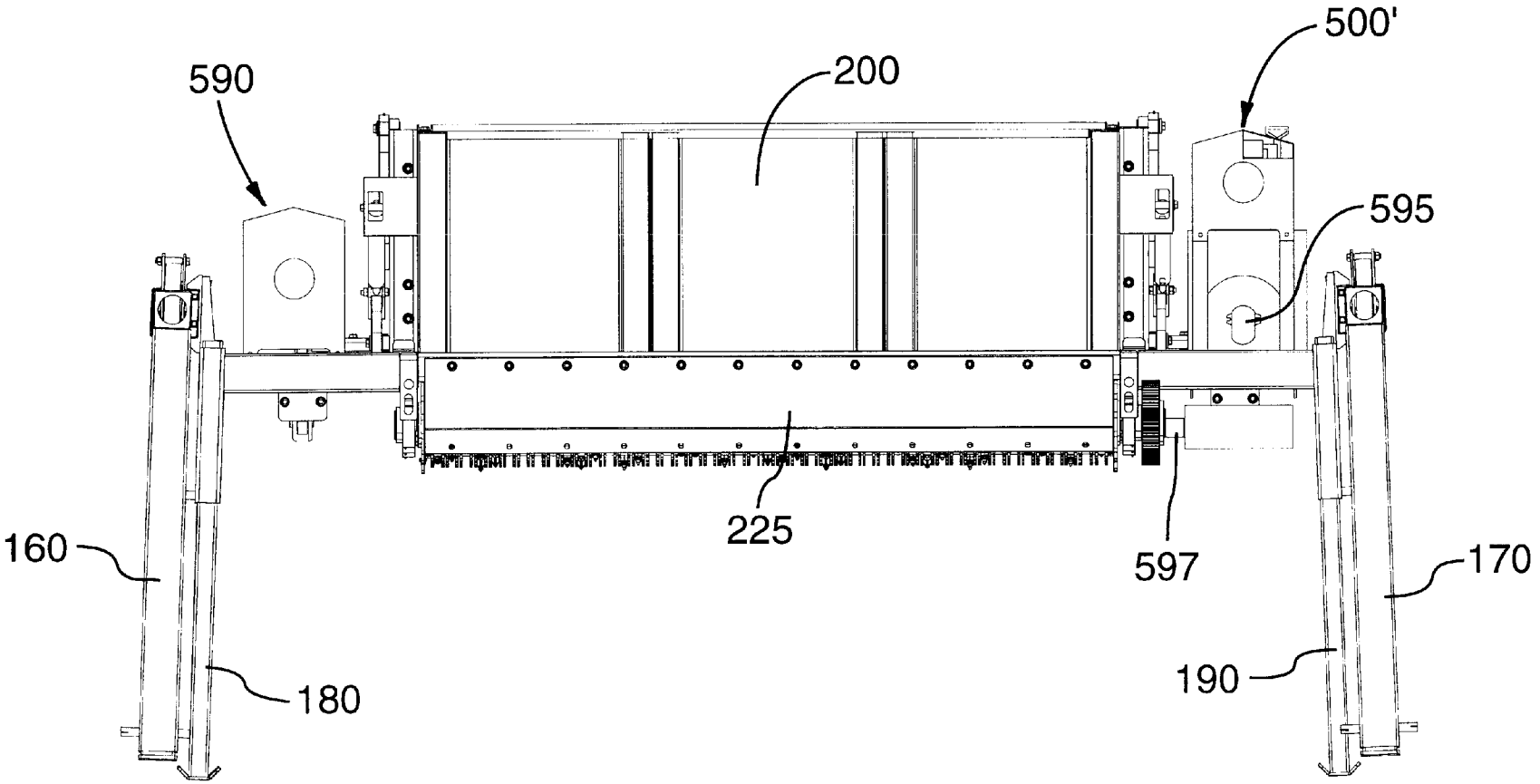
FIG. 4D is a side view of the back of a shredding apparatus according to the invention, showing the alternative drive means for the rolls being a hydraulic motor.
Figure 4E:
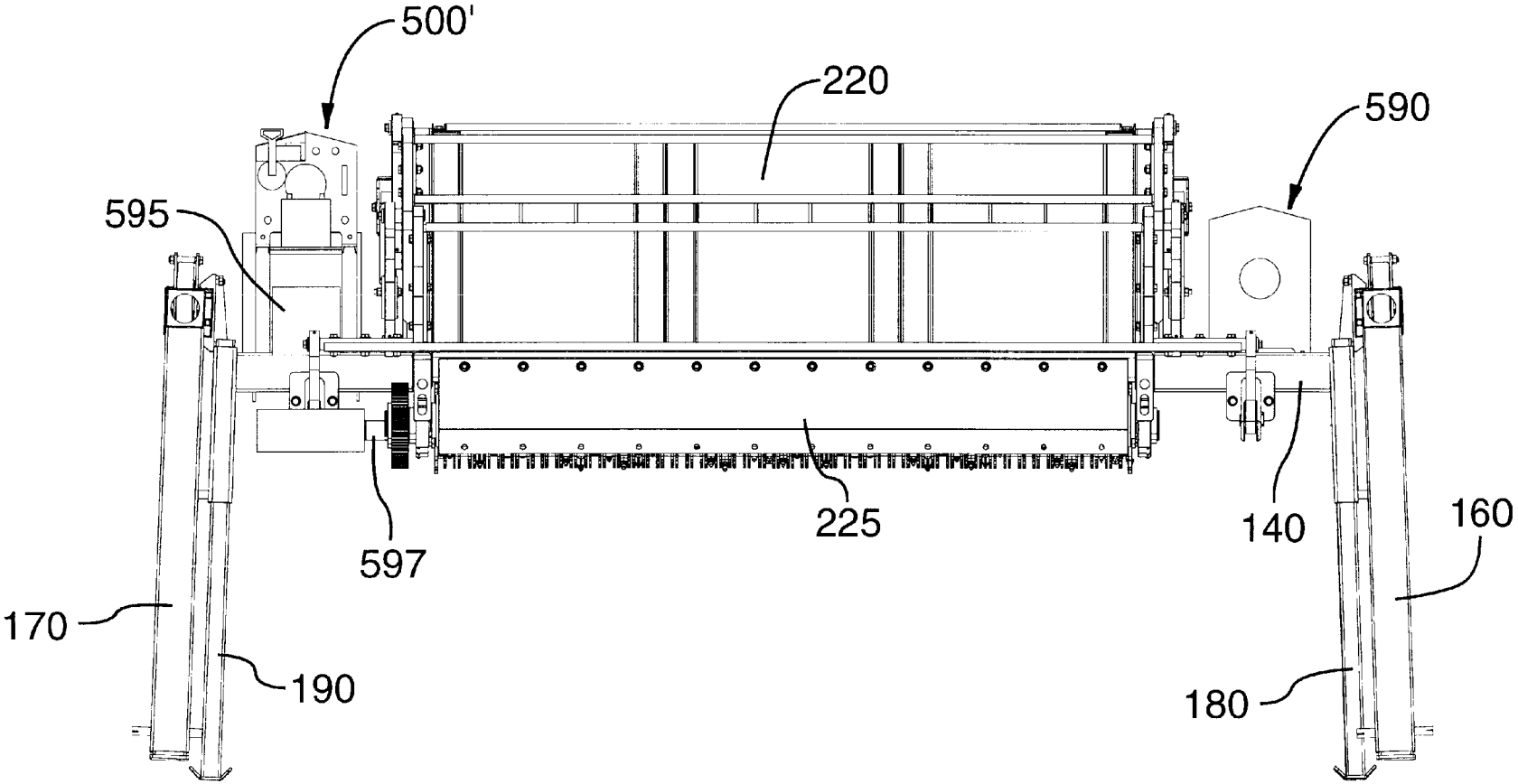
FIG. 4E is a side view of the front of a shredding apparatus according to the invention, showing the alternative drive means for the rolls being a hydraulic motor.
Figure 4F:
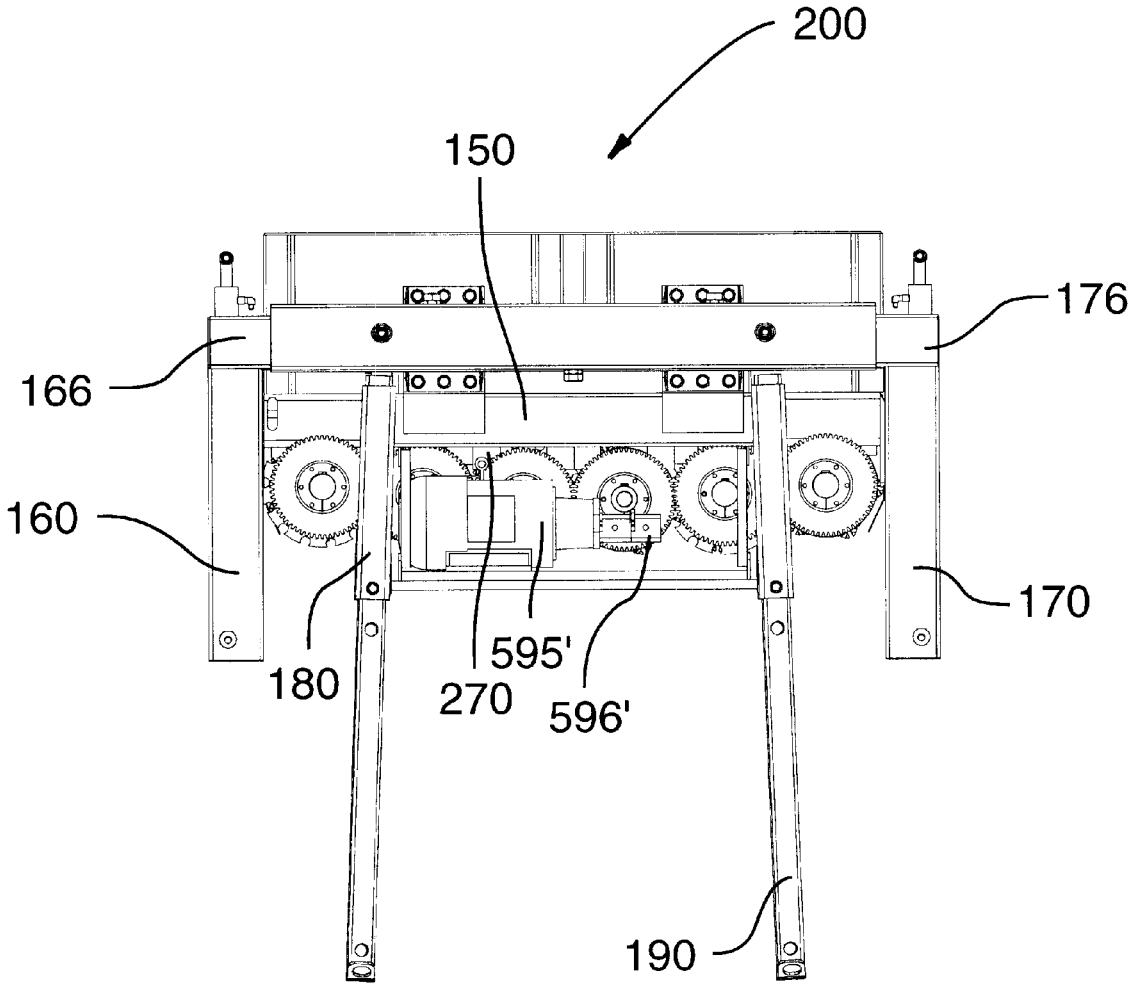
FIG. 4F is a side view of a shredding apparatus according to the invention, seen from the roll drive side, showing the alternative drive means for the rolls being an electric motor.
Figure 5A:
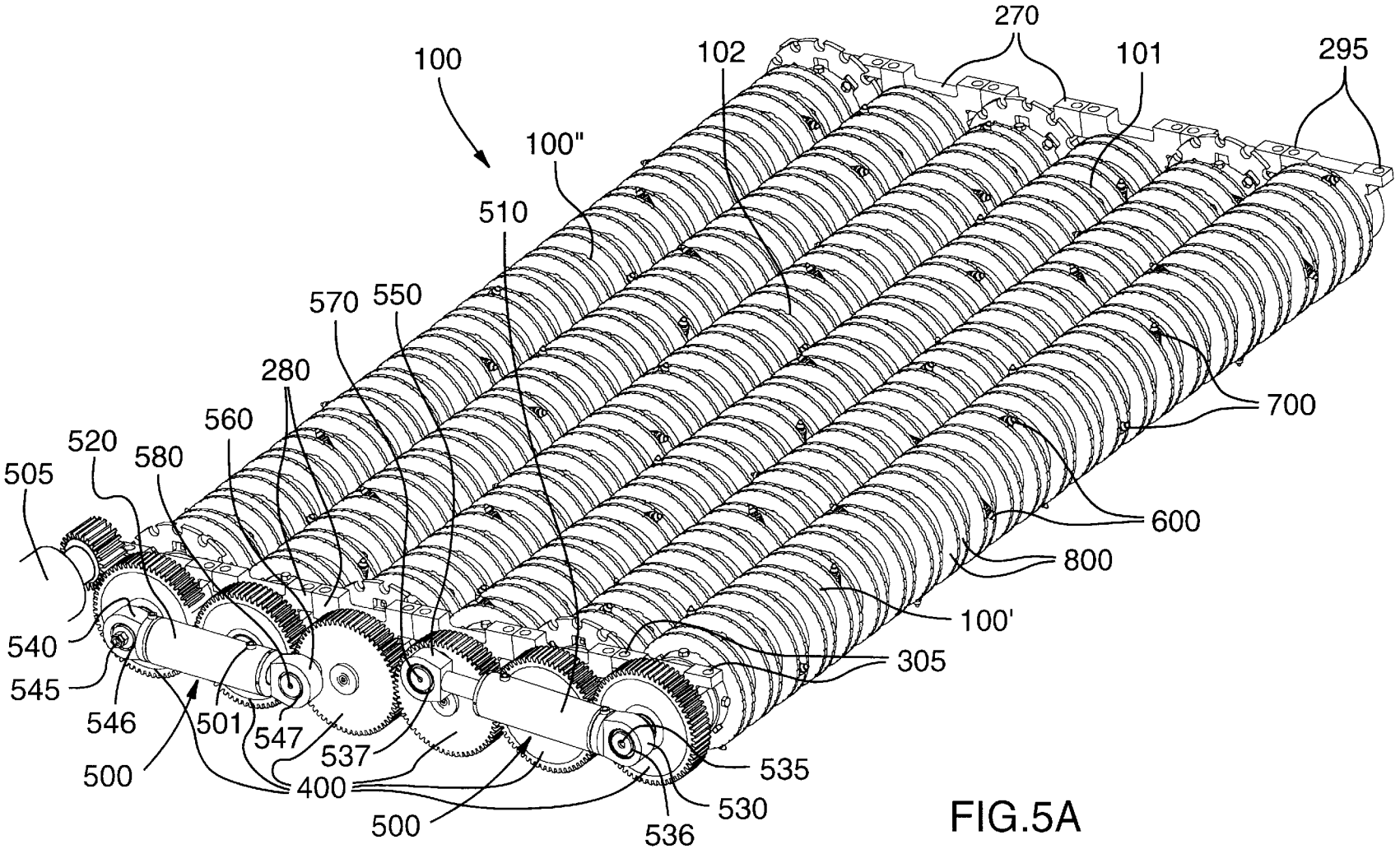
FIG. 5A is an elevational perspective side view of a roll assembly (roll bed) of a shredding apparatus according to the invention.
Figure 5B:
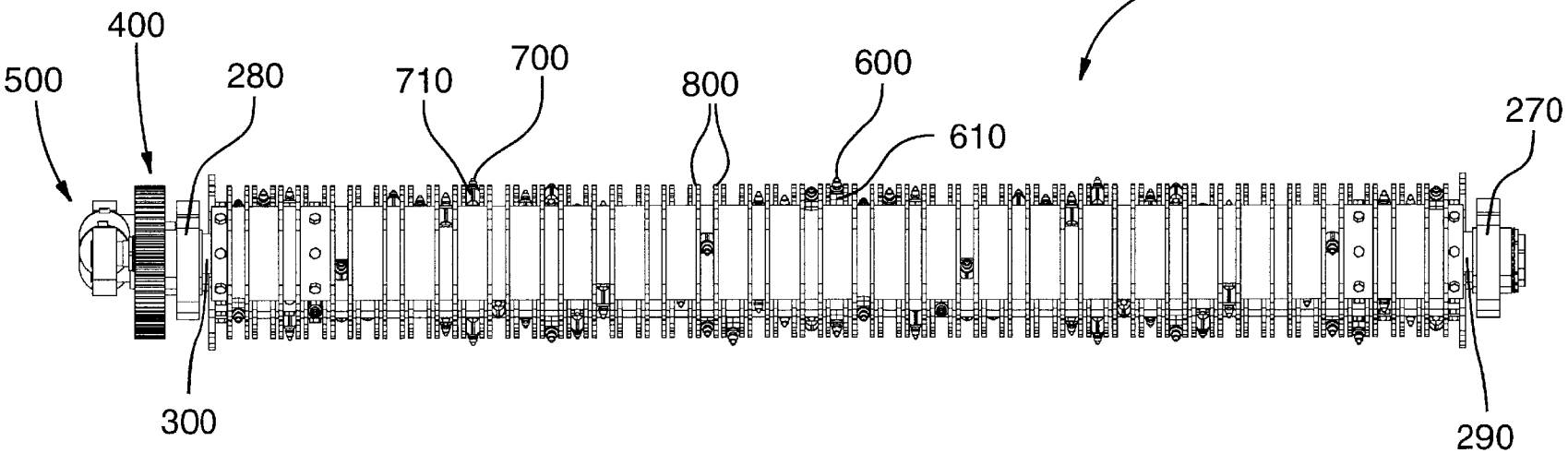
FIG. 5B is a side view of a roll assembly of a shredding apparatus according to the invention, seen perpendicularly from the longitudinal axis of the rolls and along the plane of the roll assembly.
Figure 5C:
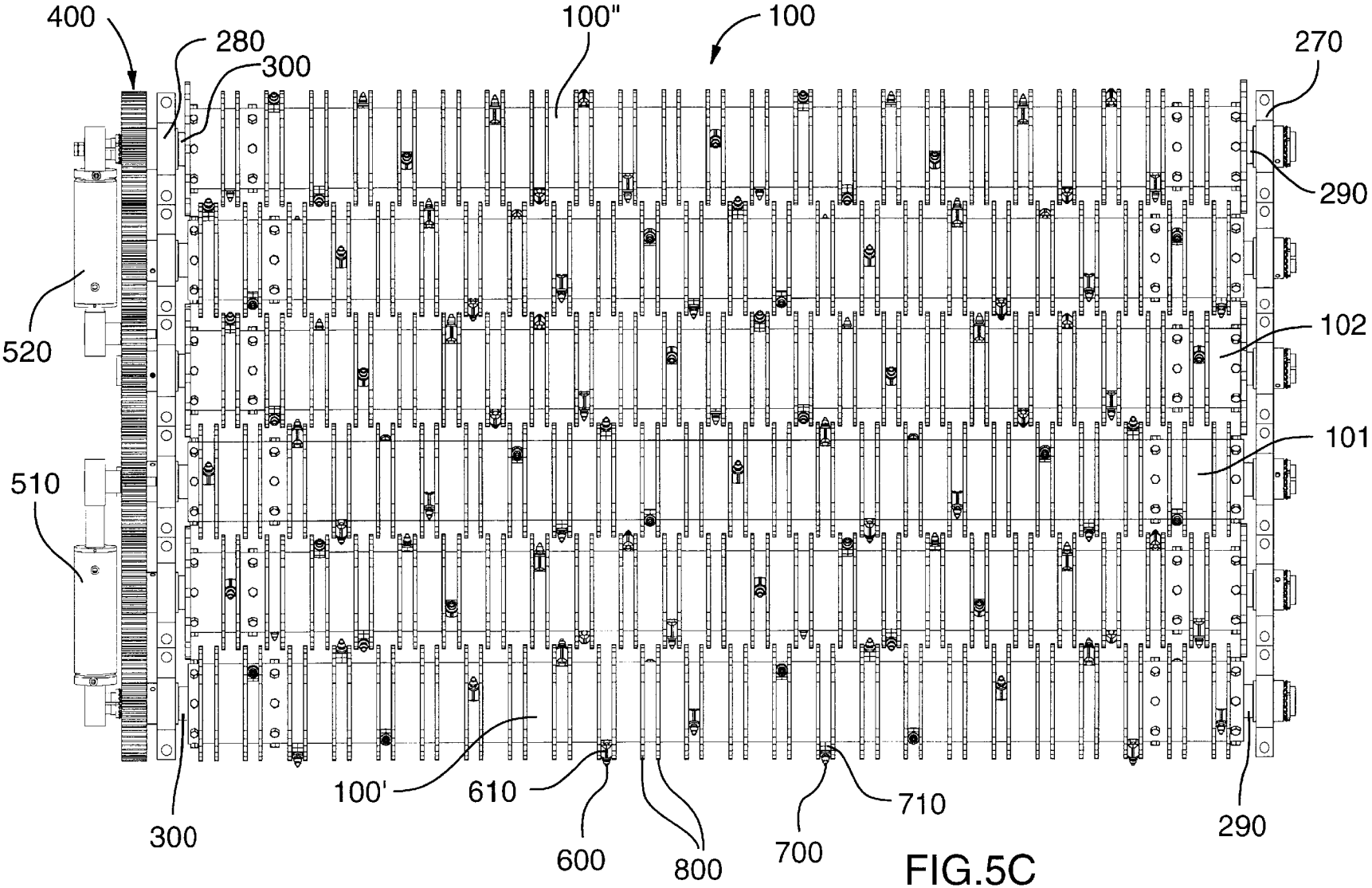
FIG. 5C is a top view of a roll assembly of a shredding apparatus according to the invention.

As is shown in FIGS. 2A, 2B and 5A, the plurality of rolls 100 are held to the frame 110 by first bearing holders 270 and second bearing holders 280. The bearing holders are also known as pillow blocks. Each roll has a first end shaft 290 and a second end shaft 300. The first end of each roll is held in the respective first bearing holder 270 and the second end of each roll is held in the respective second bearing holder 280. Each first bearing holder is attached to the frame 110 using first attachment means 295, for example bolts (not shown) attached to corresponding fastening means (not shown, for example nuts or threaded holes) arranged on the frame. Each second bearing holder 280 is attached to the frame 110 using second attachment means 305, for example bolts (not shown) attached to corresponding fastening means (not shown, for example nuts or threaded holes) arranged on the frame. Each roll 100 has a synchronization means 400 arranged on its second end shaft 300. The synchronization means transfer the rotation power to each roll from a drive system 500, so that each roll rotates in a different direction from the adjacent roll(s). Preferably, the synchronization means are cog wheels, or gears, meshing with the adjacent cog wheel of adjacent rolls. The synchronization means will be referred to as cog wheels 400 hereinafter. The drive system 500 comprises, for example, one or more electric motors, an internal combustion engine or an arrangement of at least one fluid (hydraulic or pneumatic) cylinder or motor. The drive system may provide direct drive to one or more rolls via a planetary reducer, or other types of gear mechanisms. In the preferred embodiment shown in FIGS. 5A to 5C, 7B and 8A to 8H, the drive system 500 comprises a first fluid drive cylinder 510 an a second fluid drive cylinder 520. The first drive cylinder has a first attachment end 530, which is attached at a first attachment shaft 535 concentric with the axis of rotation of a first outer roll 100' of the plurality of rolls 100. The first attachment end does not rotate with the first outer roll, a bearing 536 is arranged on the first attachment shaft to allow the first attachment shaft to rotate but not the first attachment end of the first drive cylinder. The first drive cylinder 510 further has a second attachment end 550, which is attached at a second attachment shaft 570. The second attachment shaft is arranged on the cog wheel 400 of a first inner roll 101, so that the second attachment shaft is placed radially on the cog wheel towards the circumference of the cog wheel. The second attachment end does not rotate with the first inner roll, a bearing 537 is arranged on the second attachment shaft to allow the second attachment shaft to rotate but not the second attachment end of the first drive cylinder. In this way, the cog wheel 400 of the first inner roll will rotate, when the first drive cylinder 510 is extended or retracted. Similarly, the second drive cylinder 520 has a third attachment end 540, which is attached at a third attachment shaft 545 concentric with the axis of rotation of a second outer roll 100" of the plurality of rolls 100. The third attachment end 540 does not rotate with the second outer roll, a bearing 546 is arranged on the third attachment shaft to allow the third attachment shaft to rotate but not the third attachment end of the second drive cylinder. The second drive cylinder 520 further has a fourth attachment end 560, which is attached at a fourth attachment shaft 580. The fourth attachment shaft is arranged on the cog wheel 400 of a second inner roll 102, so that the fourth attachment shaft is placed radially on the cog wheel towards the circumference of the cog wheel. The fourth attachment end does not rotate with the second inner roll, a bearing 547 is arranged on the fourth attachment shaft to allow the fourth attachment shaft to rotate but not the fourth attachment end of the second drive cylinder. In this way, the cog wheel 400 of the second inner roll will rotate, when the second drive cylinder 520 is extended or retracted. Naturally, since all cog wheels mesh, any rotation imparted to any one of the plurality of rolls 100 will cause the other rolls to rotate also. The first drive cylinder 510 and the second drive cylinder 520 are arranged so that the angular position of the second attachment shaft 570 differs from the angular position of the fourth attachment shaft 580, to prevent that one drive cylinder is in its fully extended position at the same time as the other drive cylinder is in its fully retracted position. If this should be the case, it is possible that both cylinders would be locked from movement, because there would not be a sufficient moment arm working on the respective second or fourth attachment shaft to provide a rotational movement to the respective cog wheel 400.

Figure 8A:
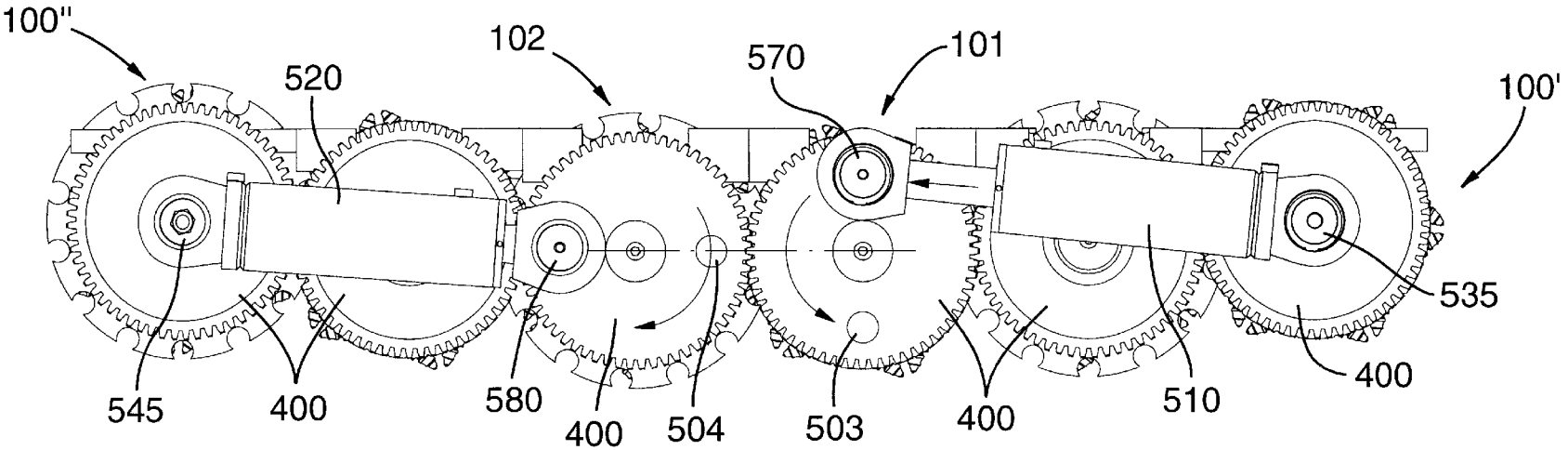
FIG. 8A is a schematic side view of the roll drive of a shredding apparatus according to the invention, seen from the roll drive side, showing the drive cylinders in a first position.
Figure 8B:
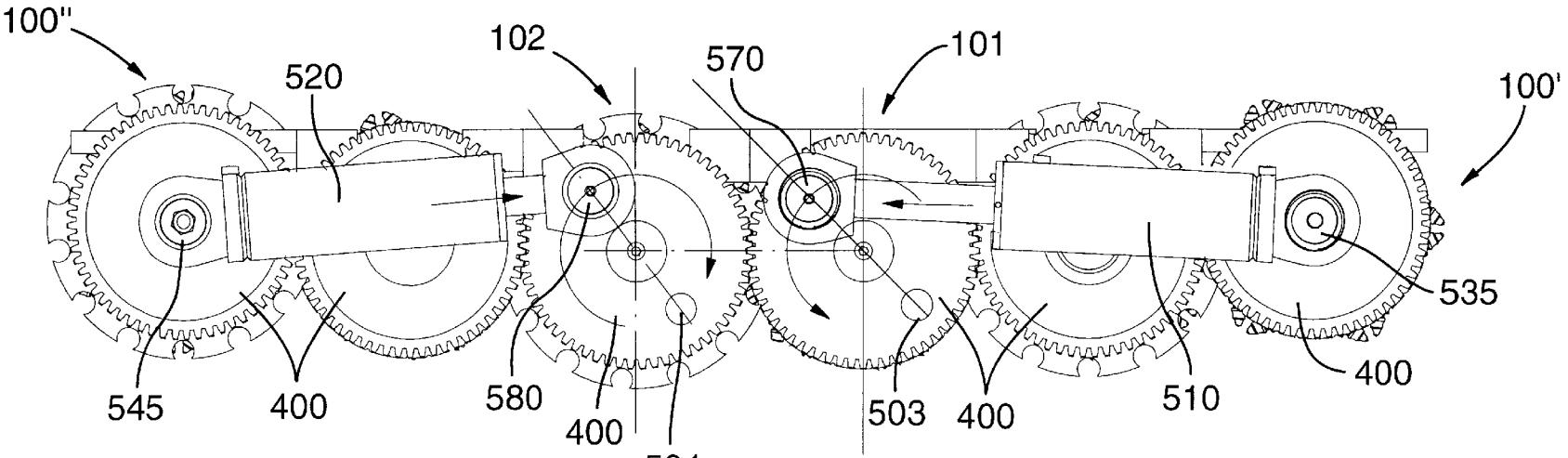
FIG. 8B is a schematic side view of the roll drive of a shredding apparatus according to the invention, seen from the roll drive side, showing the drive cylinders in a second position.
Figure 8C:
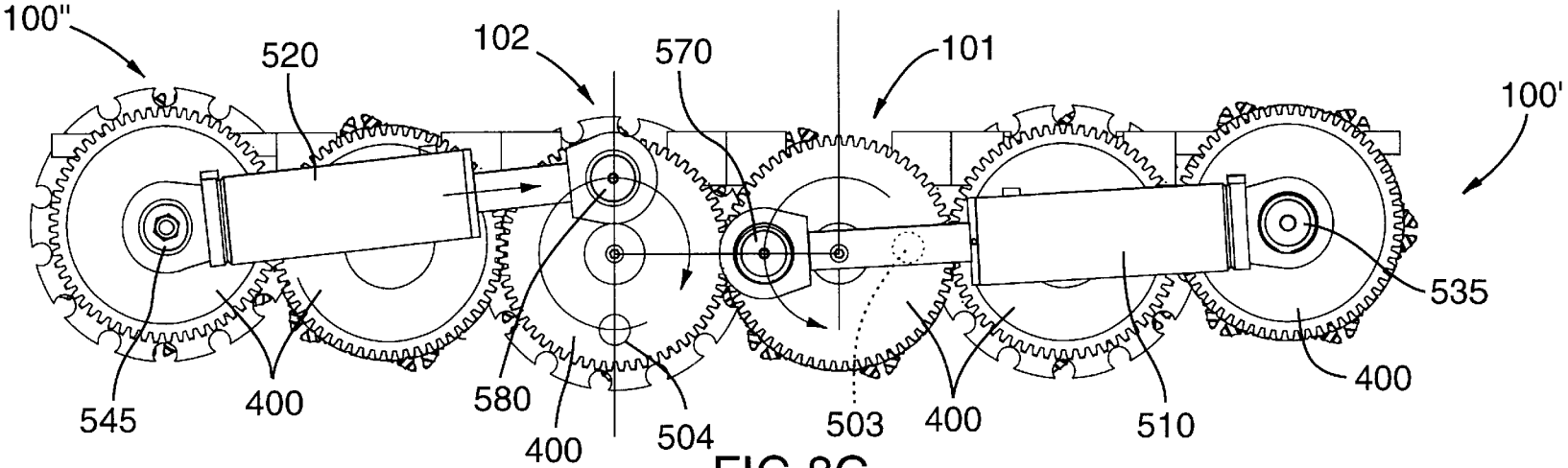
FIG. 8C is a schematic side view of the roll drive of a shredding apparatus according to the invention, seen from the roll drive side, showing the drive cylinders in a third position.
Figure 8D:
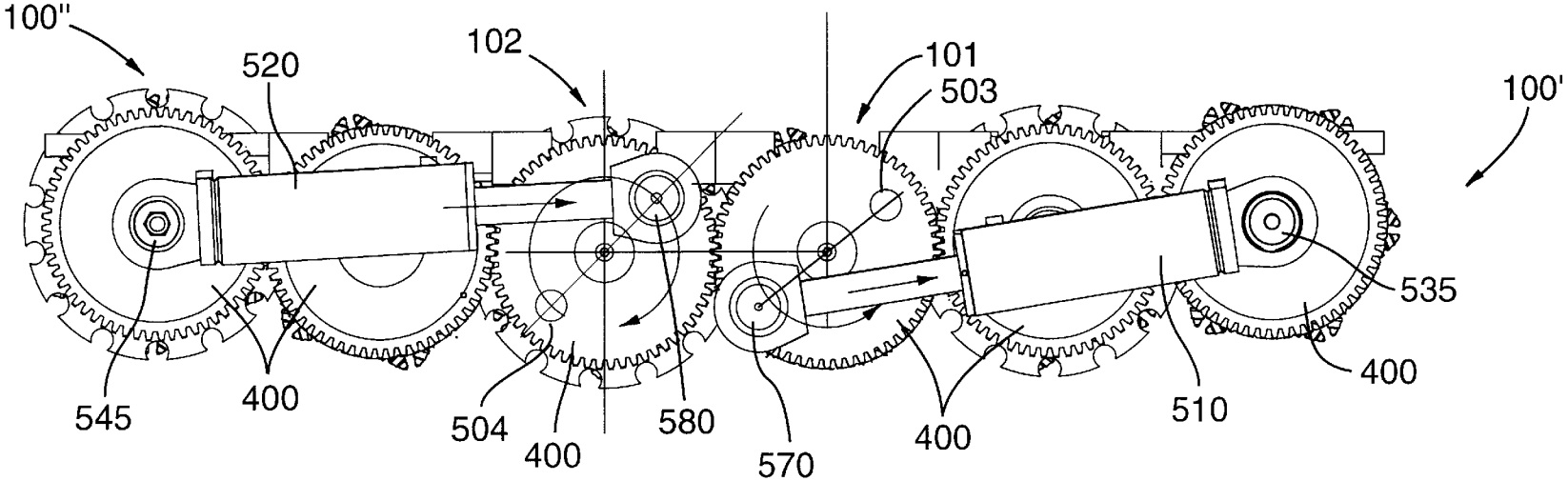
FIG. 8D is a schematic side view of the roll drive of a shredding apparatus according to the invention, seen from the roll drive side, showing the drive cylinders in a fourth position.
Figure 8E:
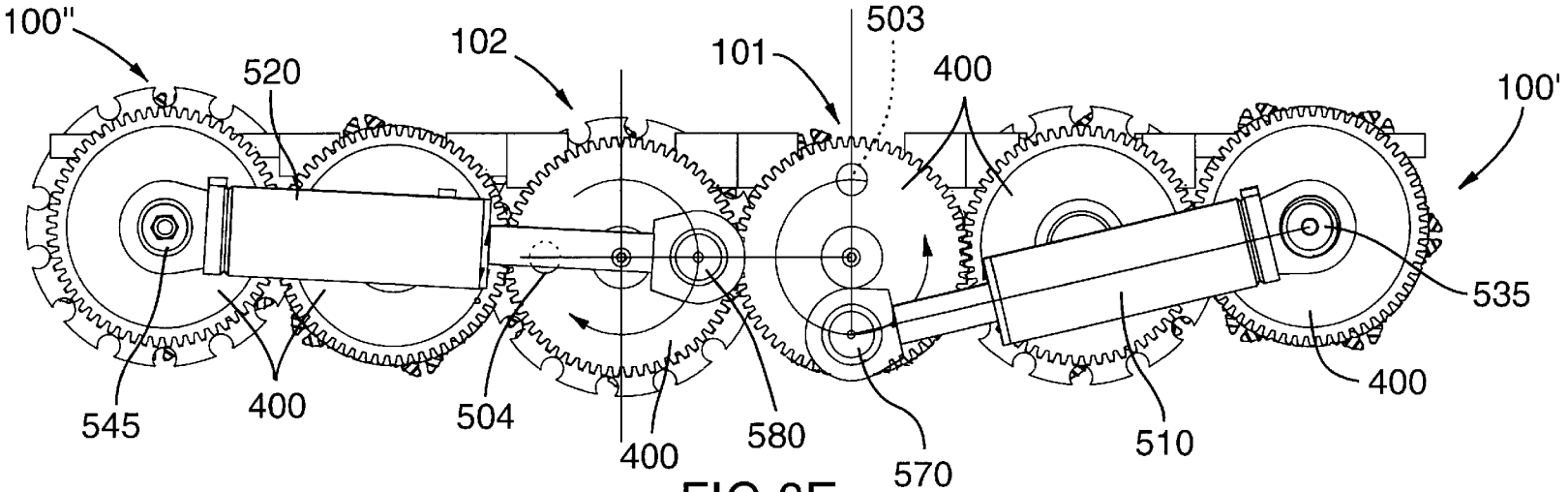
FIG. 8E is a schematic side view of the roll drive of a shredding apparatus according to the invention, seen from the roll drive side, showing the drive cylinders in a fifth position.
Figure 8F:
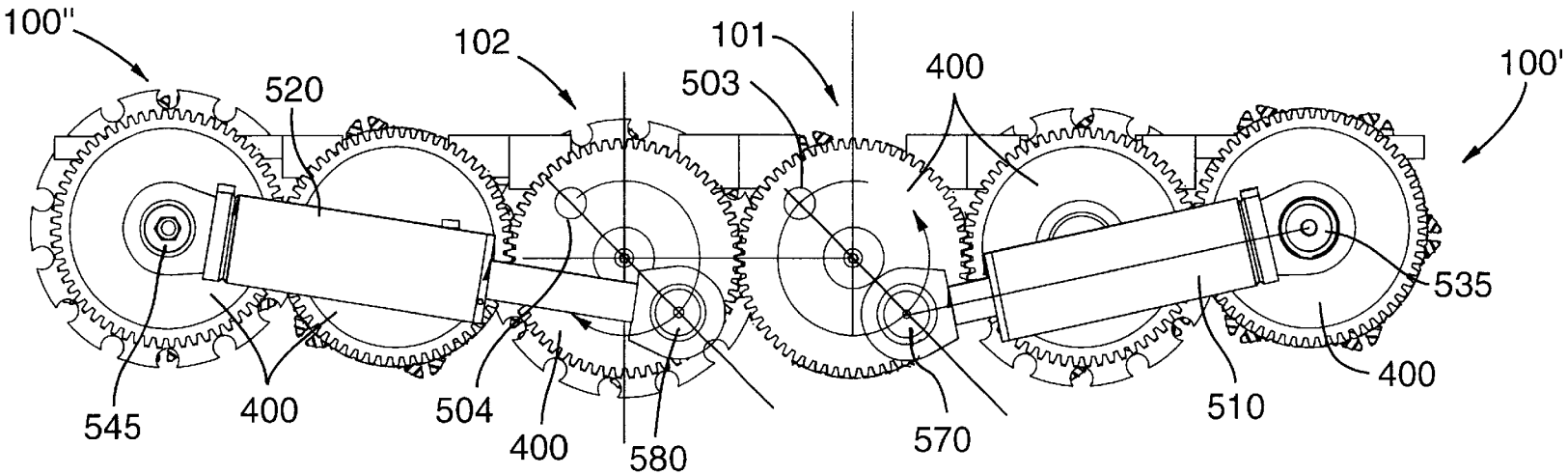
FIG. 8F is a schematic side view of the roll drive of a shredding apparatus according to the invention, seen from the roll drive side, showing the drive cylinders in a sixth position.
Figure 8G:
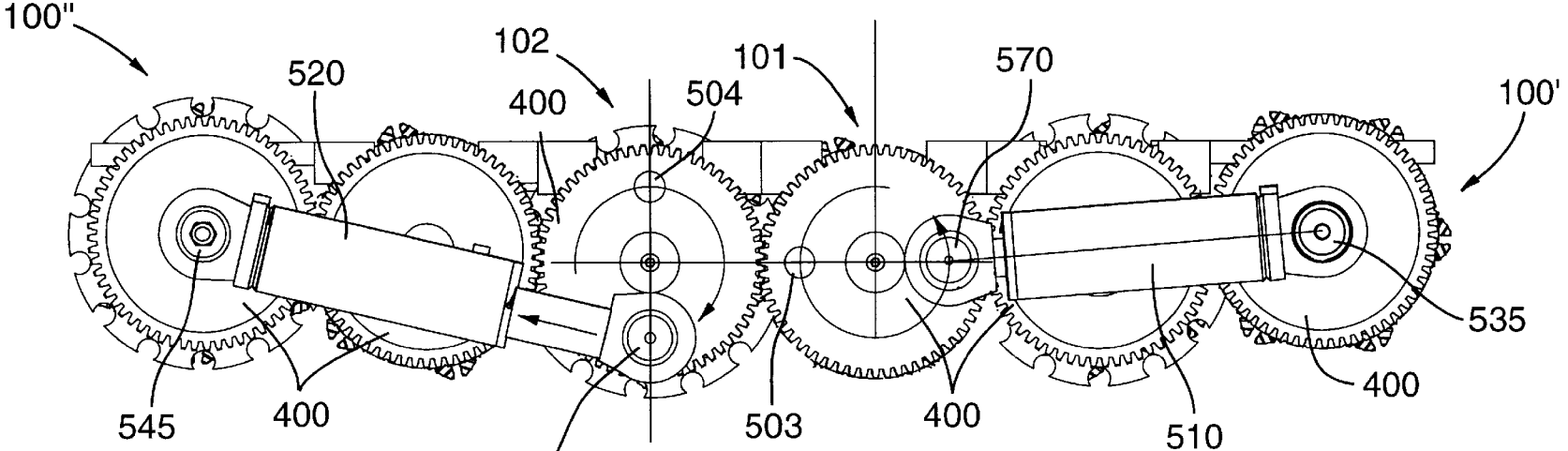
FIG. 8G is a schematic side view of the roll drive of a shredding apparatus according to the invention, seen from the roll drive side, showing the drive cylinders in a seventh position.
Figure 8H:
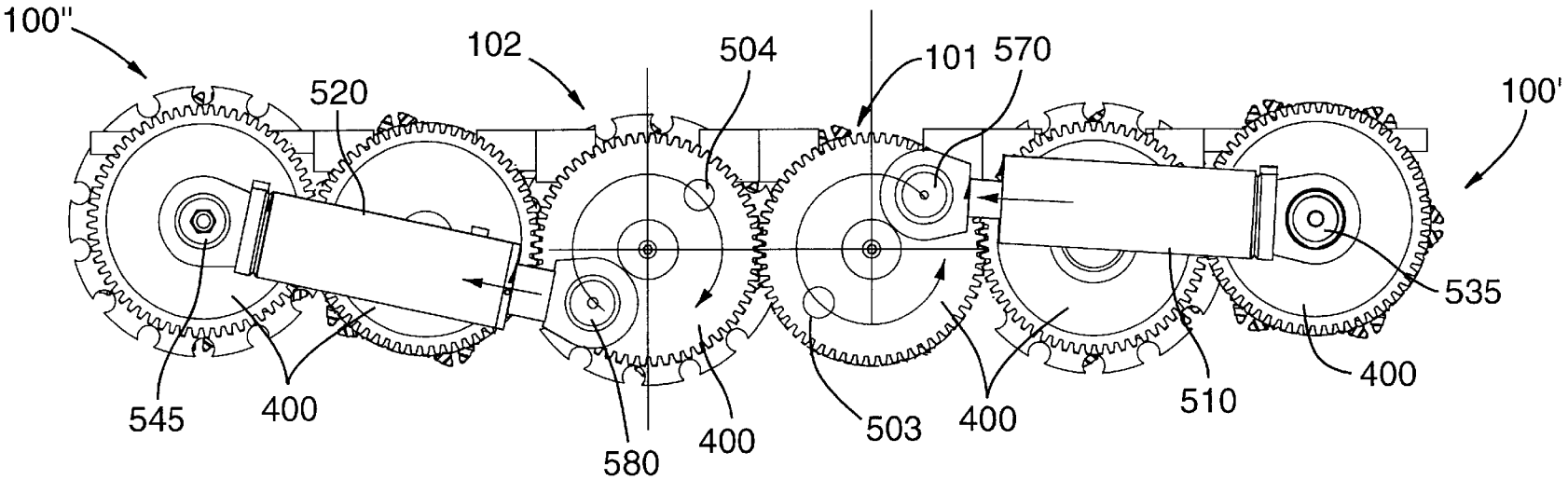
FIG. 8H is a schematic side view of the roll drive of a shredding apparatus according to the invention, seen from the roll drive side, showing the drive cylinders in an eighth position.
Figure 9A:
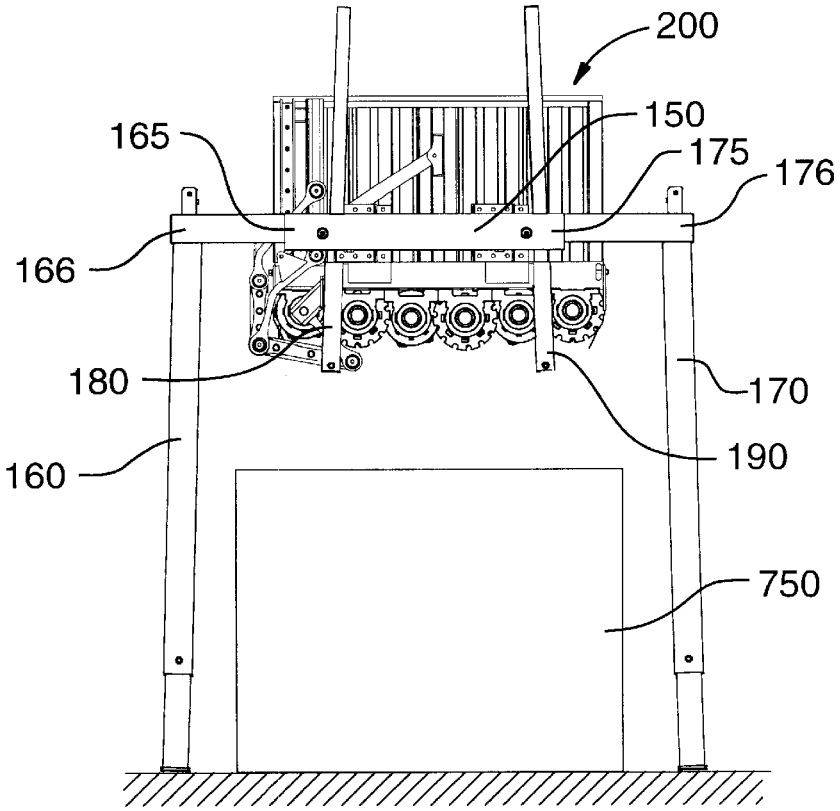
FIG. 9A is a schematic side view of a shredding apparatus according to the invention, seen from the side opposite the roll drive side, showing the shredding apparatus in a position for shredding having a container positioned underneath the roll arrangement.
Figure 9B:
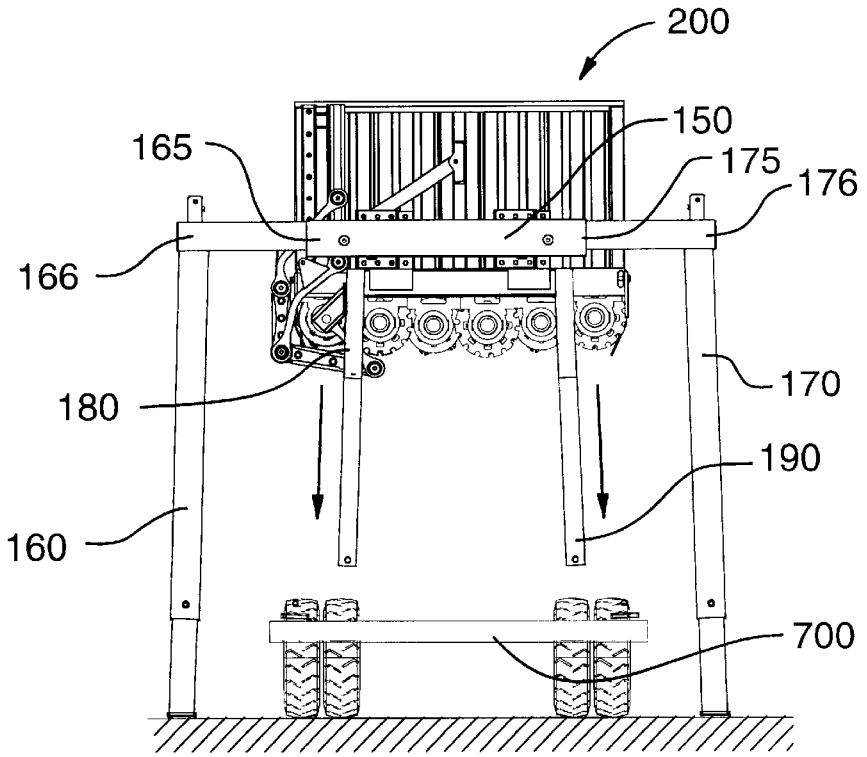
FIG. 9B is a schematic side view of a shredding apparatus according to the invention, seen from the side opposite the roll drive side, showing the shredding apparatus in a position for loading onto a trailer.
Figure 9C:
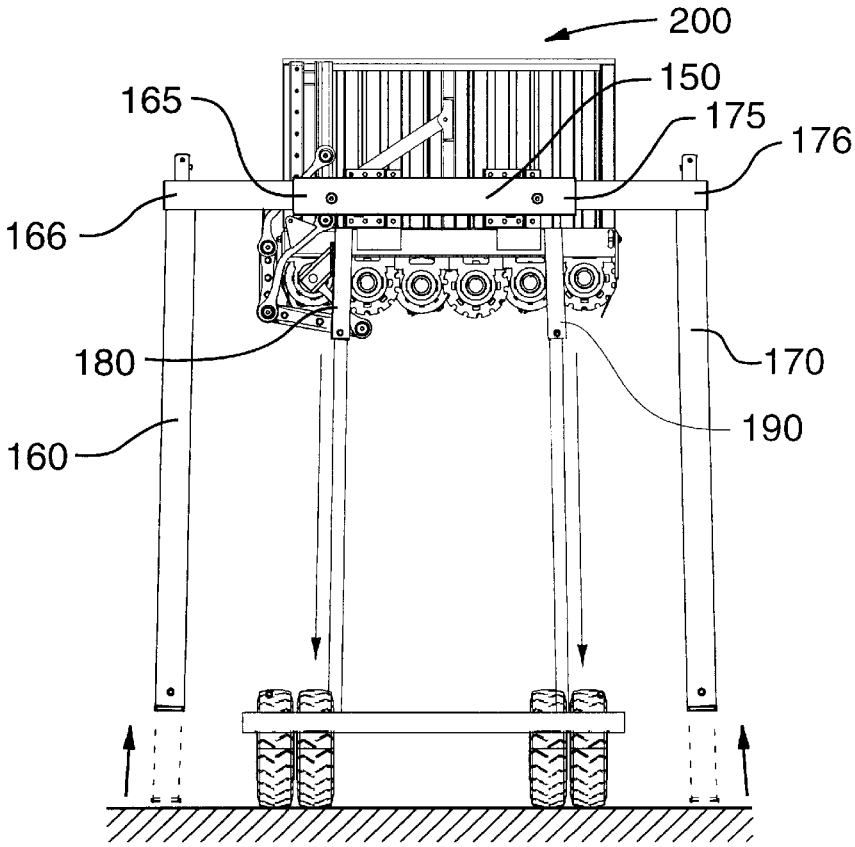
FIG. 9C is a schematic side view of a shredding apparatus according to the invention, seen from the side opposite the roll drive side, showing the shredding apparatus in a position when loading onto a trailer has begun.
Figure 9D:
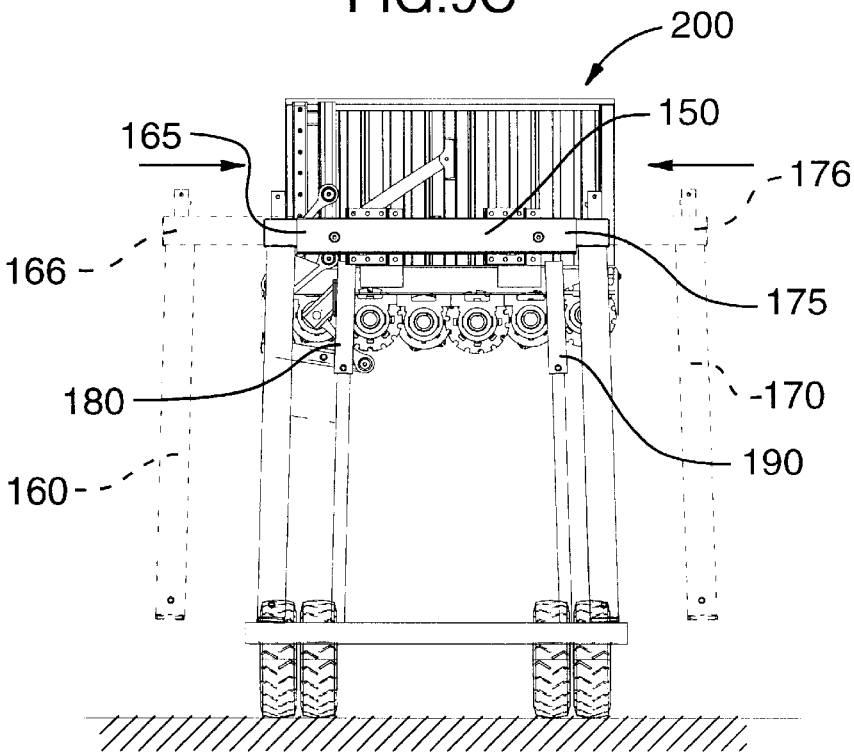
FIG. 9D is a schematic side view of a shredding apparatus according to the invention, seen from the side opposite the roll drive side, showing the shredding apparatus in a position when loading onto a trailer has finished.
Figure 9E:
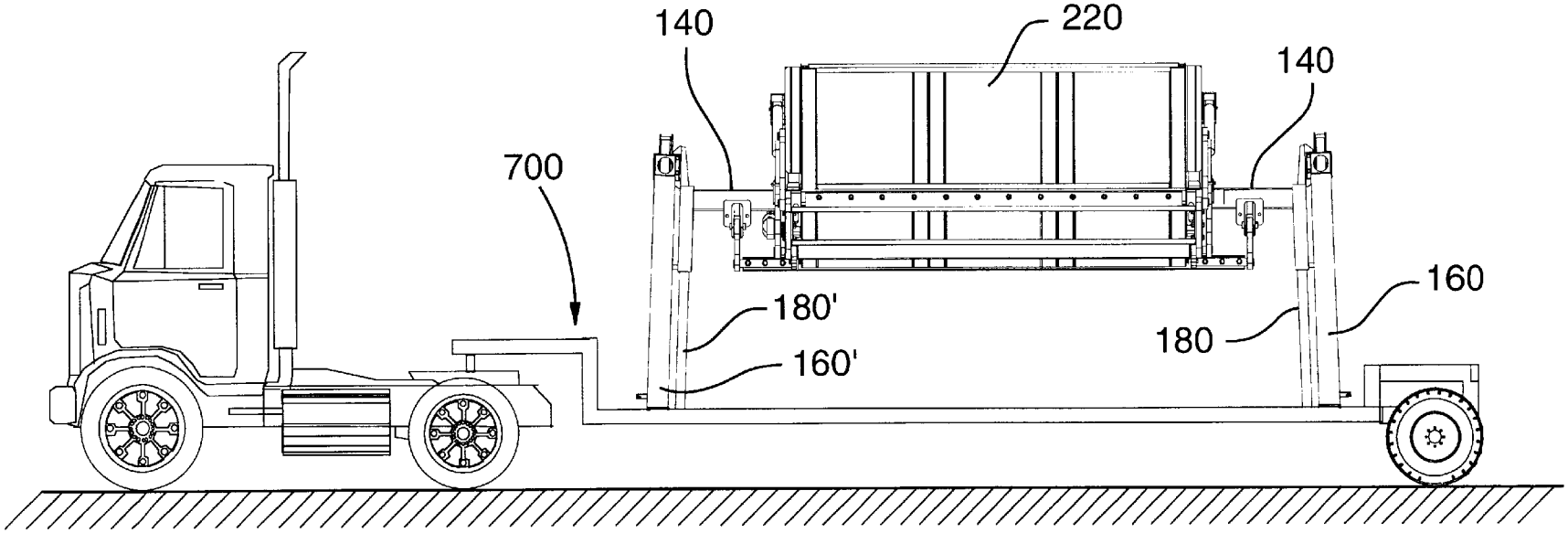
FIG. 9E is a schematic side view of a shredding apparatus according to the invention, seen from the charging door side, showing the shredding apparatus loaded onto a trailer for transport.
Figure 9F:
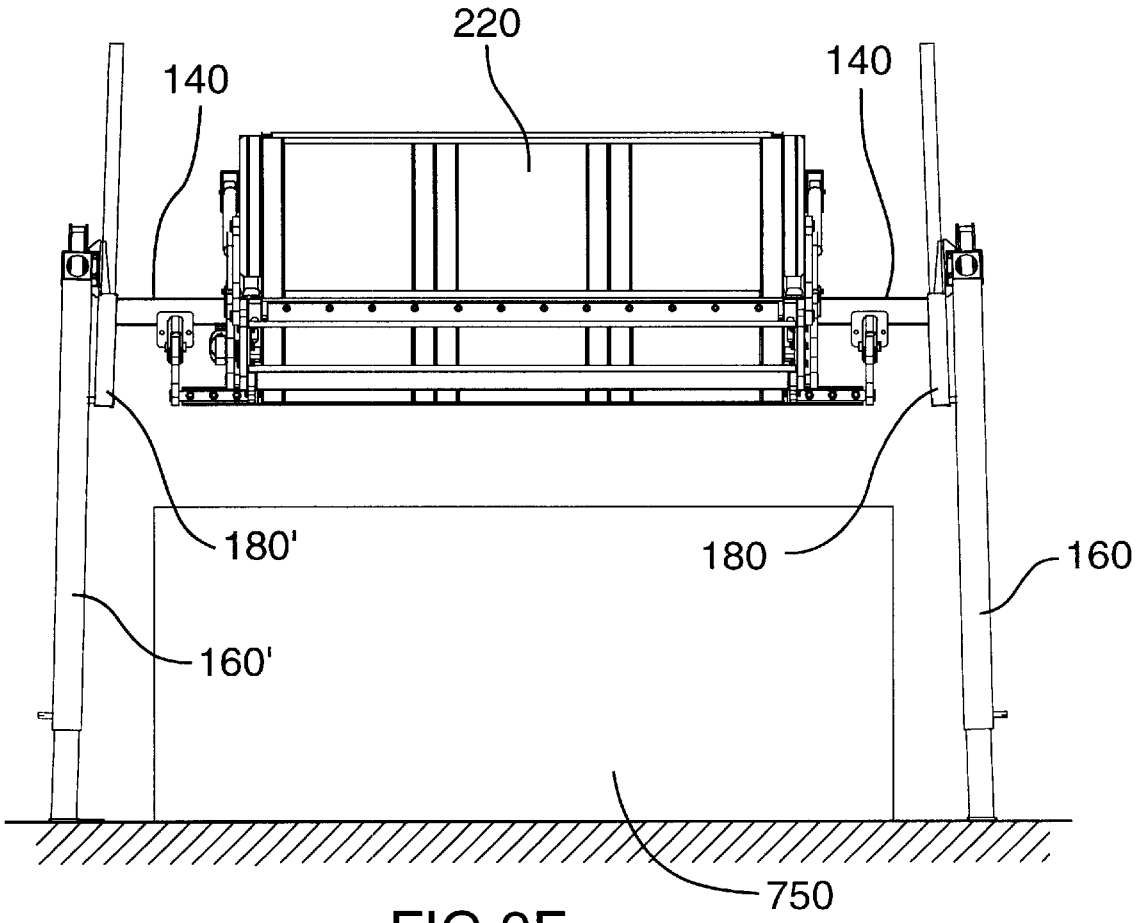
FIG. 9F is a schematic side view of a shredding apparatus according to the invention, seen from the charging door side, showing the shredding apparatus in a position for shredding having a container underneath the roll arrangement.
Figure 9G:
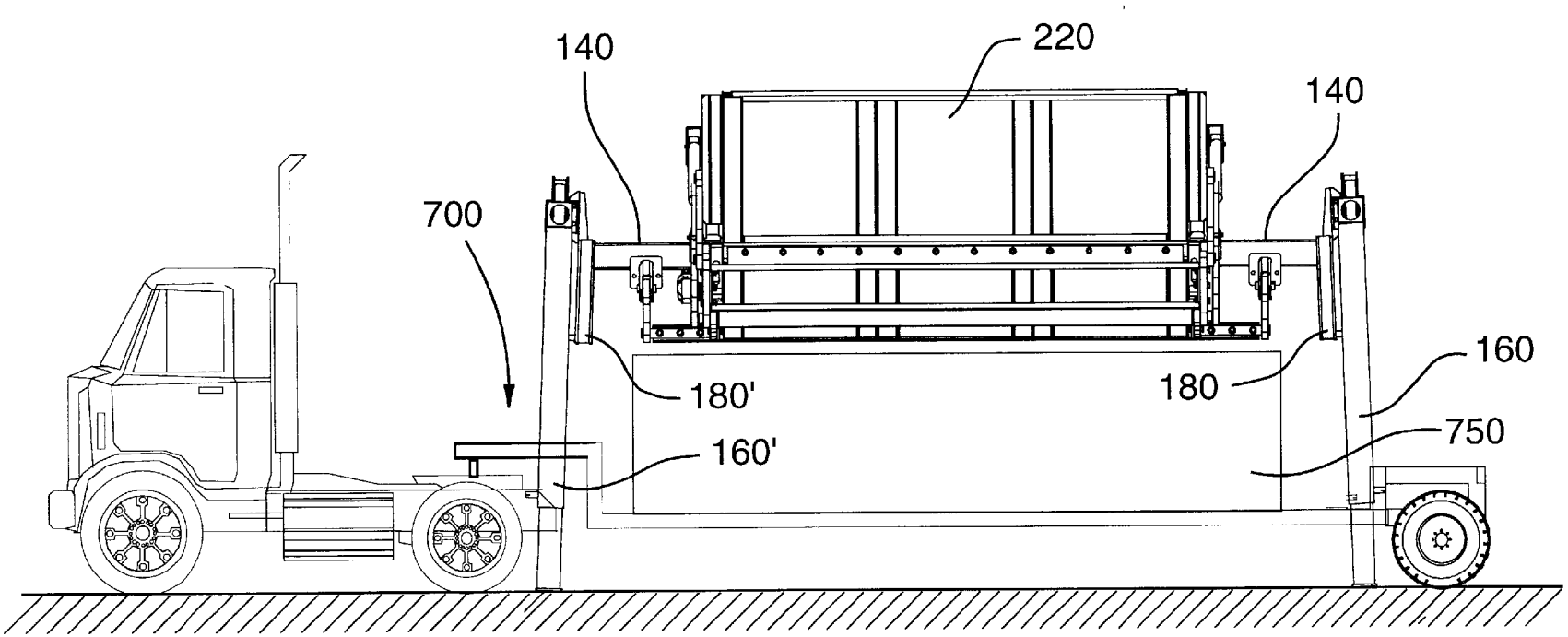
FIG. 9G is a schematic side view of a shredding apparatus according to the invention, seen from the side opposite the roll drive side, showing the shredding apparatus in a position for shredding when the container is loaded onto a trailer.

The sequence of drive cylinder movements is shown in FIGS. 8A to 8H. FIG. 8A shows the first drive cylinder 510 in a starting position, which is an arbitrary position chosen for illustration only. In this example, the first drive cylinder is extended and the second drive cylinder 520 is also extended, causing the cog wheels 400 to rotate, as described above. The cog wheel attached to the first inner roll 101 is shown with a first index mark 503, which is shown for illustration purposes only and does not necessarily appear on the product as used. Similarly, a second index mark 504 is shown on the cog wheel attached to the second inner roll 102. Thus, the second outer roll 100" will rotate counter-clockwise, its adjacent roll will rotate clockwise, the second inner roll 102 will rotate counter-clockwise, the first inner roll 101 will rotate clockwise, its adjacent roll (to the right in the Figs.) will rotate counter-clockwise and the first outer roll 100' will rotate counter-clockwise. In FIG. 8B, the drive cylinders have reached an intermediate position, where the first drive cylinder 510 is approaching its fully extended position. The first index mark 503 has rotated approximately 45 degrees anti-clockwise from its position in FIG. 8A, and the second index mark 504 has rotated approximately 45 degrees clockwise from its position in FIG. 8A. In FIG. 8C, the first drive cylinder is shown in its fully extended position, where it no longer contributes to the rotation movement of the rolls. The second drive cylinder 520 continues to extend, driving the first drive cylinder 510 past its fully extended position. The first drive cylinder then starts contracting, so that driving force is again provided by both drive cylinders. The first index mark 503 has rotated approximately 45 degrees anti-clockwise from its position in FIG. 8B, and the second index mark 504 has rotated approximately 45 degrees clockwise from its position in FIG. 8B. In FIG. 8D, the second drive cylinder is shown approaching its fully extended position. The first index mark 503 has rotated approximately 45 degrees anti-clockwise from its position in FIG. 8C, and the second index mark 504 has rotated approximately 45 degrees clockwise from its position in FIG. 8C. In FIG. 8E, the second drive cylinder is shown in its fully extended position, where it no longer contributes to the rotation movement of the rolls. The first drive cylinder 510 continues to contract, driving the second drive cylinder 520 past its fully extended position. The second drive cylinder then starts contracting, so that driving force is again provided by both drive cylinders. The first index mark 503 has rotated approximately 45 degrees anti-clockwise from its position in FIG. 8D, and the second index mark 504 has rotated approximately 45 degrees clockwise from its position in FIG. 8D. In FIG. 8F, the first drive cylinder is shown approaching its fully contracted position. The first index mark 503 has rotated approximately 45 degrees anti-clockwise from its position in FIG. 8E, and the second index mark 504 has rotated approximately 45 degrees clockwise from its position in FIG. 8E. In FIG. 8G, the first drive cylinder has reached its fully contracted position, where it no longer contributes to the rotation movement of the rolls. The first second cylinder 520 continues to contract, driving the first drive cylinder 510 past its fully contracted position. The first drive cylinder then starts extending, so that driving force is again provided by both drive cylinders. The first index mark 503 has rotated approximately 45 degrees anti-clockwise from its position in FIG. 8E, and the second index mark 504 has rotated approximately 45 degrees clockwise from its position in FIG. 8E. In FIG. 8H, the second drive cylinder is shown approaching its fully contracted position. The first index mark 503 has rotated approximately 45 degrees anti-clockwise from its position in FIG. 8F, and the second index mark 504 has rotated approximately 45 degrees clockwise from its position in FIG. 8F. During further rotation, the second drive cylinder will reach its fully contracted position, where it no longer contributes to the rotation movement of the rolls. The first cylinder 510 continues to expand, driving the second drive cylinder 520 past its fully contracted position. The second drive cylinder then starts extending, so that driving force is again provided by both drive cylinders. Thus, the system is back to a position shown in FIG. 8A.

Figure 10A:
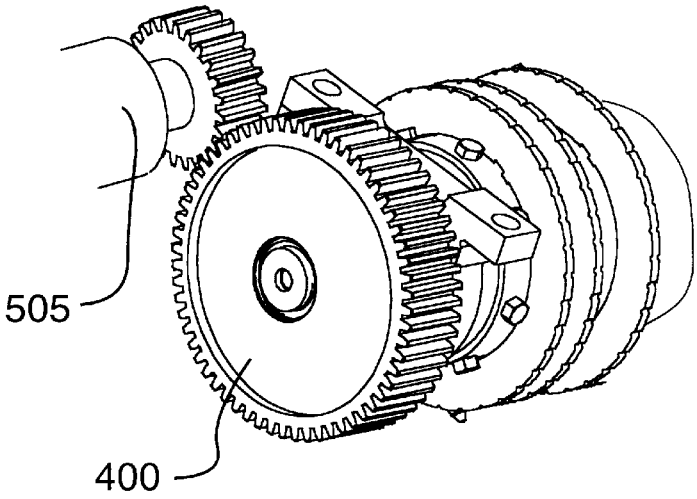
FIG. 10A is a detail view of one embodiment of a rotary position sensor for measuring the angular position of the rolls.
Figure 10B:
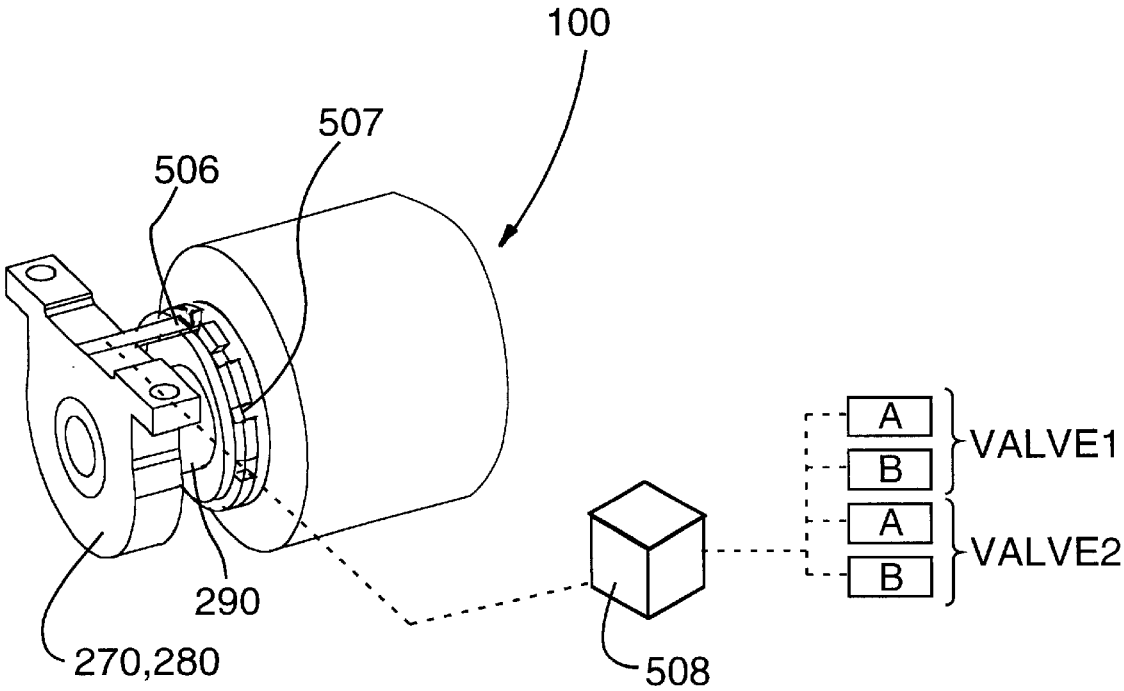
FIG. 10B is a detail view of a further embodiment of a rotary position sensor for measuring the angular position of the rolls.
Figure 11:
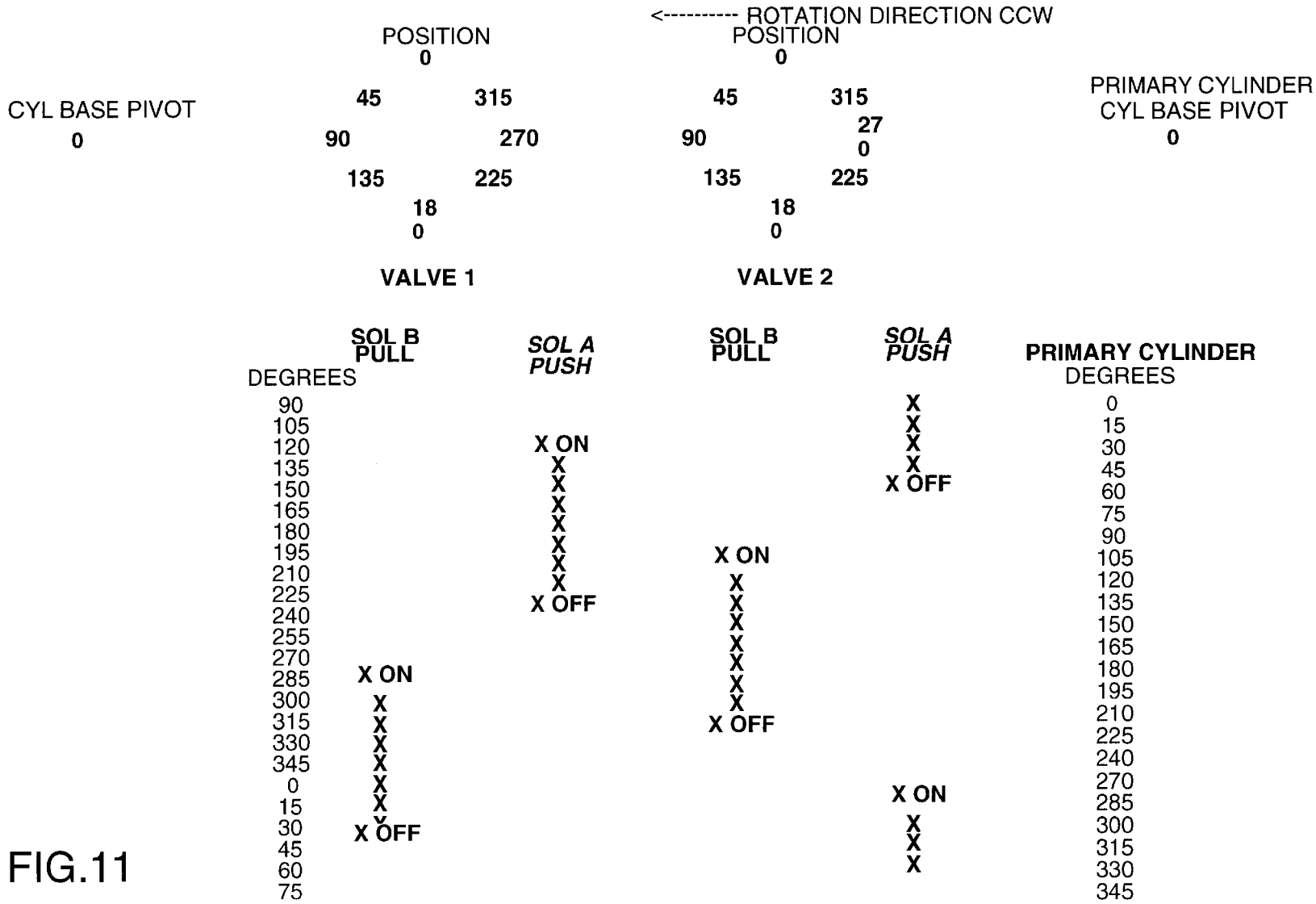
FIG. 11 is a logic diagram showing the cylinder logic for the embodiment where the drive means has two hydraulic cylinders.

The hydraulic cylinders are preferably regulated by a rotary hydraulic valve 505, which is directly linked to at least one roll drive shaft, to sense the position of the roll(s) (FIG. 10A). The rotary hydraulic valve directs the hydraulic oil to the desired cylinder, to retract or extend this cylinder as appropriate. Alternatively (FIG. 10B), an encoder 506 is directly mounted adjacent an indication means 507 arranged directly on the roll shaft end 290, to sense the radial position of the roll, and will feed a signal corresponding to this position to a central processor 508, which is programmed to sequentially activate solenoid controlled hydraulic valves VALVE1 and VALVE2, which comprises two pairs of solenoids each (VALVE1A, VALEVE1B and VALVE2A, VALVE2B, respectively), to extend or retract the cylinders sequentially at appropriate times. The operation of the respective solenoids is shown in FIG. 11.

In FIGS. 1E, 2E, 2F, 2G, 3C, 3D, 4C, 4D and 4E, an alternative drive means 500' is shown. The alternative drive means comprises a hydraulic motor 595 with associated control means 590. The hydraulic motor drives the plurality of rolls 100 via a power transmission 596 coupled to a roll drive shaft 597. Further technical features are the same as shown regarding the dual cylinder drive means, and share the same reference numerals.

In FIGS. 1F, 2H, 3E and 4F, a further alternative drive means 500" is shown. The further alternative drive means comprises an electric motor 595'. The electric motor drives the plurality of rolls 100 via a power transmission 596' coupled to a roll drive shaft 597'. Further technical features are the same as shown regarding the dual cylinder drive means, and share the same reference numerals.

As is shown in FIG. 5A, each roll 100 has a first series of picks 600 in a spaced arrangement along the longitudinal direction of the roll and facing a first direction of rotation, so that the first series of picks form a screw spiral or helix around the outer circumference of the roll. Each pick/pick holder is offset a certain first angle, with respect to adjacent picks belonging to the same helix. For example, the first angle might be 15, 30, 45, 60 or 90 degrees. An alternative embodiment (not shown) has more than one pick helix around the roll, in one direction, for example 6 or 8 helixes. Each pick, or tooth, of the first series is removable and held by a pick holder 610 (see FIG. 6). A second series of picks 700 is in a spaced arrangement along the longitudinal direction of the roll and facing a second direction of rotation, so that the second series of picks form a screw spiral or helical around the outer circumference of the roll, but winding around the roll in a direction opposite to the helical formed by the first series of picks 600. Similarly, an alternative embodiment (not shown) has more than one helix of picks around the roll in the opposite direction to the first set of helixes. Each pick, or tooth, of the second series is removable and held by a pick holder 710 (see FIG. 6). Thus, the picks of the first series shreds material when the roll is rotating in one direction, and the picks of the second series shreds material when the roll is rotating in the other direction. The roll(s) can shred material equally well in both directions of rotation.

A preferred pick is manufactured by Kennametal™, together with a suitable pick holder. The pick holder is preferably welded onto the rolls. The purpose of arranging the picks in helical patterns is to create a force working along the longitudinal direction of the rolls, when the roll is rotating and the picks of either the first or second series hit the material to be shredded. Only the picks facing the actual direction of rotation of the roll will contribute to the shredding, the other picks (facing the other direction) will not impact the material to be shredded with enough force. Thus, when the picks progressively hit the material to be shredded, the material is affected also by a force directed along the longitudinal direction of the roll, which has the effect of moving the material around in a beneficial way above the rolls. Since the direction of rotation of the rolls is inverted with regular intervals, the material to be shredded will be hit from both directions by the two sets of picks per roll, and will also be moved longitudinally along the rolls. Also, because each adjacent roll rotates in a different direction, the material to be shredded will be subjected to shearing forces, which effectively will tear the material apart.

To further improve the shredding capacity of the roll arrangement by increasing the available power per pick ratio, the angular arrangement of picks belonging to the same series of picks (first or second) is displaced a certain second angle, when comparing adjacent rolls. For example, if the second outer roll 100" has a pick belonging to the first series of picks 600 at a zero angle, the corresponding pick of the first series of the adjacent roll is arranged at 6 degrees anticlockwise direction on the adjacent roll. It is obvious that other angles might be used with success, for instance 8 degrees. Further, the corresponding pick on the second inner roll 102, which is the next adjacent roll, is arranged at 12 degrees anticlockwise direction on the second inner roll. Thus, each pick is displaced 6 degrees, compared to the pick belonging to the same series on an adjacent roll. At any given time, a maximum of two picks are in contact with the material to be shredded for each roll. To enable the rolls to be positioned close enough to each other to provide small enough openings between the rolls for the desired shredding size, the picks of one roll are displaced longitudinally with respect to an adjacent roll. Thus, the picks of one roll will not collide with the picks of an adjacent roll. The distance between adjacent rolls depends, inter alia, on the desired shredder capacity and the available power of the drive unit.

The plurality of rolls 100 further have a plurality of discs 800 arranged radially around the circumference of each roll. The discs are preferably arranged in pairs surrounding each pick 600, 700, respectively, and its pick holder 610, 710, respectively. For larger size shredding and/or more aggressive shredding, a single disc (not shown) may be used adjacent each pick. These discs function as stand-off discs, performing at least five functions: 1) controlling the cutting depth of the picks in the material to be shredded, 2) function as dynamic anvils holding the material to be shredded for the pick hit, 3) function as shear plates to tear material themselves, 4) function as sizing discs for determining the shredding size, and 5) allow fines to freely pass through the roll bed without causing additional wear and tear on the rolls. The dynamic anvil function reduces the wear on the anvil, compared to a fixed (non-rotating or non-moving) anvil construction. The distance the picks/teeth extend beyond the outer circumference of the discs 800 controls the depth of the cut ("bite") in the material to be shredded, thus controlling shredded particle size. The gaps defined between the discs control the size of the material allowed to fall through the rolls, thus letting fine and abrasive material fall through without causing wear and tear on the rolls or other parts of the shredding apparatus.

Figure 6:
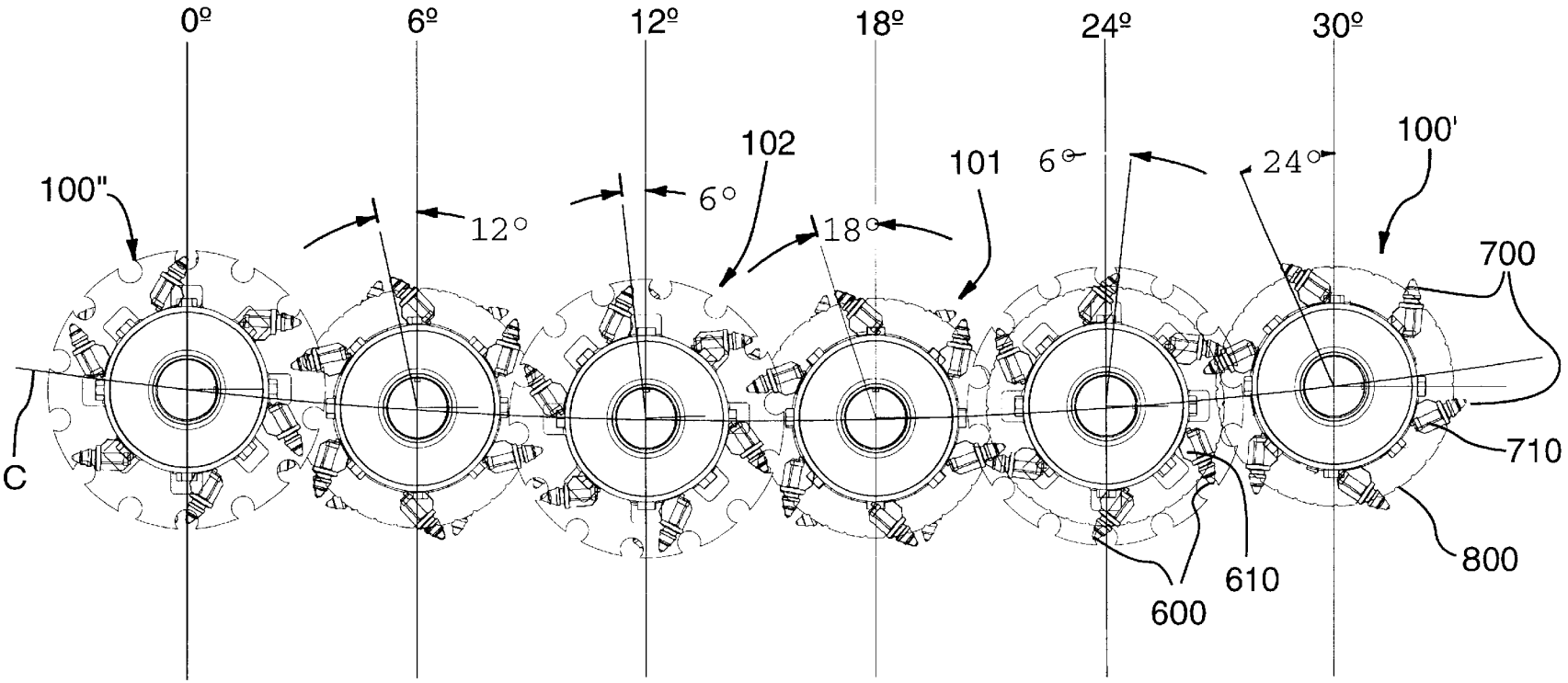
FIG. 6 is a schematic side view of the roll arrangement of a shredding apparatus according to the invention, showing a curved roll assembly.
Figure 7A:
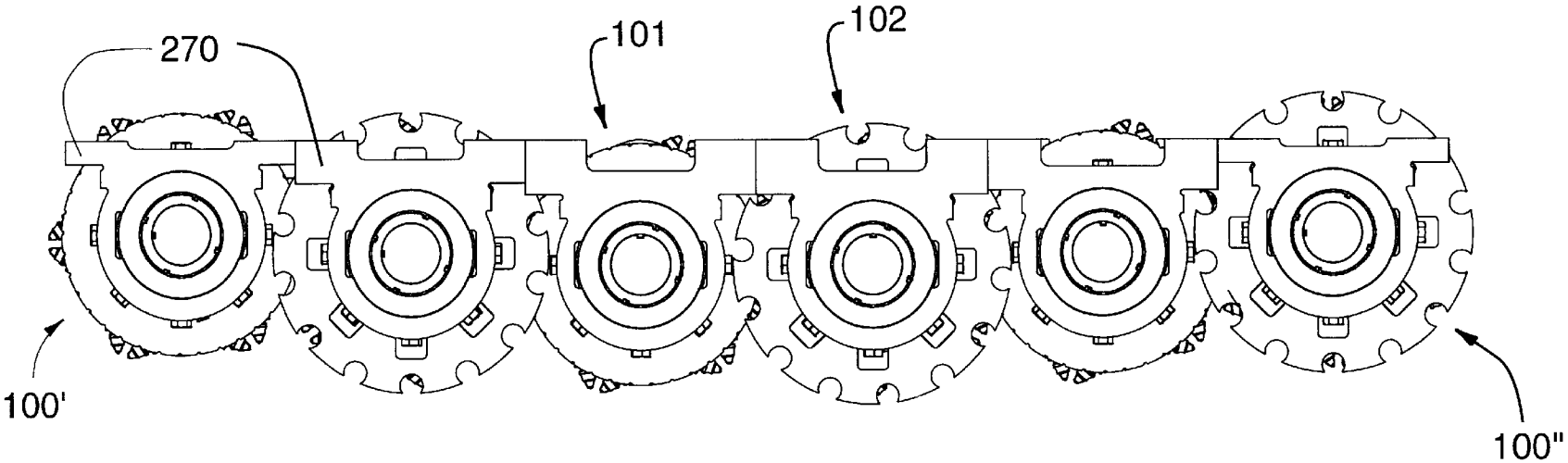
FIG. 7A is a side view of a roll arrangement of a shredding apparatus according to the invention, seen from the opposite side from the roll drive side, showing the roll holders.
Figure 7B:
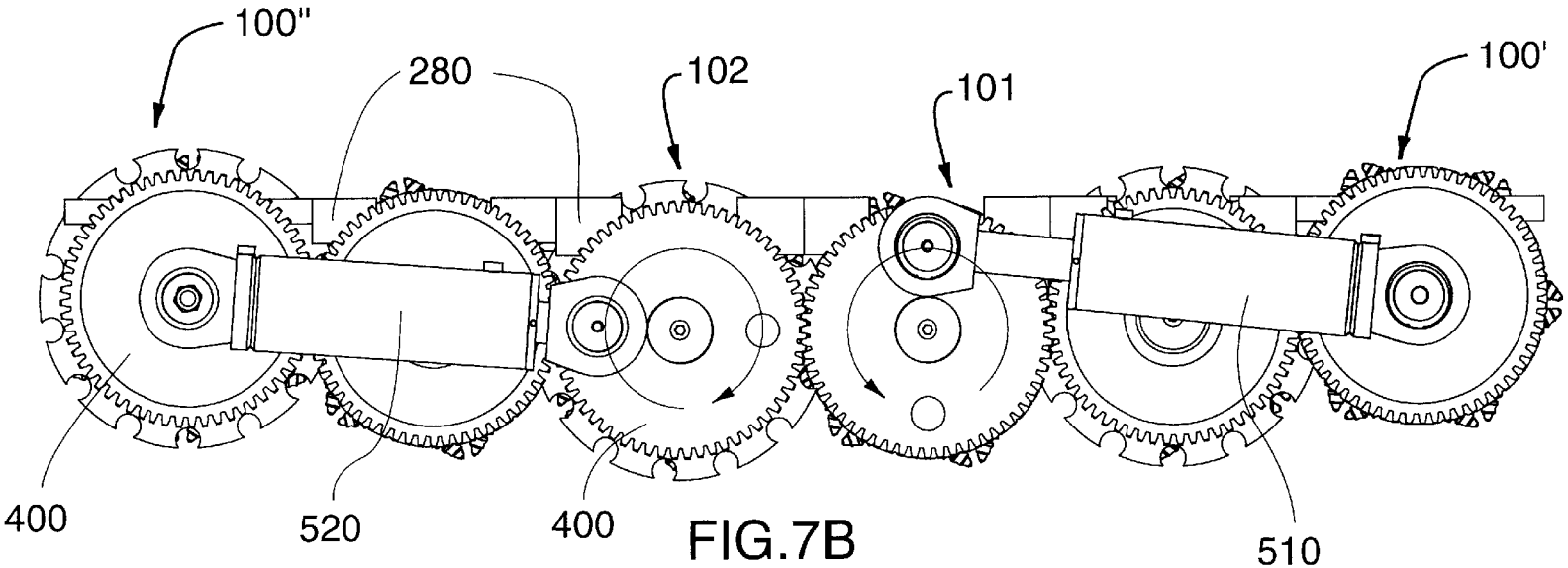
FIG. 7B is a side view of a roll arrangement of a shredding apparatus according to the invention, seen from the roll drive side, showing the roll holders, drive cylinders and cog wheels.

As is shown in FIG. 6, the plurality of rolls 100 are arranged along a sloping curve C, where the outer rolls 100', 100", respectively and the inner rolls 101, 102, respectively, are at different horizontal heights, with respect to the frame 110 (see FIG. 1A). The outer rolls are placed higher than the inner rolls, and the intermediate rolls between them are on heights which are progressively lower going from the outer rolls towards the inner rolls. Both the inner rolls are at substantially the same height, and both inner rolls are at substantially the same height. In this way, the material to be shredded will tend to fall towards the middle of the roll arrangement, as opposed to staying at the extreme ends of the roll arrangement. This enhances the shredding capacity, by avoiding still standing or stuck material at the walls of the shredder. Because of the periodic reversal of the roll rotating directions, material will not gather along the sides of the shredder where the rolls are held to the frame. Preferably, a pressure sensing means 501 (see FIG. 5A) is connected to the drive system to automatically reverse the roll rotation directions in case material gets stuck in the roll arrangement (detection of high pressure, or slow-down of rotation speed of the rolls). Also, a timer arrangement 502 (see FIG. 2C) will periodically reverse the roll rotation direction, as described.

Figure 12A:
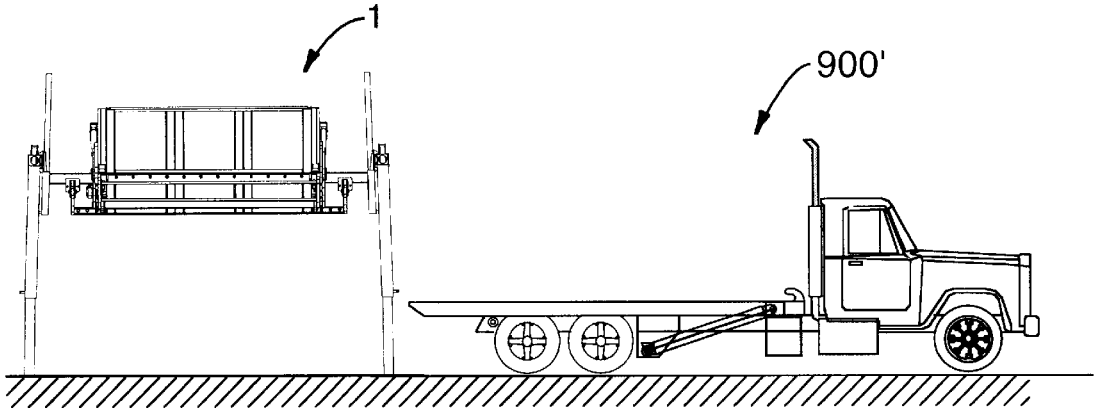
FIG. 12A is a schematic side view of a shredding apparatus according to the invention being loaded on a truck, showing the initial position of the shredding apparatus.
Figure 12B:
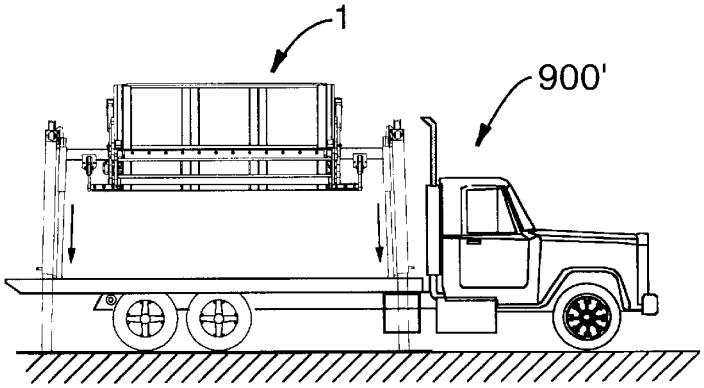
FIG. 12B is a schematic side view of a shredding apparatus according to the invention being loaded on a truck, showing the shredding apparatus being lifted off the ground by the lifting legs.
Figure 12C:
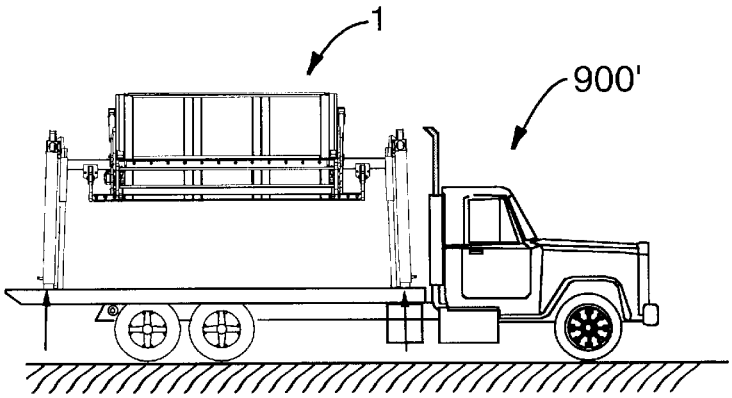
FIG. 12C is a schematic side view of a shredding apparatus according to the invention being loaded on a truck, showing the final position of the shredding apparatus loaded onto the truck.

FIGS. 12A to 12C show a sequence where a roll-off type truck 900' is used to load a shredding apparatus 1 for transport. FIG. 12A shows the truck 900' in position to back under the shredding apparatus, which is in its raised working position. In FIG. 12B, the truck is in position underneath the shredding apparatus 1, and the lifting legs of the shredding apparatus are lowered onto the carrying surface of the truck, so that the shredding apparatus main legs are lifted off ground. The main legs are lifted fully, and retracted fully horizontally, as shown in FIG. 12C, to prepare the transport of the shredding apparatus.

Figure 13A:
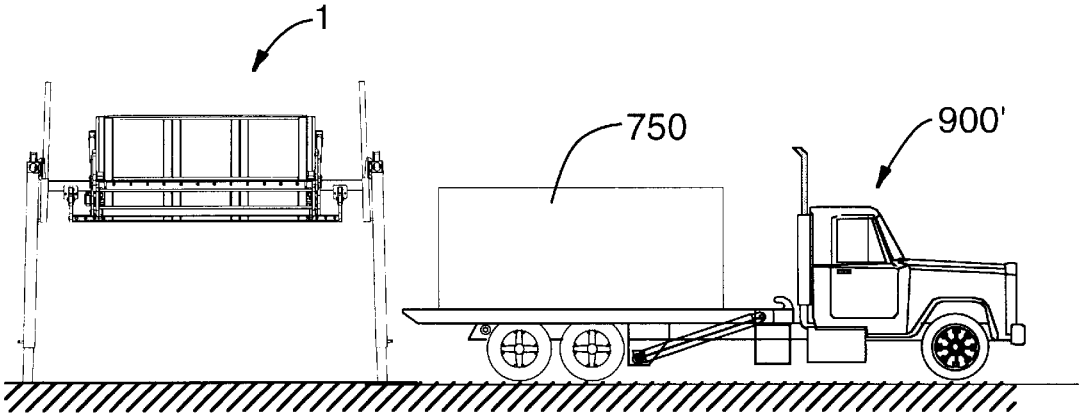
FIG. 13A is a schematic side view of a shredding apparatus according to the invention having a container placed underneath it by a truck, showing the initial position of the truck with loaded container.
Figure 13B:
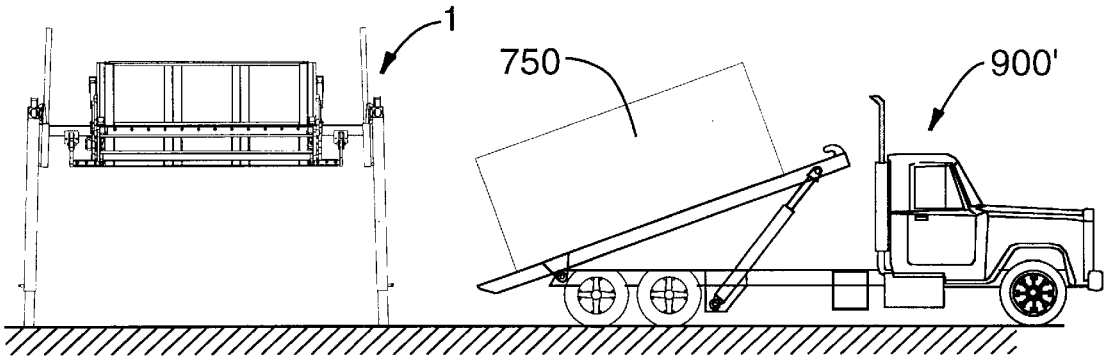
FIG. 13B is a schematic side view of a shredding apparatus according to the invention having a container placed underneath it by a truck, showing the container beginning to be unloaded from the truck.
Figure 13C:
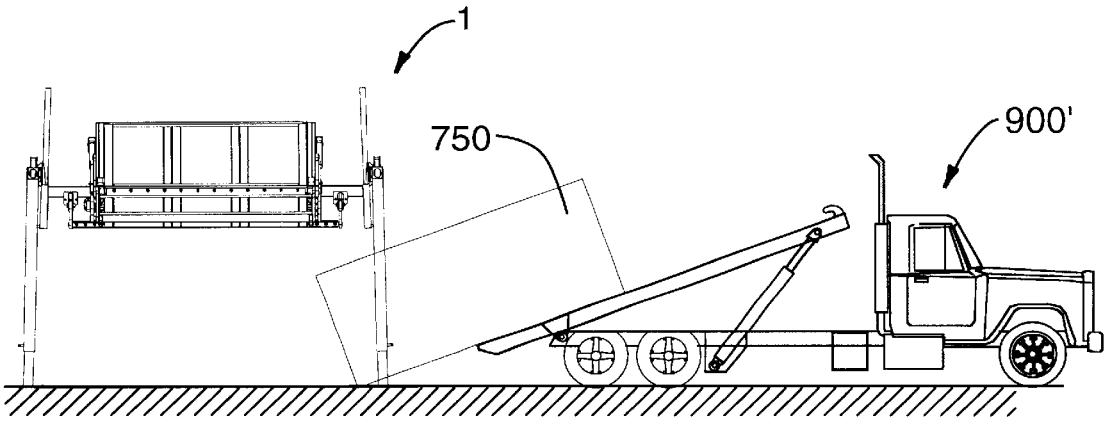
FIG. 13C is a schematic side view of a shredding apparatus according to the invention having a container placed underneath it by a truck, showing the container being slid underneath the shredding apparatus.
Figure 13D:
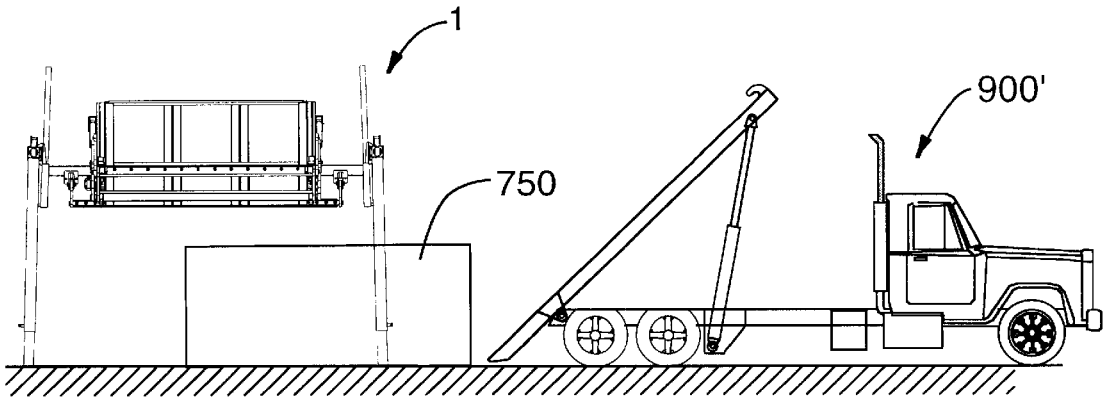
FIG. 13D is a schematic side view of a shredding apparatus according to the invention having a container placed underneath it by a truck, showing the container fully dropped onto the ground but not yet pushed underneath the shredding apparatus.
Figure 13E:
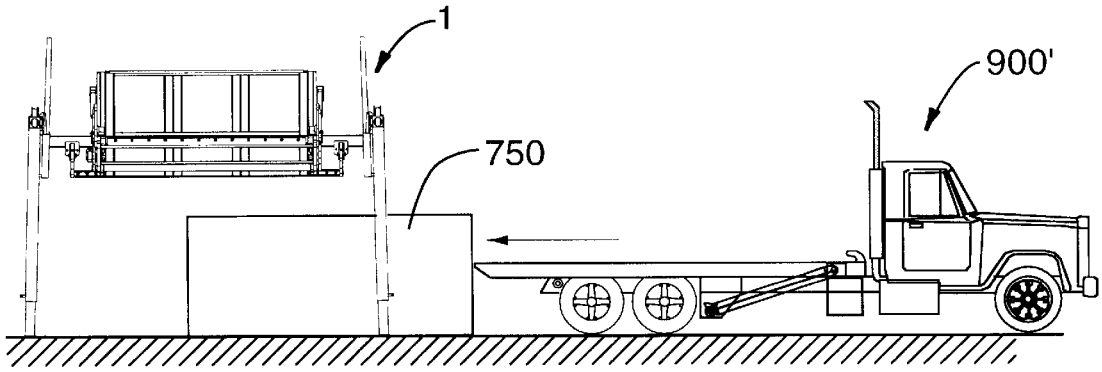
FIG. 13E is a schematic side view of a shredding apparatus according to the invention having a container placed underneath it by a truck, showing the track beginning to push the container underneath the shredding apparatus.
Figure 13F:
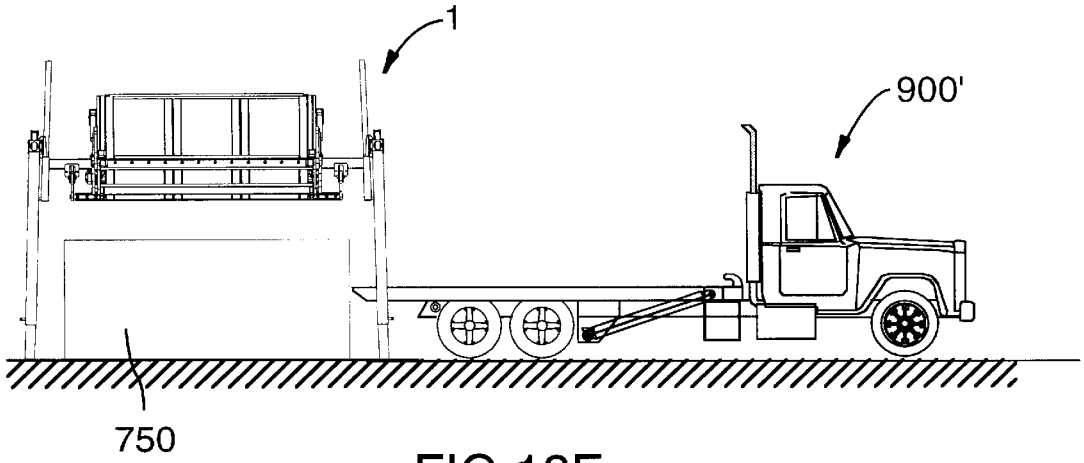
FIG. 13F is a schematic side view of a shredding apparatus according to the invention having a container placed underneath it by a truck, showing the container completely pushed underneath the shredding apparatus.

FIGS. 13A to 13F show a sequence where a roll-off type truck 900' is used to position (or remove) a container 750 from underneath the shredding apparatus 1. The container is positioned close to the shredding apparatus (being loaded onto the truck), as shown in FIG. 13A, and the lifting mechanism of the truck is started (FIG. 13B), to eventually unload the container onto the ground adjacent the shredding apparatus (FIGS. 13C and 13D). Once the container is fully resting on the ground (FIG. 13D), the truck lowers the lifting mechanism and pushes the container the required distance underneath the shredding apparatus (FIGS. 13E and 13F). Loading the container onto the truck is done in the reverse order (not shown) by first dragging the container out from under the shredding apparatus, then hooking it onto the lifting mechanism of the truck, and lifting it onto the truck. Alternatively, if the space so permits, the container (situated underneath the shredding apparatus) is directly hooked onto the lifting mechanism of the truck, and lifted onto the truck in one motion (without having to push it out a certain distance from underneath the shredding apparatus first).

Figure 14A:
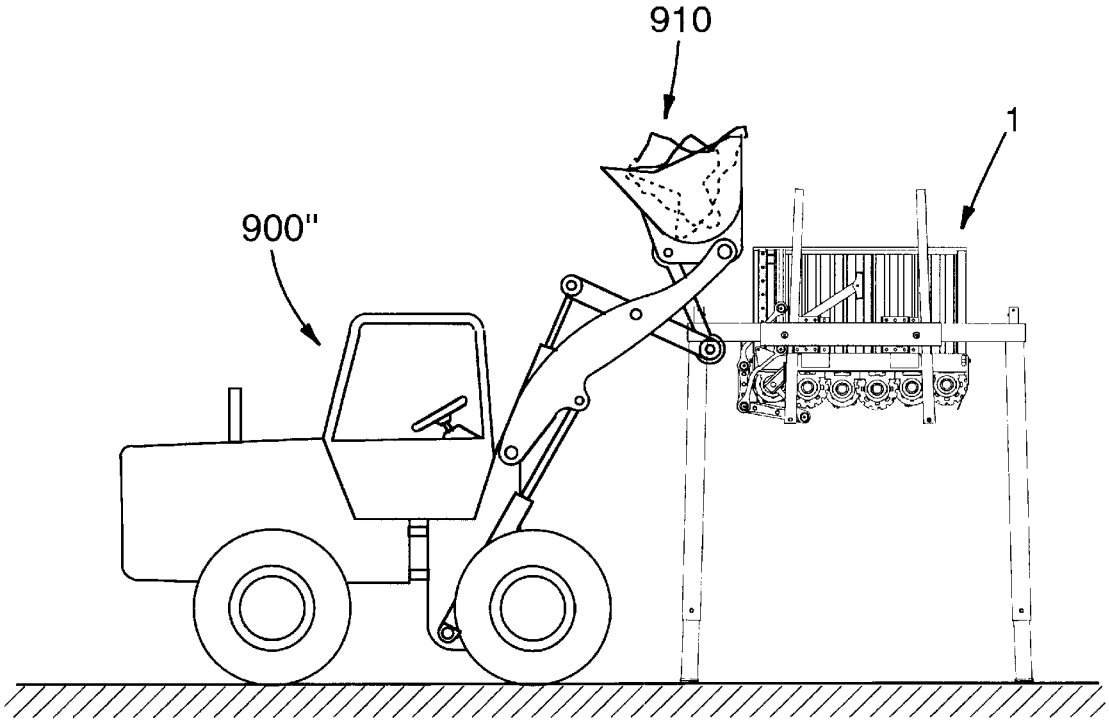
FIG. 14A is a schematic side view of a shredding apparatus according to the invention being charged with large scrap, such as stumps, by a front loader, with the door of the shredding apparatus open.
Figure 14B:
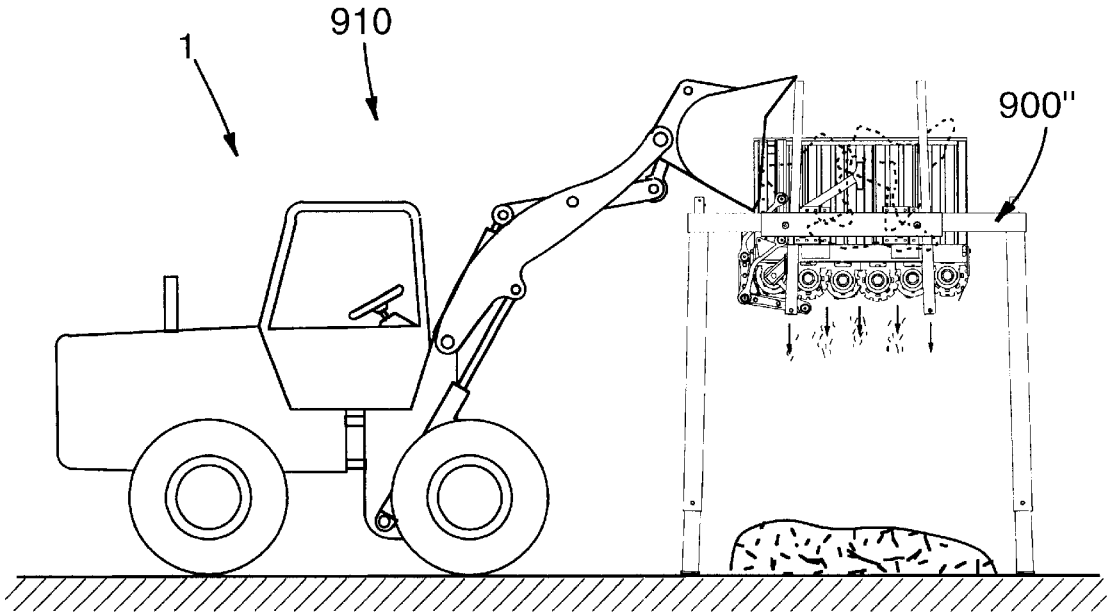
FIG. 14B is a schematic side view of a shredding apparatus according to the invention being charged with large scrap, such as stumps, by a front loader, showing the stumps being scraped off the bucket of the front loader and into the shredding apparatus.
Figure 14C:
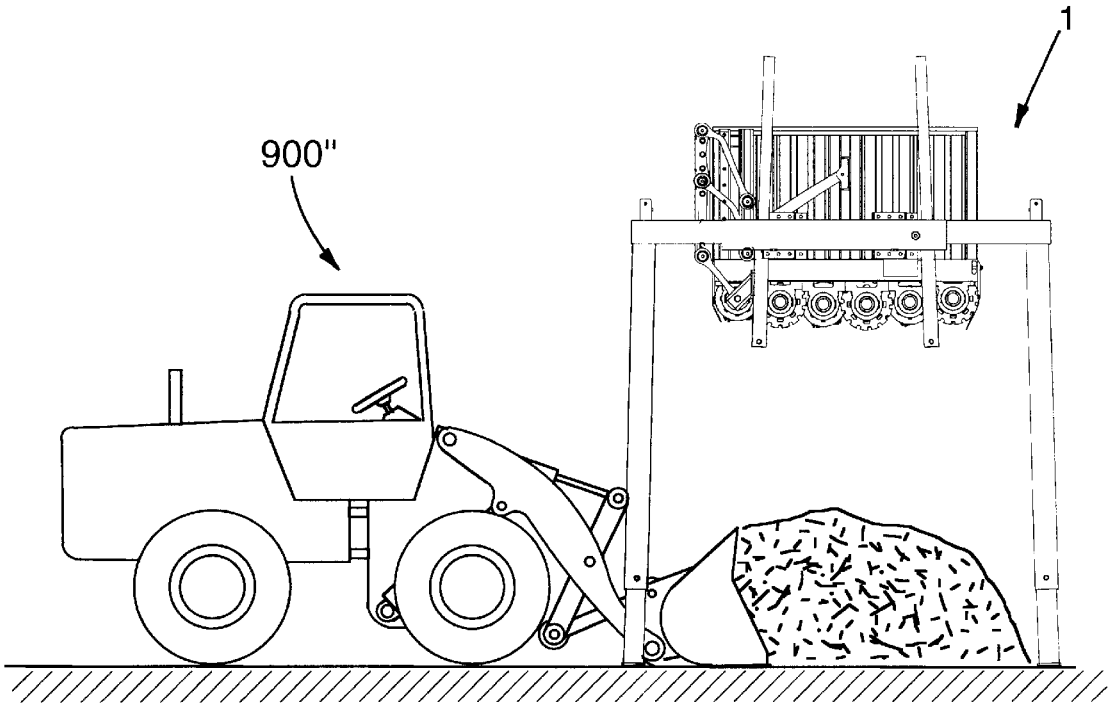
FIG. 14C is a schematic side view of a shredding apparatus according to the invention being charged with large scrap, such as stumps, by a front loader, showing the stumps fully ground and the ground material fallen on underneath the shredding apparatus ready to be pushed to the side using the front loader.

FIGS. 14A to 14C show a sequence where larger material 910, such as stumps, is charged into the shredding apparatus 1, using a front loader type vehicle 900". This type of material is often contaminated with dirt and stones, which makes it practical to not collect it in a container, but to let it fall directly onto the ground after shredding. Thus, the material 910 is charged into the shredding apparatus (FIGS. 14A and 14B) with the front door of the shredding apparatus opened, and the material is scraped off the bucket of the front loader by running the bucket over the threshold of the shredding apparatus front door (FIG. 14B). The shredded material mix can be pushed away from underneath the shredding apparatus after completed shredding, for example using the front loader (FIG. 14C).

Figure 15A:
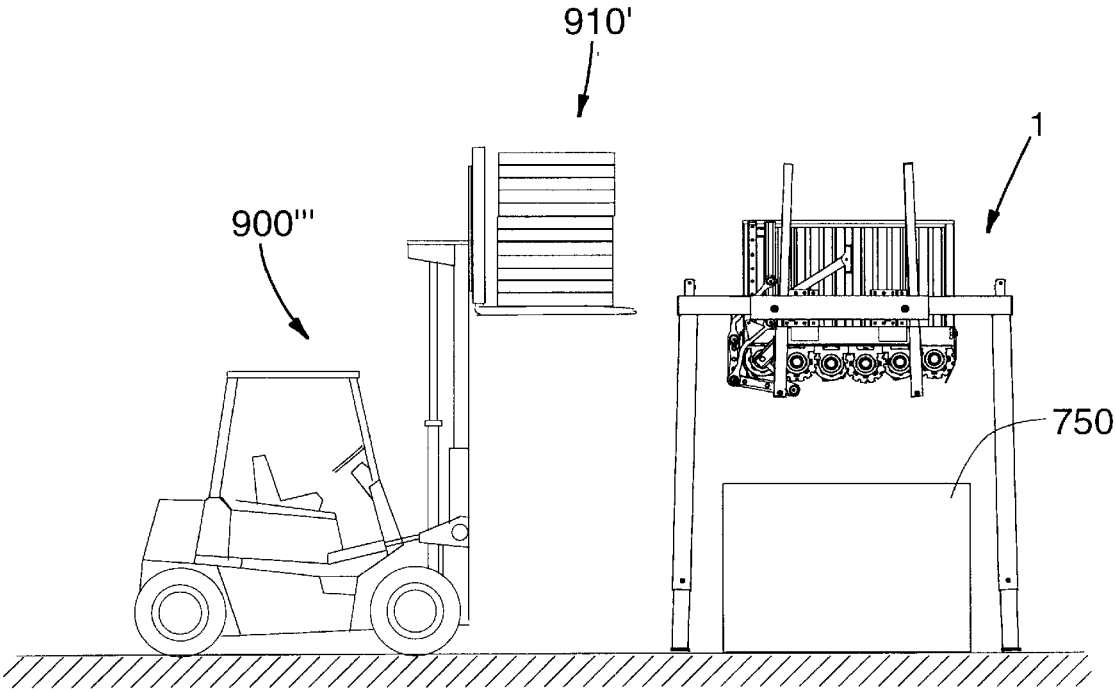
FIG. 15A is a schematic side view of a shredding apparatus according to the invention being charged with large scrap, such as pallets, by a fork lift truck.
Figure 15B:
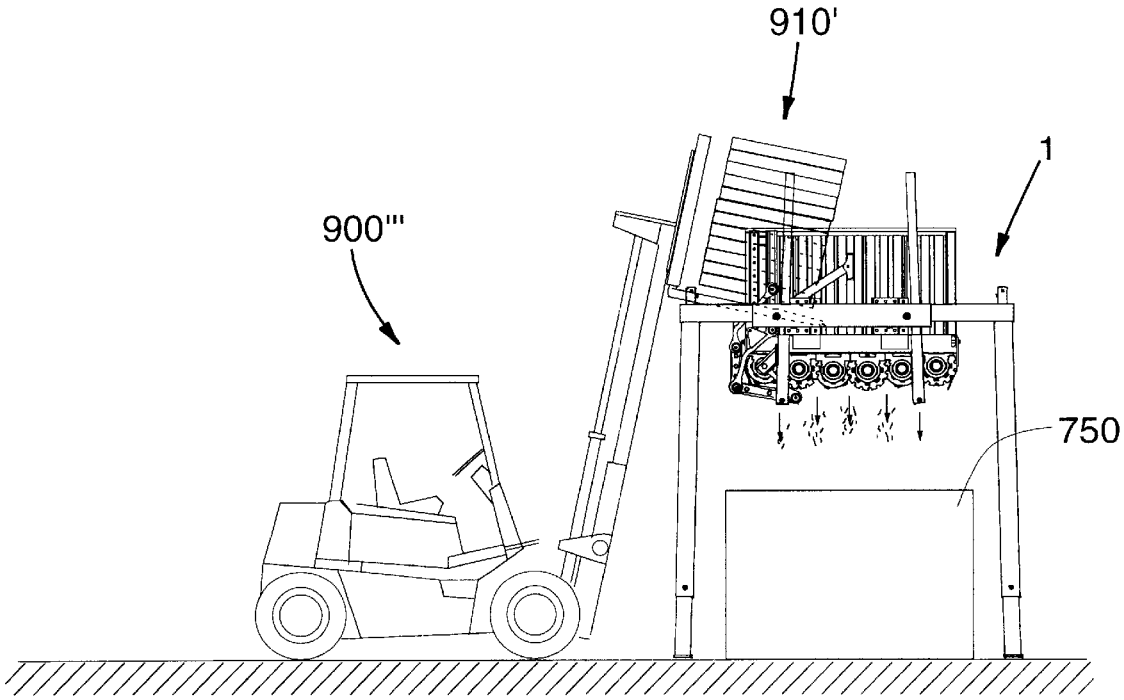
FIG. 15B is a schematic side view of a shredding apparatus according to the invention being charged with large scrap, such as pallets, by a fork lift truck, showing the pallets being scraped off the forks and into the shredding apparatus.

FIGS. 15A and 15B show a sequence where wood scrap 910', for instance pallets, is charged into the shredding apparatus 1, using a fork lift type vehicle 900'". In this case, it is desirable to collect the shredded material for later use, for example in a container 750 positioned underneath the shredding apparatus. Thus, the material 910' is charged into the shredding apparatus (FIGS. 15A and 15B) with the front door of the shredding apparatus opened, and the material is scraped off the bucket of the front loader by running the bucket over the threshold of the shredding apparatus front door (FIG. 15B). The shredded material is collected in the container for further treatment.

Figure 16B:
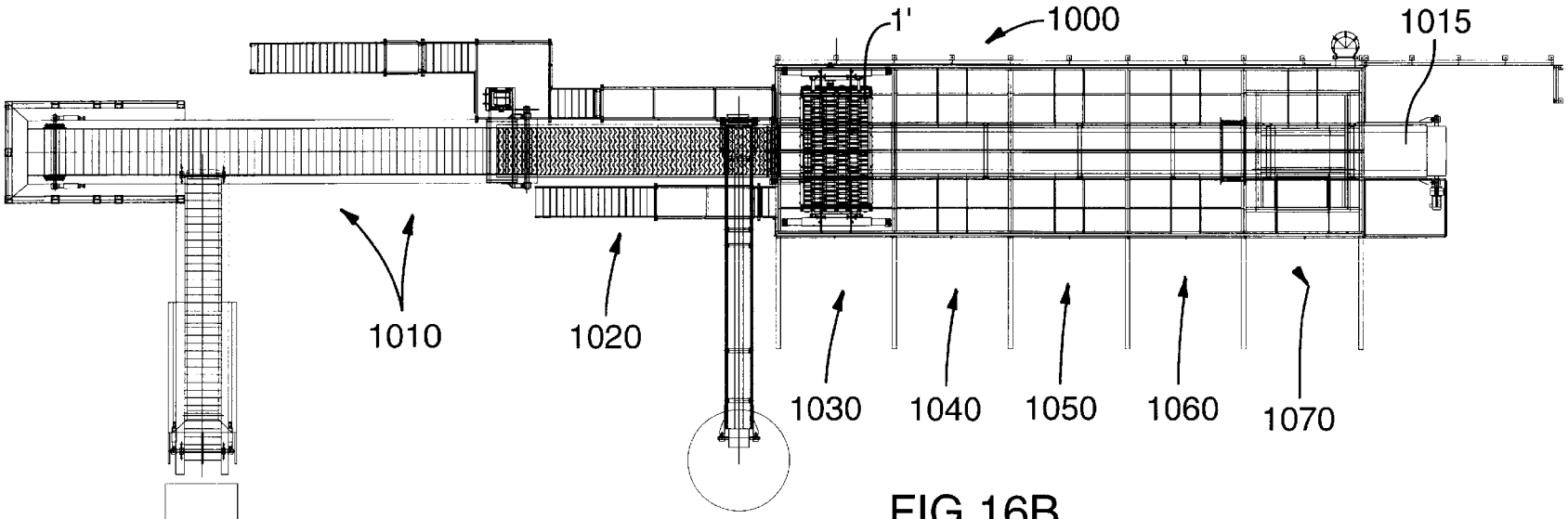
FIG. 16B is a schematic top view of a hanging shredding apparatus according to the invention being utilized within a large material sorting line.
Figure 16A:
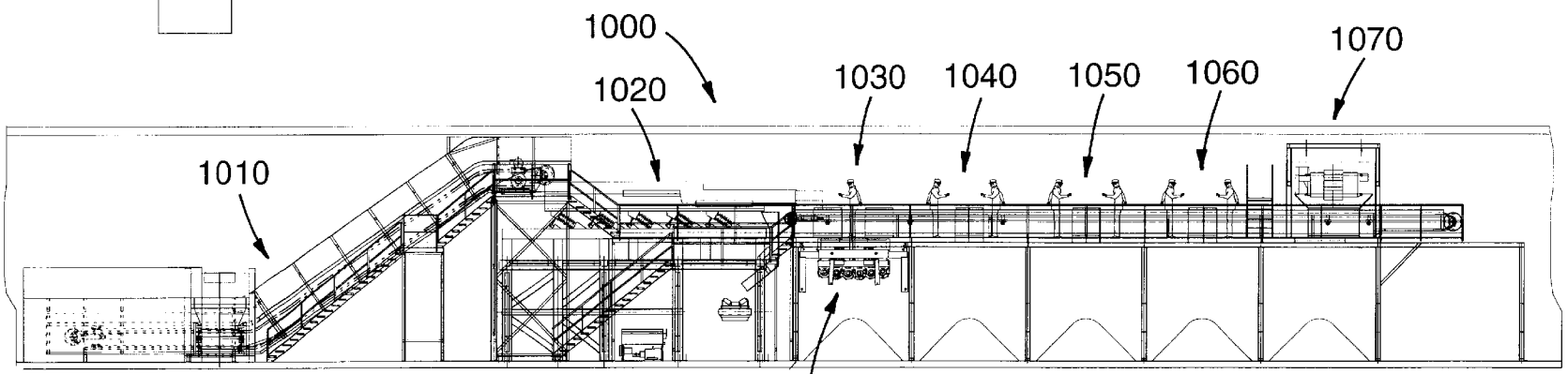
FIG. 16A is a schematic side view of a hanging shredding apparatus according to the invention being utilized within a large material sorting line.
Figure 16C:
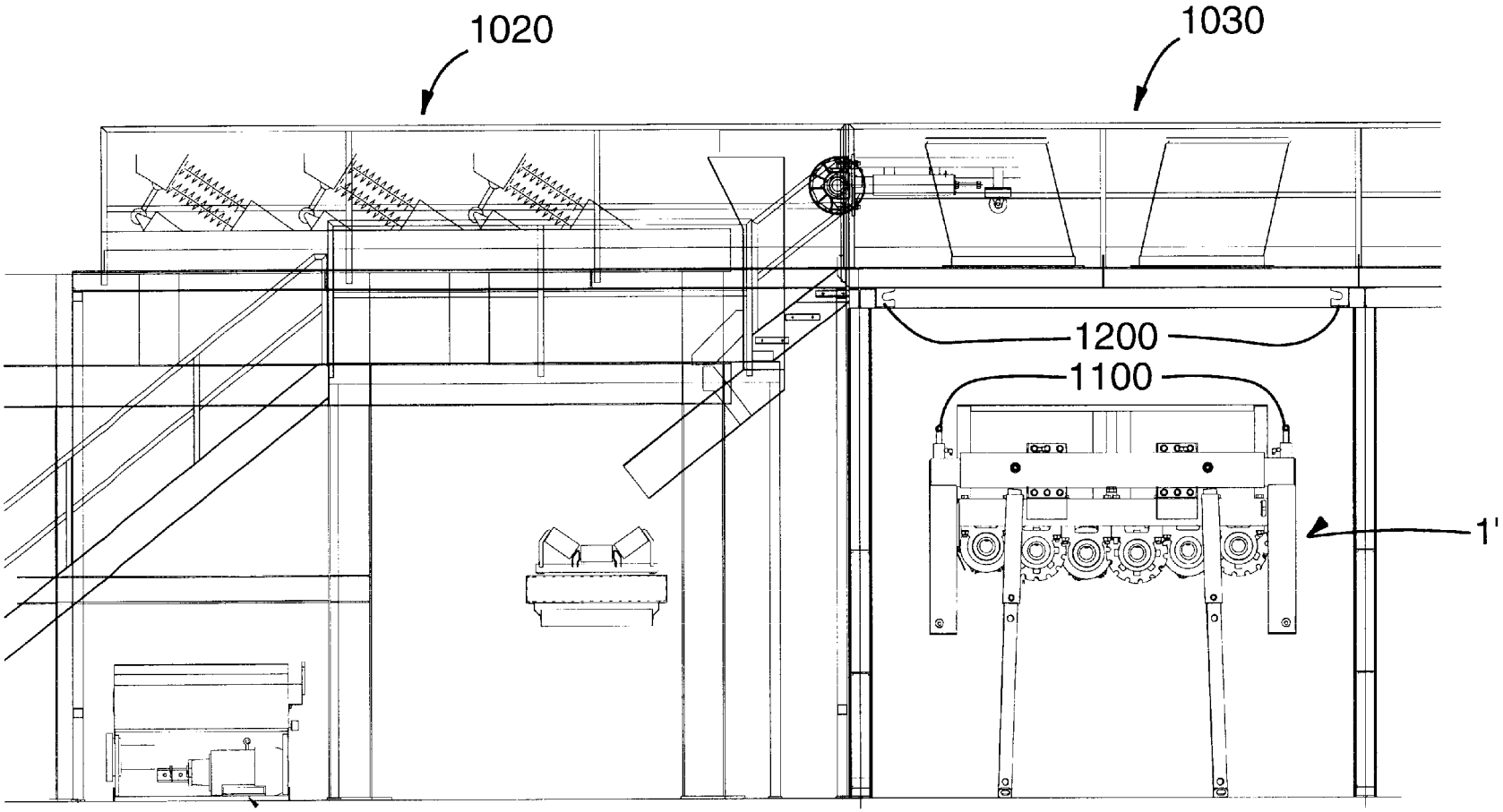
FIG. 16C is a schematic detail side view of a hanging shredding apparatus according to the invention being utilized within a large material sorting line as shown it in FIG. 16A.
Figure 16D:
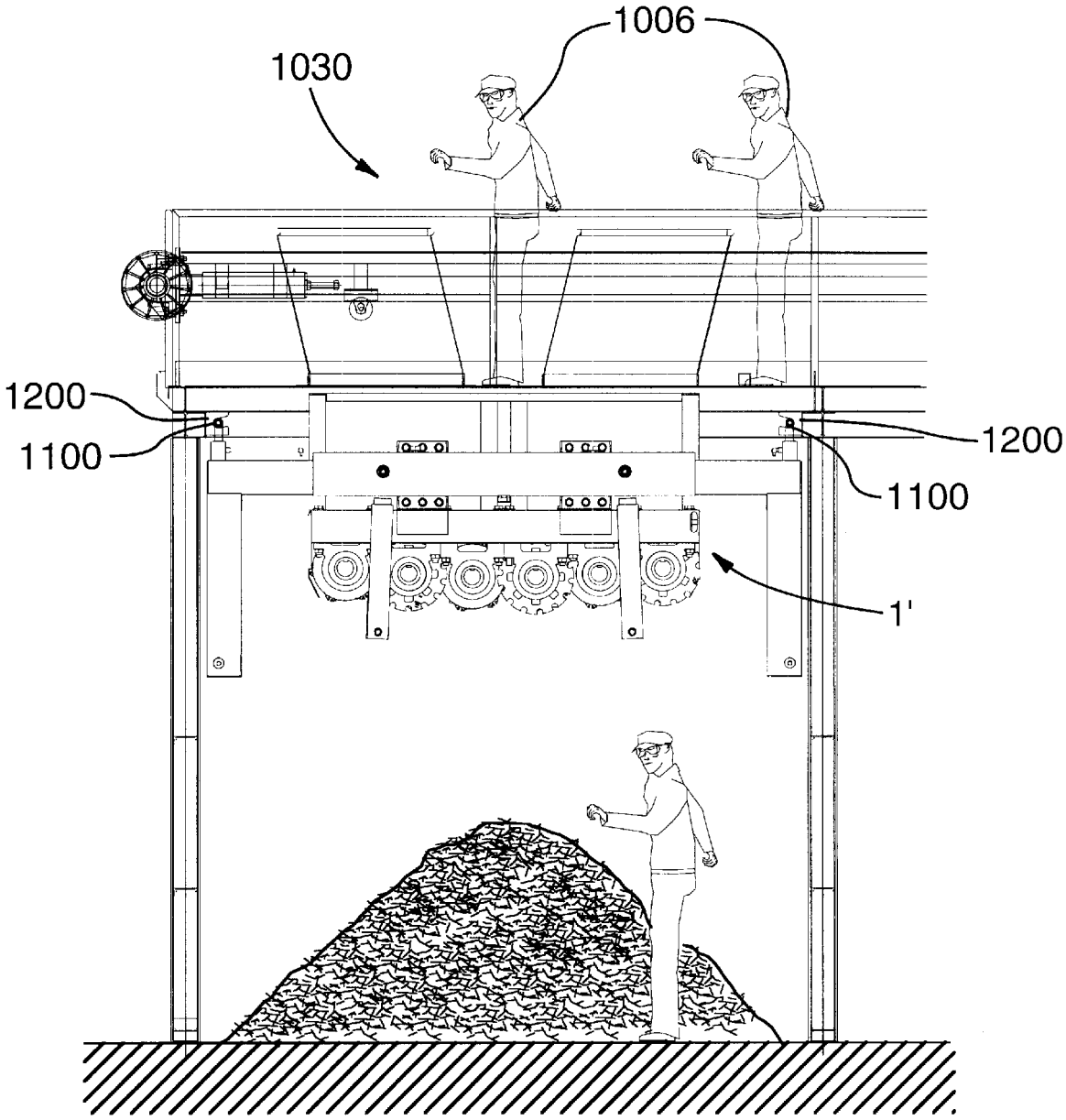
FIG. 16D is a further schematic detail side view of a hanging shredding apparatus according to the invention being utilized within a large material sorting line as shown in FIG. 16C.
Figure 16E:
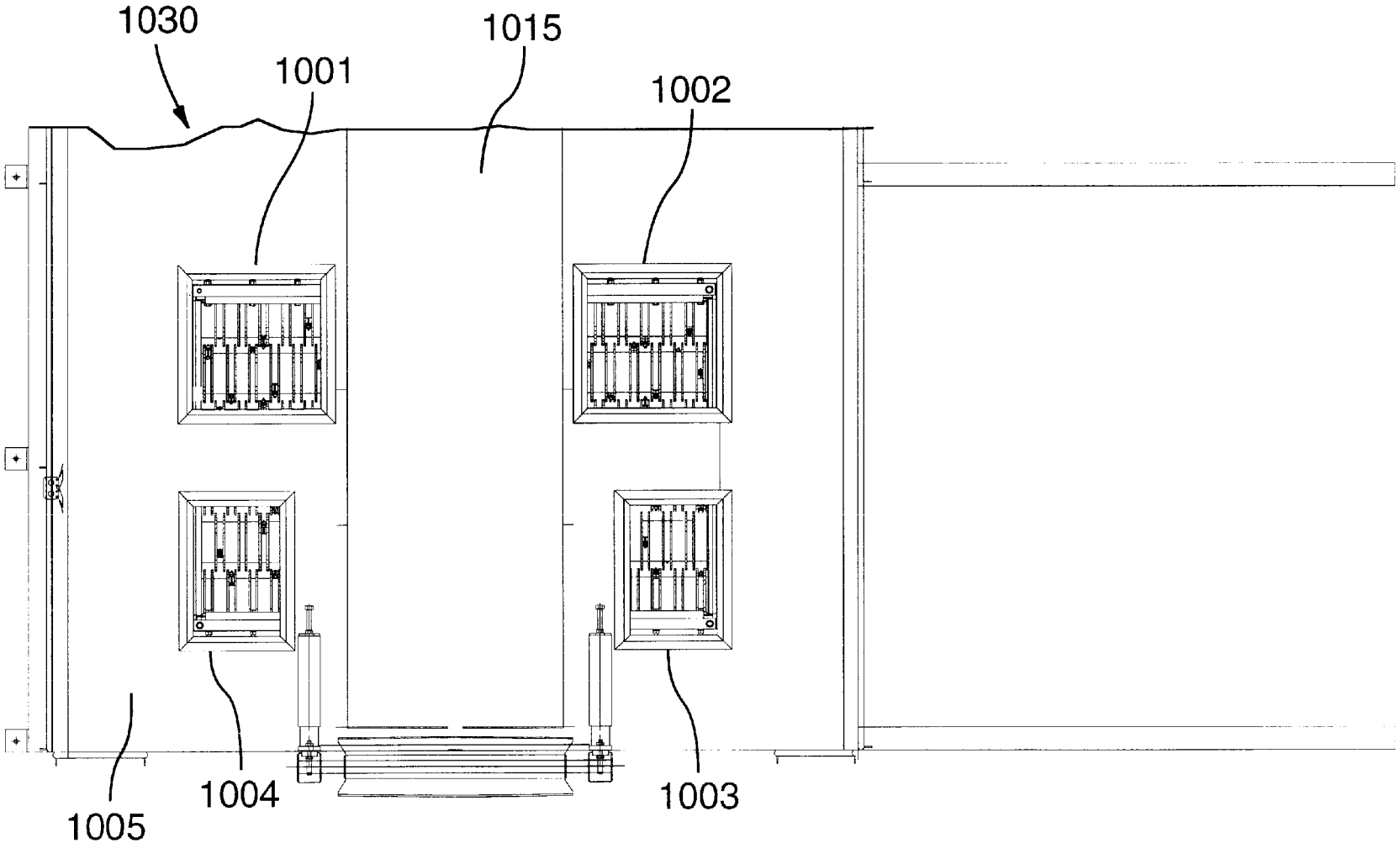
FIG. 16E is a schematic top view of a hanging shredding apparatus according to the invention being utilized within a large material sorting line as shown in FIG. 16D.
Figure 16F:
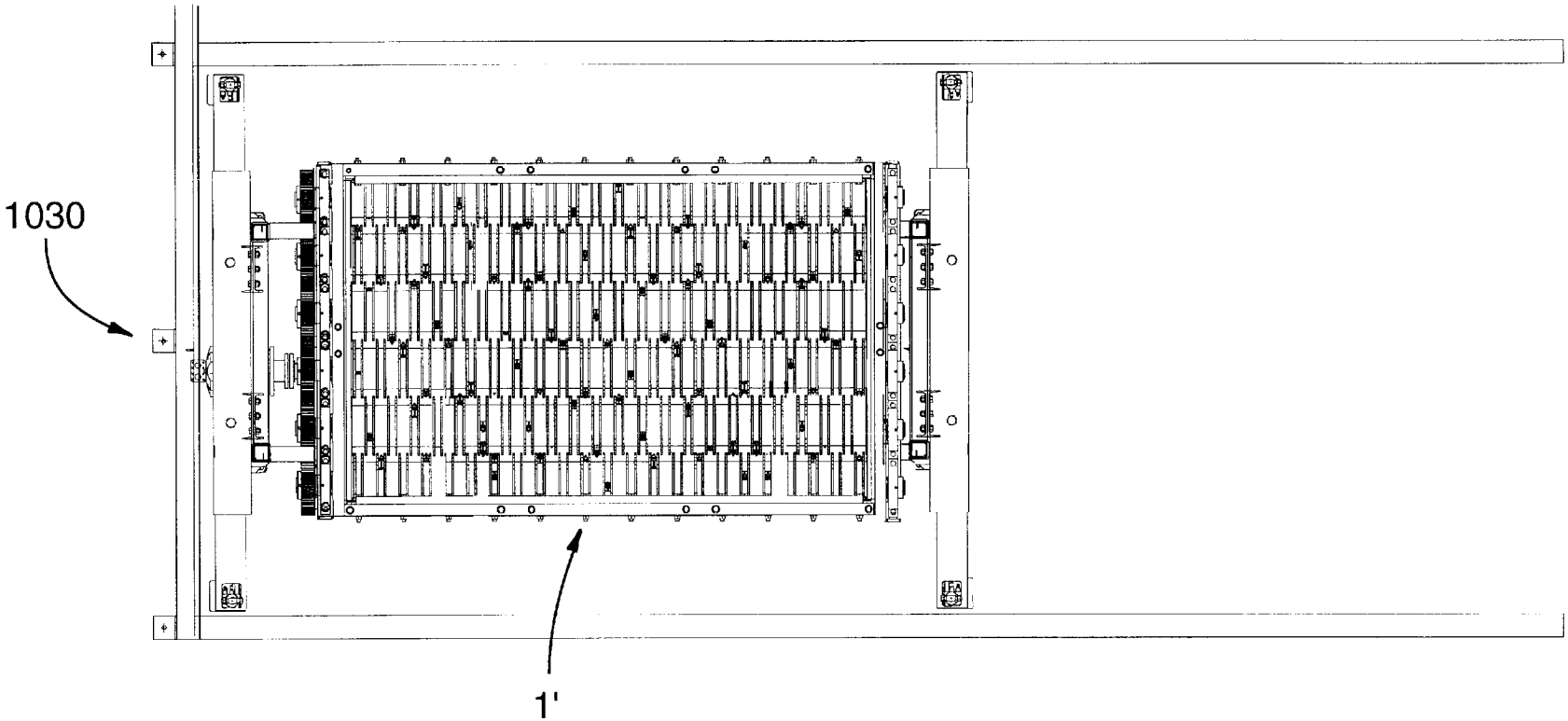
FIG. 16F is a schematic bottom view of a hanging shredding apparatus according to the invention being utilized within a large material sorting line as shown in FIG. 16D.

A further embodiment of a shredding apparatus 1' according to the invention is shown in FIGS. 16A to 16F. The shredding apparatus is used as a part of a materials sorting line 1000, having charging conveyors 1010 coupled to a vibrating bed 1020 leading to multiple material handling stations 1030, 1040, 1050, 1060, 1070. The shredding apparatus is, for example, arranged at the first material handling station 1030, preferably hanging underneath a conveyor 1015 moving material from the vibrating bed past all material handling stations. FIG. 16C shows the shredding apparatus 1' having hook means 1100 arranged adjacent the four main legs (see description above of earlier embodiment of shredding apparatus). Each hook means is arranged to engagingly cooperate with slotted holding means 1200 arranged underneath the first material handling station 1030, when the main legs are displaced vertically (as previously described), see FIG. 16D. Thus, when the shredding apparatus is lifted, using the lifting legs as described earlier, the shredding apparatus approaches the bottom of the first material handling station 1030. The main legs are extended vertically until the hook means 1100 fully engages the slotted holding means 1200, fixing the shredding apparatus underneath the first material handling station. Preferably, the first material handling station has a cover 1005 having a plurality of holes 1001, 1002, 1003, 1004, respectively, opening towards the underside of the first material handling station and the shredding apparatus hanging underneath. Sorters 1006 (see FIG. 16D) remove desired objects from the conveyor 1015 and drops them down the holes to be shredded.

It will be appreciated that the above description relates to the preferred embodiment by way of example only. Many variations on the invention will be obvious to those knowledgeable in the field, and such obvious variations are within the scope of the invention as described and claimed, whether or not expressly described. For example, the number of rolls used is a function of the desired capacity of the shredder and may range from 4, 6, 8, 10, 11, 12 or more rolls (under certain circumstances, a type of extended roll bed might be advantageous). The number of picks arranged per shaft is also chosen according to the desired capacity, keeping in mind that a large number of picks will mean a large number of cuts per time unit, making it necessary to increase the drive power. The number of pick cuts per time unit has to be chosen to comply with the desired shredding capacity and the material to be shredded. A slowly rotating roll bed, having a small number of picks per roll, may be used for low capacity and/or soft material shredding, whilst the same unit rotating at a higher speed may be used for higher capacity and/or harder material shredding. It is conceivable to use a roll bed which is substantially flat (as opposed to the sloping curve arrangement described earlier), the shredder will then lose some of the self-loading capacity.

What is claimed as the invention is:

1. A shedding apparatus comprising:

a plurality of rotatable rolls, each one of said plurality of rolls being rotatable around an axis of rotation in a first direction of rotation or a second direction of rotation, and each said roll having a plurality of angled teeth, said plurality of teeth arranged in at least one first set of teeth arranged in a first helical line across an outer surface of each of said rolls, circumferentially spaced apart a first angle and facing said first direction of rotation, and at least one second set of teeth arranged in a second helical line across said outer face of each of said rolls, circumferentially spaced apart said first angle and facing said second direction of rotation, said first helical line and said second helical line of teeth arranged to axially move material to be shredded when said rolls are rotated;

a frame structure having roll holding means, for journalling said plurality of rolls in a spaced apart relationship to form a bed of said plurality of rolls, said frame structure being surrounded by an enclosure provided with a charging open for material to be shredded and a discharging opening for shredded material;

a reversible drive means for supplying rotation force to rotate said plurality of rolls; and a plurality of gear means, arranged one for each said roll, for transferring said rotation force from one roll to an adjacent roll so that adjacent rolls rotate in opposite directions of rotation, wherein said each said roll of said plurality of rolls arranged in a middle portion of said bed of rolls are held in a lower position compared to said rolls arranged towards either of two outer sides of said bed of rolls, forming sloping sides of said bed of rolls down towards the middle of said bed of rolls in the longitudinal direction of said bed of rolls, to force material to be shredded to be moved from said outer sides to said middle portion of said bed of rolls.

2. A shredding apparatus as specified in claim 1, wherein said teeth are mounted on stand-off discs on a central shaft, there being substantial gaps between adjacent stand-off discs to permit smaller debris to fall through without need for shredding same.

3. A shredding apparatus as specified in claim 1, wherein said teeth are replaceable.

4. A shredding apparatus comprising:

a plurality of rotatable rolls, each one of said plurality of rolls being rotatable around an axis of rotation in a first direction of rotation or a second direction of rotation, and each said roll having a plurality of angled teeth, said plurality of teeth arranged in at least one first set of teeth arranged in a first helical line across an outer surface of each of said rolls, circumferentially sp apart a first angle and King said first direction of rotation, and at least one second set of teeth arranged in a second helical line across said outer face of each of said rolls, circumferentially spaced apart said first angle and facing said second direction of rotation, said first helical line and said second helical line of teeth arranged to axially move material to be shredded when said rolls are rotated;

a frame structure having roll holding means, for journalling said plurality of rolls in a spaced apart relationship to form a bed of said plurality of rolls, said frame structure being surrounded by an enclosure provided with a charging opening for material to be shredded and a discharging opening for shredded material;

a reversible drive means for supplying rotation force to rotate said plurality of rolls; and a plurality of gear means, arranged one for each said roll, for transferring said rotation force from one roll to an adjacent roll so that adjacent rolls rotate in opposite directions of rotation, wherein said reversible drive means comprises a first hydraulic cylinder and a second hydraulic cylinder, said first cylinder being anchored at one end and attached to a first gear means of a first roll at a first off-center mounting means on said first gear means, said second cylinder being anchored at one end and attached to a second gear means of a second roll at a second off-center mounting means on said second gear means, so that when said first cylinder is extended or retracted, said first gear means is made to rotate around said axis of rotation for said first roll, and when said second cylinder is extended or retracted, said second gear means is made to rotate around said axis of rotation for second said roll, causing said plurality of rolls to rotate driven by said plurality of gear means for each said roll, and wherein said first off-center mounting means and said second off-center mounting means are arranged at different angular locations on said first and second gear means, respectively, to prevent stalling of rotation force transfer from said first and second cylinders.

5. A shredding apparatus as specified in claim 4, wherein said teeth are mounted on stand-off discs on a central shaft, there being substantial gaps between adjacent standoff discs to permit smaller debris to fall through without need for shredding same.

6. A shredding apparatus as specified in claim 4, wherein said teeth are replaceable.

7. A shredding apparatus comprising:

a plurality of rotatable rolls, each one of said plurality of rolls being rotatable around an axis of rotation in a first direction of rotation or a second direction of rotation, and each said roll having a plurality of angled teeth, said plurality of teeth arranged in at least one first set of teeth arranged in a first helical line across an outer surface of each of said rolls, circumferentially spaced apart a first angle and facing said first direction of rotation, and at least one second set of teeth arranged in a second helical line across said outer face of each of said rolls, circumferentially spaced apart said first angle and facing said second direction of rotation, said first helical line and said second helical line of teeth arranged to axially move material to be shredded when said rolls are rotated;

a frame structure having roll holding means, for journalling said plurality of rolls in a spaced apart relationship to form a bed of said plurality of rolls, said frame structure being surrounded by an enclosure provided with a charging opening for material to be shredded and a discharging for shredded material;

a reversible drive means for supplying rotation force to rotate said plurality of rolls; and a plurality of gear means, arranged one for each said roll, for transferring said rotation force from one roll to an adjacent roll so that adjacent rolls rotate in opposite directions of rotation, wherein said apparatus further comprises, and a plurality of extendible and contractible lifting legs, to lift said shredding apparatus off ground, so that said main legs can be spaced apart and extended or contracted and spaced together for providing self-loading and self-erecting capabilities to said shredding apparatus, a plurality of main legs mounted at spaced-apart locations on said frame, to support said shredding apparatus off the ground, so that removable bin means may be positioned underneath said rolls.

8. A shredding apparatus as specified in claim 7, wherein said main legs comprise a first leg assembly and a second leg assembly, arranged on opposite sides of said frame, said first leg assembly comprising a first main housing attached to said frame via first frame extensions, a first main leg extending from said first main housing, protruding substantially downwards, at a first end of said first main housing and a second main leg, protruding substantially downwards, from a second end of said first main housing, said first main leg being held by a first holding means, slidingly arranged in said first main housing at said first end, between a retracted position and an extended position, and said second main leg being held by a second holding means, slidingly arranged in said first main housing at said second end, between a retracted position and an extended position, and said second leg assembly comprising a second main housing attached to said frame via second frame extensions, a third main leg extending from said second main housing, protruding substantially downwards, at a third end of said second main housing and a fourth main leg, protruding substantially downwards, from a fourth end of said second main housing, said third main leg being held by a third holding means, slidingly arranged in said second main housing at said third end, between a retracted position and an extended position, and said fourth main leg being held by a fourth holding means, slidingly arranged in said second main housing at said fourth end, between a retracted position and an extended position.

9. A shredding apparatus as specified in claim 8, wherein said sliding motion of said first holding means and said second holding means is provided by at least one first fluid cylinder arranged inside said first main housing, and said sliding motion of said third holding means and said fourth holding means is provided by at least one second fluid cylinder arranged inside said first main housing.

10. A shredding apparatus as specified in claim 8, wherein a first lifting leg and a second lifting leg are arranged at said first frame extension, said first lifting leg and said second lifting leg being extendably arranged in a downward direction, between a fully retracted position and a fully extended position, where said first lifting leg and said second lifting leg extends further downwards than said first main leg and said second main leg, and a third lifting leg and a fourth lifting leg are arranged at said second frame extension, said third lifting leg and said fourth lifting leg being extendably arranged in a downward direction, between a fully retracted position and a fully extended position, where said third lifting leg and said fourth lifting leg extends further downwards than said third main leg and said fourth main leg.

11. A shredding apparatus as specified in claim 8, wherein said plurality of rolls are arranged with their longitudinal direction running from said first leg assembly to said second leg assembly.

12. A shredding apparatus as specified in claim 8, wherein said plurality of rolls are arranged with their longitudinal direction perpendicular to a line connecting said first leg assembly and said second leg assembly.

13. A shredding apparatus as specified in clam 7, wherein said plurality of legs can be spaced apart and extended, or contracted and spaced together, for providing self-loading and self-erecting capabilities to said shredding apparatus.

14. A shredding apparatus as specified in claim 13, wherein there are four lifting legs and four main legs, said lifting legs being extendable and retractable to take the weight of said apparatus off said main legs, for repositioning of said main legs, whereby said apparatus may be readily loaded onto or unloaded from a trailer.

15. A shredding apparatus as specified in claim 7, wherein said teeth are mounted on stand-off discs on a central shaft, there being substantial gaps between adjacent standoff discs to permit smaller debris to fall through without need for shredding same.

16. A shredding apparatus as specified in claim 7, wherein said teeth are replaceable.

* * * * *